US010323491B2

(12) United States Patent
Palmer et al.

(10) Patent No.: US 10,323,491 B2
(45) Date of Patent: Jun. 18, 2019

(54) VARIABLE RATE STEAM INJECTION, INCLUDING VIA SOLAR POWER FOR ENHANCED OIL RECOVERY, AND ASSOCIATED SYSTEMS AND METHODS

(71) Applicant: GlassPoint Solar, Inc., Fremont, CA (US)

(72) Inventors: Daniel Palmer, Muscat (OM); Peter Emery von Behrens, Menlo Park, CA (US); John Setel O'Donnell, Palo Alto, CA (US); Ali Hassan Ibrahim Mohammadi, Muscat (OM)

(73) Assignee: GlassPoint Solar, Inc., Fremont, CA (US)

( * ) Notice: Subject to any disclaimer, the term of this patent is extended or adjusted under 35 U.S.C. 154(b) by 172 days.

(21) Appl. No.: 15/253,294

(22) Filed: Aug. 31, 2016

(65) Prior Publication Data

US 2017/0074082 A1 Mar. 16, 2017

Related U.S. Application Data

(60) Provisional application No. 62/213,078, filed on Sep. 1, 2015.

(51) Int. Cl.
*E21B 43/24* (2006.01)
*E21B 36/00* (2006.01)

(52) U.S. Cl.
CPC ..... *E21B 43/24* (2013.01); *E21B 36/003* (2013.01); *E21B 43/2406* (2013.01)

(58) Field of Classification Search
CPC ..... E21B 43/24; E21B 43/168; E21B 43/166
See application file for complete search history.

(56) References Cited

U.S. PATENT DOCUMENTS

| | | | | |
|---|---|---|---|---|
| 1,240,890 | A | 9/1917 | Shuman et al. | |
| 3,847,136 | A | 11/1974 | Salvail | |
| 3,962,873 | A | 6/1976 | Davis | |
| 4,174,752 | A | 11/1979 | Slater et al. | |
| 4,209,222 | A | 6/1980 | Posnansky | |
| 4,211,613 | A * | 7/1980 | Meckler | C02F 1/14 203/11 |

(Continued)

FOREIGN PATENT DOCUMENTS

| | | | |
|---|---|---|---|
| CN | 2776908 | Y | 5/2006 |
| CN | 101126553 | A | 2/2008 |

(Continued)

OTHER PUBLICATIONS

Adventures in Energy, "Extracting Oil and Natural Gas." 1 pages, accessed Oct. 7, 2013.

(Continued)

*Primary Examiner* — Kenneth L Thompson
(74) *Attorney, Agent, or Firm* — Perkins Coie LLP

(57) ABSTRACT

Systems and methods for variable rate steam injection, including via solar power for enhanced oil recovery, are disclosed. Several embodiments include using the variable nature of solar-generated steam to improve the efficiency and cost-effectiveness of enhanced oil recovery processes. In particular embodiments, the variable rate injection can provide more uniform steam distribution in an oil-bearing formation, at a lower cost than if the same amount of steam were provided on a continuous basis.

45 Claims, 35 Drawing Sheets

(56) References Cited

U.S. PATENT DOCUMENTS

| | | | | |
|---|---|---|---|---|
| 4,333,447 | A | 6/1982 | Lemrow et al. | |
| 4,513,733 | A | 4/1985 | Braun | |
| 5,018,576 | A | 5/1991 | Udell et al. | |
| 5,058,675 | A | 10/1991 | Travis | |
| 6,233,914 | B1 | 5/2001 | Fisher | |
| 6,237,337 | B1 | 5/2001 | Bronicki et al. | |
| 6,279,312 | B1 | 8/2001 | Hennecke | |
| 7,992,553 | B2 | 8/2011 | Le Lievre | |
| 8,167,041 | B2 | 5/2012 | Chiesa et al. | |
| 8,701,773 | B2 | 4/2014 | O'Donnell et al. | |
| 8,739,774 | B2 | 6/2014 | O'Donnell et al. | |
| 8,748,731 | B2 | 6/2014 | MacGregor et al. | |
| 8,752,542 | B2 | 6/2014 | O'Donnell et al. | |
| 9,777,562 | B2 * | 10/2017 | Lastra | E21B 43/24 |
| 2002/0108745 | A1 | 8/2002 | Kimura | |
| 2004/0048770 | A1 | 3/2004 | Howard et al. | |
| 2006/0048770 | A1 | 3/2006 | Meksvanh et al. | |
| 2006/0124360 | A1 | 6/2006 | Lee et al. | |
| 2007/0056726 | A1 | 3/2007 | Shurtleff | |
| 2007/0168170 | A1 | 7/2007 | Thomas | |
| 2008/0127647 | A1 | 6/2008 | Leitner | |
| 2008/0216822 | A1 | 9/2008 | Lazzara et al. | |
| 2008/0257552 | A1 | 10/2008 | Shurtleff et al. | |
| 2008/0308094 | A1 | 12/2008 | Johnston | |
| 2009/0056699 | A1 | 3/2009 | Mills et al. | |
| 2009/0056944 | A1 | 3/2009 | Nitschke | |
| 2010/0000773 | A1 | 1/2010 | Yoshinaga et al. | |
| 2011/0036090 | A1 | 2/2011 | Rop | |
| 2011/0094755 | A1 | 4/2011 | Corbett et al. | |
| 2011/0126824 | A1 | 6/2011 | Conlon et al. | |
| 2011/0277470 | A1 | 11/2011 | Benyaminy et al. | |
| 2012/0125611 | A1 | 5/2012 | Ayirala et al. | |
| 2012/0138293 | A1 | 6/2012 | Kaminsky et al. | |
| 2012/0138316 | A1 | 6/2012 | Matzakos | |
| 2012/0152307 | A1 | 6/2012 | MacGregor et al. | |
| 2012/0167873 | A1 | 7/2012 | Venetos et al. | |
| 2012/0234311 | A1 | 9/2012 | Johnson et al. | |
| 2012/0255309 | A1 | 10/2012 | Venetos et al. | |
| 2012/0273195 | A1 | 11/2012 | Wheeler et al. | |
| 2012/0274069 | A1 | 11/2012 | Venetos et al. | |
| 2013/0091842 | A1 | 4/2013 | Kaufmann et al. | |
| 2013/0092153 | A1 | 4/2013 | O'Donnell et al. | |
| 2013/0105151 | A1 * | 5/2013 | Rop | E21B 43/24 166/263 |
| 2013/0206134 | A1 | 8/2013 | O'Donnell et al. | |
| 2013/0220305 | A1 | 8/2013 | von Behrens | |
| 2014/0069416 | A1 | 3/2014 | von Behrens | |
| 2014/0190469 | A1 | 7/2014 | O'Donnell et al. | |
| 2014/0216717 | A1 | 8/2014 | O'Donnell et al. | |
| 2014/0318792 | A1 | 10/2014 | Chen et al. | |
| 2014/0326234 | A1 | 11/2014 | O'Donnell et al. | |
| 2014/0345599 | A1 | 11/2014 | O'Donnell et al. | |
| 2014/0347757 | A1 | 11/2014 | MacGregor et al. | |
| 2015/0144125 | A1 | 5/2015 | von Behrens | |
| 2015/0285048 | A1 | 10/2015 | O'Donnell et al. | |
| 2015/0295158 | A1 | 10/2015 | O'Donnell et al. | |
| 2016/0112484 | A1 | 4/2016 | Liu | |
| 2016/0116186 | A1 | 4/2016 | Brown et al. | |
| 2017/0009561 | A1 * | 1/2017 | Mokheimer | E21B 43/24 |
| 2017/0219203 | A1 * | 8/2017 | Chandra | E21B 43/24 |

FOREIGN PATENT DOCUMENTS

| | | | |
|---|---|---|---|
| CN | 101270675 | A | 9/2008 |
| CN | 101280966 | A | 10/2008 |
| CN | 201359397 | | 12/2009 |
| CN | 202598911 | | 12/2012 |
| DE | 102004013590 | A1 | 10/2005 |
| ES | 2327991 | A1 | 11/2009 |
| JP | 56085508 | | 7/1981 |
| JP | 2001082104 | | 3/2001 |
| WO | WO-0181240 | A2 | 11/2001 |
| WO | WO-2008153922 | A1 | 12/2008 |
| WO | WO-2009012378 | A1 | 1/2009 |
| WO | WO-2009131438 | A2 | 10/2009 |
| WO | WO-2010040957 | A2 | 4/2010 |
| WO | WO-2011053863 | A2 | 5/2011 |
| WO | WO-2012006257 | A2 | 1/2012 |
| WO | WO-2012006258 | A2 | 1/2012 |
| WO | WO-2014107688 | A1 | 7/2014 |

OTHER PUBLICATIONS

Adventures in Energy, "Separating Oil, Natural Gas and Water." 1 page, accessed Oct. 7, 2013.

Bierman et al "Performance of Enclosed Trough OTSG for Enhanced Oil Recovery," SolarPaces 2013, 11 pages.

International Search Report and Written Opinion for International Patent Application No. PCT/US2016/049724, Applicant: Glasspoint Solar, Inc., dated Dec. 6, 2016, 45 pages.

Bierman et al "Solar Enhanced Oil Recovery Plant in South Oman," SolarPaces 2013; pp. 10.

BrightSource Limitless, "Coalinga Project Facts, A BrightSource Energy Concentrating Solar Power Project," Fact Sheet, accessed Sep. 19, 2013, http://www.brightsourceenergy.com/stuff/contentmgr/files/0/ad5d33a2bc493a5079b5dda609724238/folder/coalinga_fact_sheet.pdf, 2 pages.

BrightSource Limitless, "Enhanced Oil Recovery Project—Coalinga," accessed Sep. 19, 2013, http://www.brightsourceenergy.com/coalinga, 2 pages.

Champion Technologies, "Enhanced Oil Recovery." 2 pages, accessed Oct. 7, 2013.

Proz, 'On the edge of manufacturing tolerance' [bulletin board], Mar. 12, 2005 [retrieved on Jan. 7, 2014]. Retrieved from the internet <http://www.proz.com/kudoz/English/military_defense/968330-on_the_edge_of_manufacturing_tolerance.html>.

The Linde Group, "Enhanced Oil Recovery (EOR)", 1 page, accessed Oct. 7, 2013.

* cited by examiner

| Description of Example wells | | | Example Well Parameters | | | | | Application of Controller logic | | | | | |
|---|---|---|---|---|---|---|---|---|---|---|---|---|---|
| Well Types | Name | Description | Steam Demand | Peak Steam Injection | SOR (V/V) | Minimum Steam Rate | Injection Poltential | Operating Mode Expected | Ranking | Operating Mode during Solar Day | Daytime Calculation | Operating mode During Night | Night Time Calculation |
| 1 | High Value New Injector | Newly drilled well in a high quality part of the reservoir. Steam breakthrough has not occurred at the producer wells in the pattern. The operators objective is to maximize injection to accellerate production. | 400 | 700 | 3 | 200 | 12 | "A" type well | Highest Rank | Valve open to allow peak flow | Set to peak flow | Valve to night flow setting | Night flow is the flow rate required to satisfy steam demand calculation |
| 2 | High Value Old Injector | Well in high quality part of the reservoir that has been injecting steam for some time. Steam breakthrough has occurred at the producer wells in the pattern. This well is high value but most of the steam can be injected during the solar day. | 150 | 600 | 5 | 80 | 20 | "B" Type Well | High Rank | Valve open to allocated day flow setting | Day flow calculated to satify daily steam demand, assumed operating at min flow during the night | Valve set to minimum flow rate | Set to minimum flow |
| 3 | Fracture limited new injector | Newly drilled well in a high quality part of the reservoir. Flow rate is limited by potential fracturing of the overburden hence max rate is limited to be much lower than well 1. Steam breakthrough has not occurred at the producer wells in the pattern. | 150 | 160 | 4 | 50 | 20 | "A" type well | High Rank | Valve set to prevent over pressure of the well | Valve set to wellhead pressure limit | Valve to night flow setting | Night flow is the flow rate required to satisfy steam demand calculation |

*FIG. 13A*

| Description of Example wells | | | Example Well Parameters | | | | | Application of Controller logic | | | | | |
|---|---|---|---|---|---|---|---|---|---|---|---|---|---|
| Well Types | Name | Description | Steam Demand | Peak Steam Injection | SOR (V/V) | Minimum Steam Rate | Injection Poltential | Operating Mode Expected | Ranking | Operating Mode during Solar Day | Daytime Calculation | Operating mode During Night | Night Time Calculation |
| 4 | Low Value Injector | Newly drilled well in a low quality or thin part of the reservoir. Steam breakthrough has not occurred at the producer wells in the pattern, injectivity is low. Due to reservoir thickness or quality, SOR is low. | 100 | 120 | 6 | 50 | 3 | "A" type well | Low Rank | Valve fully open, provided steam is available | Set to full open provided steam is available and not used by higher ranked wells | Valve to night flow setting | Night flow is the flow rate required to satisfy steam demand calculation |
| 5 | Old Old Low value Injector | Well in low quality part of the reservoir that has been injecting steam for some time. Steam breakthrough has occurred at the producer wells in the pattern, very little oil is produced at offset producers. | 80 | 500 | 8 | 20 | 5 | "B" Type Well | Lowest Rank | Valve fully open, provided steam is available | Set to full open provided steam is available and not used by higher ranked wells | Valve set to minimum flow rate | Set to minimum flow |

*FIG. 13B*

SolarFlow(1) = SolarPeak * SolarFraction(1) — Eq 4.10

OTSG(1) = OTS Eq 4.11 OR OTSG(1) = OTSGF OR OTSG(1) = Mfsum – [SolarFlow(1) + HRSGF = DuctMinF]

TotalSteamOutput(1) = SolarFlow(1) + HRSGF + DuctMinF + OTSG(1) — Eq 4.9

| Time Segment (i) | (i) | 1 | 2 | 3 | 4 | 5 | 6 | 7 | 8 | 9 | 10 | 11 | 12 | 13 |
|---|---|---|---|---|---|---|---|---|---|---|---|---|---|---|
| Time of Day | | 7:00 | 7:30 | 8:00 | 8:30 | 9:00 | 9:30 | 10:00 | 10:30 | 11:00 | 11:30 | 12:00 | 12:30 | 13:00 |
| % solar of peak | *SolarPercentage(i)* | 0% | 0% | 0% | 10% | 20% | 40% | 65% | 80% | 90% | 95% | 100% | 100% | 98% |
| Solar Steam | *SolarFlow(i)* | 0 | 0 | 0 | 120 | 240 | 480 | 780 | 960 | 1080 | 1140 | 1200 | 1200 | 1176 |
| HRSG Steam | *HRSGF* | 50 | 50 | 50 | 50 | 50 | 50 | 50 | 50 | 50 | 50 | 50 | 50 | 50 |
| Duct Burner steam | *DuctMinF* | 25 | 25 | 25 | 25 | 25 | 25 | 25 | 25 | 25 | 25 | 25 | 25 | 25 |
| OTSG Steam | *OTSG(i)* | 400 | 400 | 400 | 400 | 342.1 | 102.14 | 100 | 100 | 100 | 100 | 100 | 100 | 100 |
| Solar Hours | *SD(i)* | 0 | 0 | 0 | 0.5 | 0.5 | 0.5 | 0.5 | 0.5 | 0.5 | 0.5 | 0.5 | 0.5 | 0.5 |
| | | | | | | | | | | | | | | |
| Total Steam | *TotalSteamOutput(i)* | 475 | 475 | 475 | 657.14 | 657.14 | 657.14 | 955 | 1135 | 1255 | 1315 | 1375 | 1375 | 1351 |

*FIG. 15A*

| Well Rank | Well | Steam/Oil Ratio | Target Rate, TSPD | Min Flow, TSPD | Peak Flow, TSPD | Delivered steam, TSPD | Well Type? | Night Flow, TSPD | Adjusted Peak Flow, TSPD | Cumulative Night Flow, TSPD |
|---|---|---|---|---|---|---|---|---|---|---|
| (n) | - | SOR | TR | MF | PF | DS | WellType | NF | APF | CN |
| 1 | Well 1 | 3 | 400 | 200 | 500 | 325 | A | 328.6 | 500.0 | 657.1 |
| 2 | Well 3 | 4 | 150 | 50 | 160 | 96 | A | 142.9 | 160.0 | 328.6 |
| 3 | Well 2 | 5 | 150 | 80 | 600 | 297 | B | 80.0 | 248.0 | 185.7 |
| 4 | Well 4 | 6 | 100 | 50 | 120 | 79 | A | 85.7 | 120.0 | 105.7 |
| 5 | Well 5 | 8 | 80 | 20 | 500 | 220 | B | 20.0 | 164.0 | 20.0 |

Eq 4.4 DS(1)=[PF(1)*SD/24] - [MF(1)*(24-SD)/24

Eq 4.2 NF(1)=[TF(1)-(PF(1)*(SD/24))]*(24/(24-SD))

Eq 4.3 APF(1)=[TF(1)-(MF(1)*((24-SD)/24))]*24/SD)

Eq 4.5 & 4.6 CN(1) = NF(1) + SN(2) CN(5) - MF(5)

*FIG. 15B*

| Well Rank | Well | Steam/Oil Ratio | Target Rate, TSPD | Min Flow, TSPD | Peak Flow, TSPD | Steam Value, TSPD |
|---|---|---|---|---|---|---|
| (n) | - | *SOR* | *TR* | *MF* | *PF* | *SteamValue* |
| 1 | Well 1 | 3 | 400 | 200 | 500 | $ 91 |
| 2 | Well 2 | 5 | 150 | 80 | 600 | $ 49 |
| 3 | Well 3 | 4 | 150 | 50 | 160 | $ 65 |
| 4 | Well 4 | 6 | 100 | 50 | 120 | $ 38 |
| 5 | Well 5 | 8 | 80 | 20 | 500 | $ 25 |
| | | Total | 880 | 400 | 1880 | |

SteamValue(1) = [(OilPrice/SOR) – SteamPrice] Eq 4.1

*FIG. 15C*

SteamFlow(1,1)=SB(1,1)-CN(1) or NF(1) or APF(1)
SteamFlow(2,1)=SB(2,1)-CN(2) or NF(2) or APF(2)
……
SteamFlow(5,1)=SB(5,1)-CN(5) or NF(5) or APF(5)
Eq 4.12 & 4.13

Steam Flow (initial estimate) >> *SteamFlow(n,i)*

| Well Rank (n) / *Time Segment (i)* | *1* | *2* | *3* | *4* | *5* | *6* | *7* | *8* | *9* | *10* | *11* | *12* | *13* |
|---|---|---|---|---|---|---|---|---|---|---|---|---|---|
| n=1 | 329 | 329 | 329 | 329 | 329 | 448 | 500 | 500 | 500 | 500 | 500 | 500 | 500 |
| n=2 | 143 | 143 | 143 | 143 | 160 | 160 | 160 | 160 | 160 | 160 | 160 | 160 | 160 |
| n=3 | 80 | 80 | 80 | 80 | 248 | 248 | 248 | 248 | 248 | 248 | 248 | 248 | 248 |
| n=4 | 86 | 86 | 86 | 86 | 86 | 120 | 120 | 120 | 120 | 120 | 120 | 120 | 120 |
| n=5 | 20 | 20 | 20 | 20 | 43 | 129 | 164 | 164 | 164 | 164 | 164 | 164 | 164 |

*FIG. 15D*

SB(1,1)=TotalSteamOutput(1)
SB(2,1)=SB(1,1)-SteamFlow(2,1)
Eq 4.7 & 4.8

Steam Balance >> *SB(n,i)*

| Well Rank (n) | *Time Segment (i)* | *1* | *2* | *3* | *4* | *5* | *6* | *7* | *8* | *9* | *10* | *11* | *12* | *13* |
|---|---|---|---|---|---|---|---|---|---|---|---|---|---|---|
| n=1 | | 329 | 329 | 329 | 329 | 536 | 657 | 905 | 1085 | 1205 | 1265 | 1325 | 1325 | 1301 |
| n=2 | | 186 | 186 | 186 | 186 | 376 | 497 | 745 | 925 | 1045 | 1105 | 1165 | 1165 | 1141 |
| n=3 | | 106 | 106 | 106 | 106 | 128 | 249 | 497 | 677 | 797 | 857 | 917 | 917 | 893 |
| n=4 | | 20 | 20 | 20 | 20 | 43 | 129 | 377 | 557 | 677 | 737 | 797 | 797 | 773 |
| n=5 | Excess Steam Balance >> Excess(i) | 0 | 0 | 0 | 0 | 0 | 0 | 213 | 393 | 513 | 573 | 633 | 633 | 609 |

Excess(1) - SB(5,1),
Excess(2) - SB(5,2)
Eq 4.15

*FIG. 15E*

AdjSteamFlow(1,1) = SteamFlow(1,1) + [Excess(1) * ExtraCapacity%(1)]
AdjSteamFlow(2,1) = SteamFlow(2,1) + [Excess(1) * ExtraCapacity%(2)]
AdjSteamFlow(3,1) = SteamFlow(3,1) + [Excess(1) * ExtraCapacity%(3)]
Eq 4.18

Adjusted Steam Flow >> *AdjSteamFlow(n,i)*

| Well Rank (n) | *Time Segment (i)* | *1* | *2* | *3* | *4* | *5* | *6* | *7* | *8* | *9* | *10* | *11* | *12* | *13* |
|---|---|---|---|---|---|---|---|---|---|---|---|---|---|---|
| n=1 | | 329 | 329 | 329 | 329 | 329 | 448 | 500 | 500 | 500 | 500 | 500 | 500 | 500 |
| n=2 | | 143 | 143 | 143 | 143 | 160 | 160 | 160 | 160 | 160 | 160 | 160 | 160 | 160 |
| n=3 | | 80 | 80 | 80 | 80 | 248 | 248 | 357 | 449 | 510 | 541 | 572 | 572 | 560 |
| n=4 | | 86 | 86 | 86 | 86 | 86 | 120 | 120 | 120 | 120 | 120 | 120 | 120 | 120 |
| n=5 | | 20 | 20 | 20 | 20 | 43 | 129 | 268 | 356 | 415 | 444 | 473 | 473 | 461 |

*FIG. 15F*

| Extra Steam Available for "B" Wells, TSPD | | Steam supplied to well, TSPD | Steam balance relative to target flow, TSPD |
|---|---|---|---|
| *ExtraCapacity* | | SteamSupply | Steam Balance |
| 0 | 0% | 376 | (23.6) |
| 0 | 0% | 149 | (1.3) |
| 352 | 51% | 197 | 46.7 |
| 0 | 0% | 96 | (4.3) |
| 336 | 49% | 118 | 37.8 |

ExtraCapacity(1) = PF(1) - AF(1) Eq 4.16

SteamSupply(1) = [AdjsSteamFlow(1,1) + AdjsSteamFlow(1,2) + ... + AdjsSteamFlow(1,48)]/48 Eq 4.19

SteamBalance(1) = SteamSupply(1) – TR(1) Eq 4.20

*FIG. 15G*

VARIABLE RATE STEAM INJECTION, INCLUDING VIA SOLAR POWER FOR ENHANCED OIL RECOVERY, AND ASSOCIATED SYSTEMS AND METHODS

CROSS-REFERENCE TO RELATED APPLICATION

The present application claims priority to U.S. Provisional Application No. 62/213,078, filed Sep. 1, 2015, and incorporated herein by reference.

TECHNICAL FIELD

The present technology is directed generally to variable rate steam injection, including via solar power for enhanced oil recovery, and associated systems and methods.

BACKGROUND

Thermal enhanced oil recovery (EOR) is a class of techniques well-known to those skilled in the art for increasing the oil production rate and ultimate oil recovery fraction in oil drilling processes. Thermal EOR has been particularly applied to oil-bearing formations where the oil has low mobility, whether due to characteristics of the formation (low permeability), or to characteristics of the oil (high viscosity), or both.

Several steam injection processes are well-known in the art, including the use of vertical and horizontal injection wells, and the use of continuous or intermittent steam injection. In some cases, steam is co-injected with gases, surfactants, solvents, or other substances that change the physical and chemical properties of the steam and the oil in the formation. Well-known techniques include SAGD (steam-assisted gravity drainage), SAGOGD (steam-assisted gas-oil gravity drainage), CSS (cyclic steam stimulation), steamflood, and steam drive.

The cost of steam represents a significant fraction of the total cost of oil production in thermal EOR operations. Accordingly, efficiently and cost-effectively supplying steam is a subject of key importance to the economics of oil production operations. Existing advances in the design and construction of steam generators, and systems for cost-efficiently treating feedwater, include reusing water produced from the oilfield and controlling the distribution and injection of steam across a field comprising multiple concurrent or sequentially operating injection wells. FIG. 1A schematically illustrates a conventional steam generation and distribution arrangement in which one or more centralized steam generation facilities deliver steam to a plurality of injection wells. In this arrangement, one or more steam generators feed a plurality of steam injection wells through a distribution network. The flow to each injection well can be apportioned in a manner that distributes stream relatively uniformly across the injection wells, reducing the effect of pressure drops in the distribution network and variations in subsurface pressure or injectivity. Accordingly, the system can include a flow rate control device in the steam flow path to each well, which is typically installed either at the wellhead or at a distribution manifold. Such rate control devices can include a "choke" which establishes critical flow conditions at the desired steam injection rate. Such flow control devices provide a low-cost way to establish a roughly uniform allocation of steam from the network to each of a plurality of injection wells. Some installations use motor-operated valves. For example, such valves are used in "cyclic steam stimulation" projects where the steam at an individual injector is turned on and off, typically multiple times per year, but typically less often than once per week or once per month.

In some instances, the use of solar steam generators can significantly reduce costs, emissions, and fuel use for oilfield steam generation. Unlike fuel-fired steam generators, solar steam generators generate steam at varying rates. Solar steam generators can deliver steam directly from concentrated solar energy collectors, or indirectly, after the solar energy has been transferred through an intermediate heat transfer fluid and/or heat storage device. Whether delivered directly or indirectly, however, solar energy is available in a time-varying manner. A representative solar steam generator is shown in FIG. 1B.

In some cases, fuel-fired steam generators are operated in concert with solar-powered generators to complement the time-varying output of the solar-powered generators. To maintain a relatively constant injection rate, fuel-fired steam generators are turned up or down in firing rate, based on the current availability of solar steam. Steam flow control devices at the wellheads play a role in balancing the flow rate into each well; these can be fixed choke or manually variable valves. FIG. 1C illustrates an example of solar steam generators intertied to a distribution network. FIG. 1D (taken from U.S. Pat. No. 8,701,773, assigned to the assignee of the present application) illustrates the respective contributions of fuel-fired steam (line 12) and solar steam (line 10) on an hourly basis, with the total steam injection rate roughly constant over the course of a 24-hour day (line 13), or greater during daylight hours (line 11).

In some instances, solar steam is more valuable than fuel-fired steam, e.g., due to lower cost, lower emissions, and/or other benefits. In such cases, systems and methods that enable solar steam to deliver a relatively greater fraction of the total annual injected steam volume are beneficial. The production and injection of steam at time-varying rates is one method which can enable solar steam to deliver a relatively greater fraction of total annual steam. For example U.S. Pat. No. 8,701,773 (referenced above) discloses the production of steam from the combination of both solar steam generators and fuel-fired steam generators at a time-varying total rate. However, improvements are needed in the systems and methods for dividing, distributing and injecting steam at time-varying rates to improve system efficiency.

BRIEF DESCRIPTION OF THE DRAWINGS

FIGS. 13A-13B are charts illustrating characteristics of the types of injection wells shown in FIGS. 11 and 12, in accordance with embodiments of the present technology.

FIGS. 15A-15G illustrate inputs and outputs for a spreadsheet-based variable rate steam injection program configured in accordance with an embodiment of the present technology.

DETAILED DESCRIPTION

The following description of the present technology has been arranged under headings 1-8 (listed below) for purposes of organization. Aspects of the technology described under any of the following headings may be combined with aspects described under any of the other headings in other embodiments.

1. Introduction
2. General System Characteristics
3. Injection Well Layouts and Associated Challenges
4. Variable Rate Injection to Address Flow/Heating Non-Uniformities
5. Variable Rate Steam Injection to Increase the Fraction of Heating Produced by Solar-Generated Steam
6. Representative Implementations
7. Well Design for Variable Rate Steam Injection
8. Further Embodiments

1. INTRODUCTION

The present technology is directed generally to thermal EOR systems and methods using variable rate steam injection to account for variations in steam price, steam availability, oil recovery rates, oil recovery fractions, and/or other production variables. Oil recovery rates and ultimate recovery fractions are altered by changes in oil volume due to thermal expansion, rock wettability changes, pressure changes, oil viscosity changes, and/or other effects. Certain aspects of the present technology are directed to the following areas, each of which is described in further detail below:

Variable Rate—subsurface effects of variable rate steam generation and how to manage them.

Allocation of Steam Across Multiple Wells—control systems that effectively allocate a varying flow rate of steam across multiple wells.

Per-Well Allocation of Steam—control systems that effectively allocate a varying flow rate of steam per well based on local reservoir characteristics at individual wells.

Allocation of intermittent steam injection to production wells during high-solar insolation periods.

Determining and implementing steam flow allocations to achieve a high fraction of overall steam production produced by solar energy.

The foregoing aspects of the technology can be grouped under two general categories. One is to increase (e.g., maximize) the uniformity with which an oil-bearing formation is heated. Another is to increase (e.g., maximize) the amount of heat delivered to the oil-bearing formation that is produced by solar energy, sometimes referred to herein as the "solar fraction". Both results can be achieved by varying the rate at which steam is provided to one or more injection wells at the oil-bearing formation, and in particular, by automatically changing the settings of the valves that control the flow of steam to the injection wells.

Figure 1A:
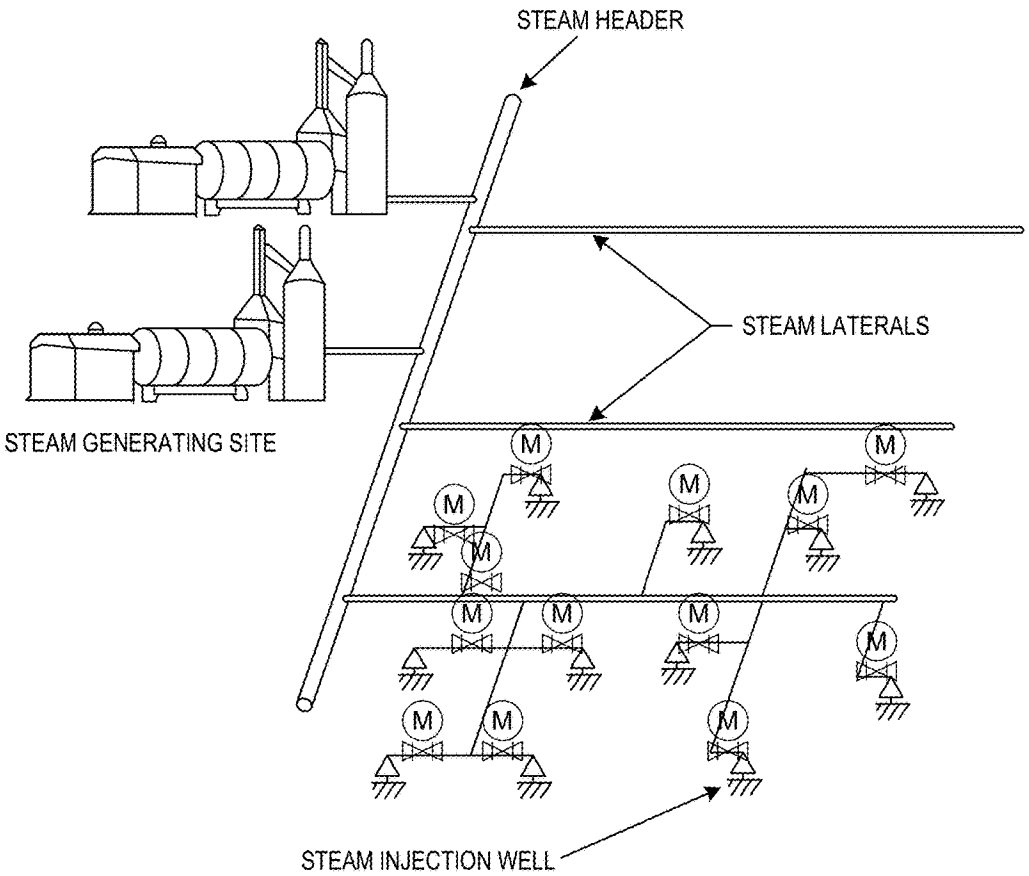
FIG. 1A (Prior Art)
FIG. 1A is a partially schematic illustration of an EOR oilfield coupled to a fuel-fired steam generation site, and including motor-operated valves at the wellheads, in accordance with the prior art.
Figure 1B:
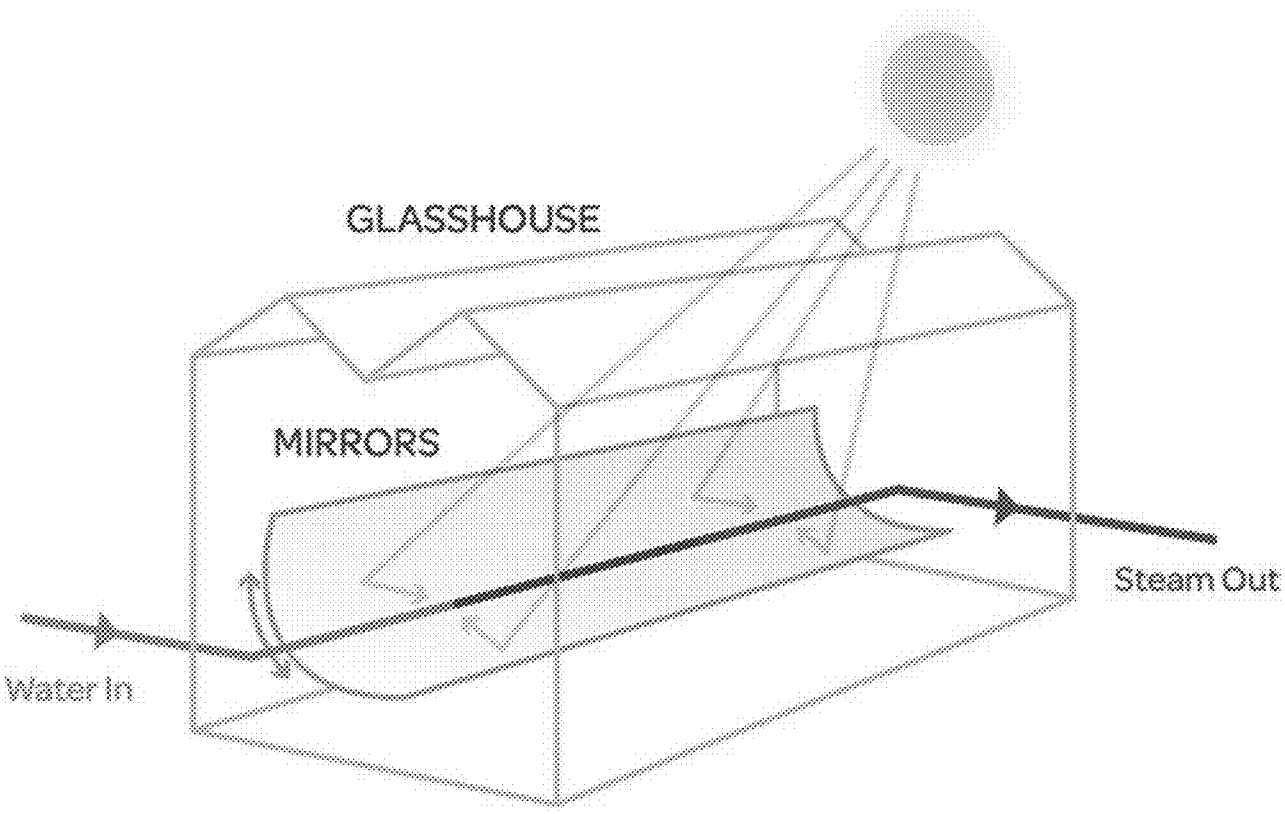
FIG. 1B (Prior Art)
FIG. 1B illustrates a glass house configured to heat water to steam for a solar EOR operation, in accordance with the prior art.
Figure 1C:
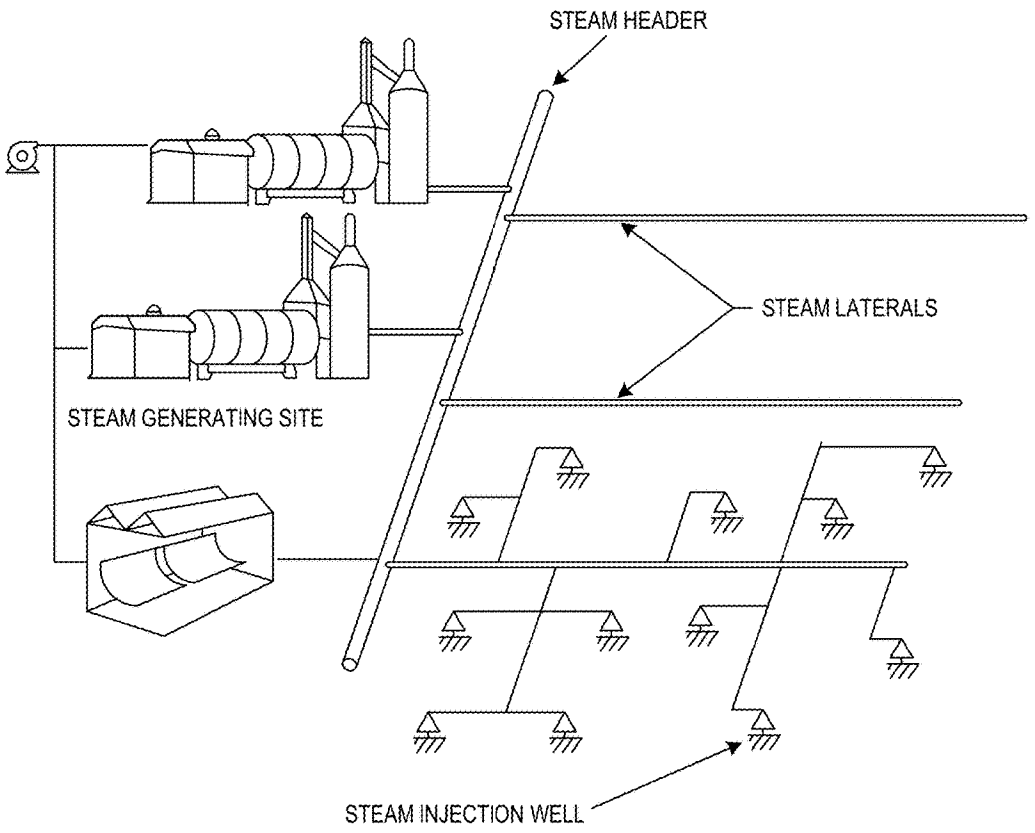
FIG. 1C (Prior Art)
FIG. 1C illustrates an oilfield coupled to a fuel-fired steam generation site and a solar-powered steam generator, in accordance with the prior art.
Figure 1D:
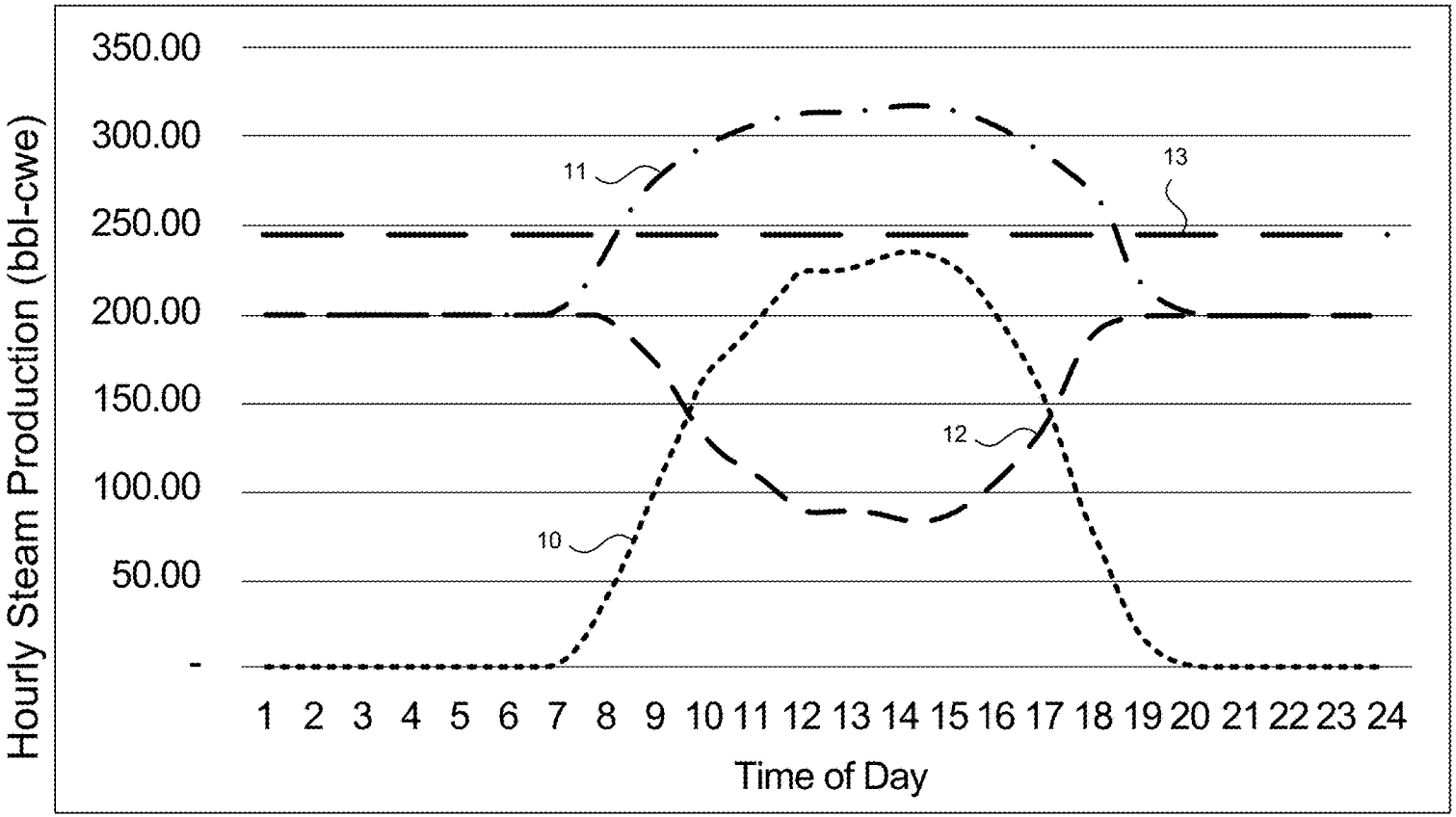
FIG. 1D (Prior Art)
FIG. 1D is a graph illustrating the output of a combined fuel-fired and solar-powered steam generation facility, in accordance with the prior art.
Figure 2:
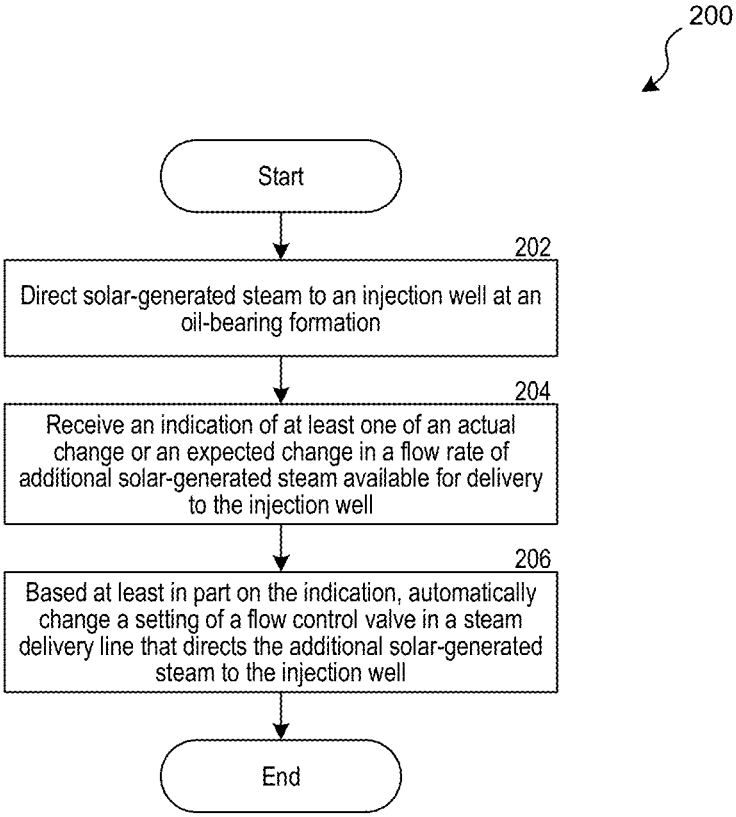
FIG. 2 is a flow diagram illustrating a process for varying steam injection at an oil field in accordance with representative embodiments of the present technology.

FIG. 2 is a flow diagram illustrating methods in accordance with embodiments of the present technology. In particular, FIG. 2 illustrates a process 200 for improving the results of a solar EOR operation. Process portion 202 includes directing solar-generated steam to an injection well at an oil-bearing formation. The term solar-generated steam refers to steam that is heated by concentrated solar energy. The concentrated solar energy can be generated by receivers and concentrators located within a protective enclosure (e.g., a glass house), as disclosed in U.S. Pat. No. 8,887,712, assigned to the assignee of the present application, and incorporated herein by reference. The solar concentrators can include point-source concentrators, trough-shaped concentrators, Fresnel concentrators, and/or other suitable devices, as are also disclosed in U.S. Pat. No. 8,887,712.

The process 200 can further include receiving an indication of a flow rate change (process portion 204). The change can be an actual change, an expected change, or both, in a flow rate of additional solar-generated steam available for delivery to the injection well. For example, process portion 204 can include receiving an indication that the expected availability of solar-generated steam will be increasing (e.g., at the start of the day), or decreasing (e.g., at the end of the day). In other embodiments, the expected change can be a seasonal change, for example, a decrease in expected solar-generated steam resulting from the change from summer to winter. Accordingly, the expected change in available steam can correspond to a change in time. In other embodiments, the expected change can be based on other factors, (e.g., weather forecasts), which can be long-term or short-term.

Actual changes can be based on measurements, e.g., pressure and/or flow rate measurements indicating changes in steam flow rate. The changes can be measured and transmitted in real time or near real time. In some cases, the measurements of real-time events can support predictions (even very near term predictions) of changes in flow rate. For example, a measured change in solar insolation due to a cloud passing overhead can indicate an imminent decrease in available solar steam.

The process can include changing valve settings based on both expected changes and actual changes. For example, the valve setting can be changed based on predicted solar insolation, and then updated based on actual insolation and/or actual steam flow.

In process portion 206, the process includes automatically changing a setting of a flow control valve in a steam delivery line that directs the additional solar-generated steam to the injection well. The change in valve setting is based at least in part upon the indication received in process portion 204. For example, the valve can be automatically opened at the start of the day to increase the flow of solar-generated steam flow to the well, or closed (or partially closed) at the end of the day to reduce or eliminate the flow of steam at night. As will be described in further detail below, the schedule in accordance with which the valves for multiple wells at an oil field are opened and closed can depend upon the nature of the individual well, the local nature of the oil-bearing formation, the time of day, the season, and/or other variables.

Other embodiments of the present technology can include variations of the process described above with reference to FIG. 2. For example, one variation can include directing steam to a plurality of injection wells at an oil bearing formation, with the injection wells connected to a steam distribution network. The steam can be heated by a combination of concentrated solar energy and non-solar energy. The process can further include receiving an indication of at least one of an actual change or an expected change in a flow rate of additional steam available for delivery to the plurality of injection wells. Based at least in part on the indication, the process can include automatically changing a setting of at least one flow control valve in a steam distribution network to change an apportionment of the additional steam over the plurality of injection wells. For example, the flow control valves for different injection wells can be changed by different amounts.

Still a further embodiment can include providing solar-generated steam for delivery to an injection well at an oil-bearing formation, wherein the solar-generated steam is heated by concentrated solar energy. The process can further include directing, to a controller of steam delivered to the injection well, an indication of an expected change in a flow rate of additional solar-generated steam available for delivery to the injection well. In particular embodiments, the foregoing methods can be carried out by the operator of a solar field, and the information provided as a result of the process can be used by the operator of an oil field or another industrial facility that uses solar-generated steam.

As used herein, the term "automatically" refers to operations that do not require manually adjusting a valve setting. The automation can be implemented electronically, electromagnetically, mechanically, via fluidics, and/or in other manners that do not require direct manipulation by an operator. For example, in some instances, the flow valves include a motor coupled to a controller that issues commands to change the valve setting via the motor. In other embodiments, the valve can be connected directly to a sensor which actuates the valve via a simple on/off command, but without the need for a more sophisticated controller. In still a further embodiment, the valve can be pressure-sensitive (e.g., via a spring or other suitable mechanical device), and can open and close in direct response to pressure changes.

The expected results of automatically varying the injection well setting in response to actual and/or expected changes in the availability of solar-generated steam can include increasing the uniformity with which the oil field is heated, increasing the amount of the heating energy that is solar-generated (the solar fraction), reducing the costs of integrating solar-generated steam into an oilfield, and/or increasing the oil production per unit of steam injected in a thermal EOR operation, when compared to existing techniques.

Many embodiments of the technology described below may take the form of computer- or controller-executable instructions, including routines executed by a programmable computer or controller. Those skilled in the relevant art will appreciate that the technology can be practiced on computer/ controller systems other than those shown and described below. The technology can be embodied in a special-purpose computer, controller or data processor that is specifically programmed, configured or constructed to perform one or more of the computer-executable instructions described below. Accordingly, the terms "computer" and "controller" as generally used herein refer to any data processor and can include Internet appliances and hand-held devices (including palm-top computers, wearable computers, cellular or mobile phones, multi-processor systems, processor-based or programmable consumer electronics, network computers, mini computers and the like). Information handled by these computers can be presented at any suitable display medium, including a CRT display or LCD.

The technology can also be practiced in distributed environments, where tasks or modules are performed by remote processing devices that are linked through a communications network. In a distributed computing environment, program modules or subroutines may be located in local and remote memory storage devices. Aspects of the technology described below may be stored or distributed on computer-readable media, including magnetic or optically readable or removable computer disks, as well as distributed electronically over networks. Data structures and transmissions of data particular to aspects of the technology are also encompassed within the scope of the embodiments of the technology.

2. GENERAL SYSTEM CHARACTERISTICS

Figure 3:
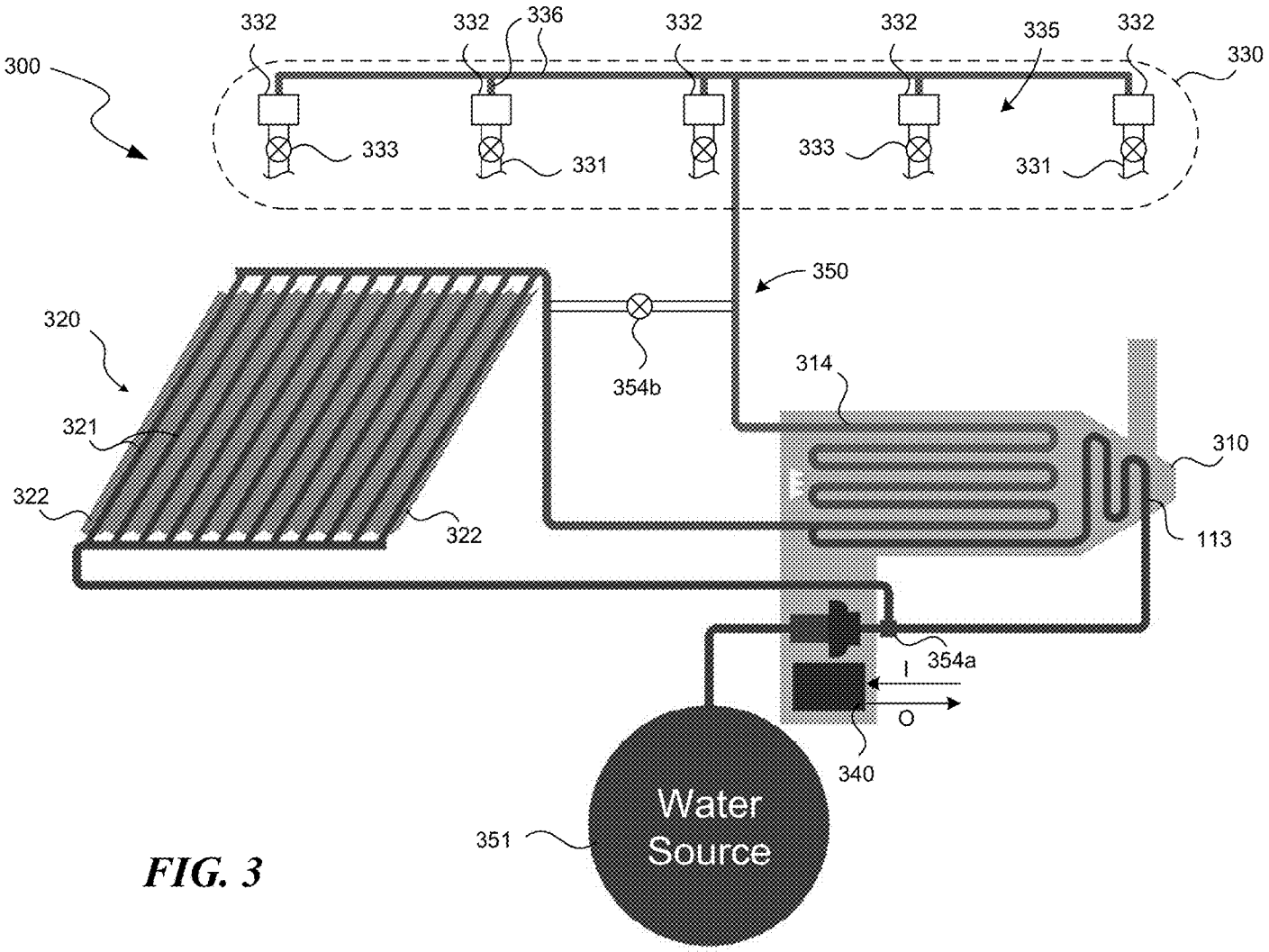
FIG. 3 is a partially schematic illustration of an oilfield configured to receive steam from both a a solar-powered facility and non-solar powered facility to achieve variable rate steam injection, in accordance with an embodiment of the present technology.

FIG. 3 is a partially schematic, simplified illustration of a representative oilfield system 300 that receives steam from both a solar steam generator 320, and a non-solar steam generator 310 (e.g., a fuel-fired steam generator), and delivers the steam to a target user 330, e.g., an oilfield 335. The solar steam generator 320 can include one or more receivers 321 (e.g., elongated conduits carrying water or another working fluid) and one or more corresponding concentrators 322 (e.g., mirrors that are positionable to concentrate incident solar radiation on the receivers 321). The concentrators 322 can include trough-shaped parabolic mirrors in particular embodiments, and can have other configurations in other embodiments. The non-solar steam generator 310 can include any one or combination of a heat recovery steam generator (HRSG) that recovers heat from a power generator to produce steam, a duct burner, a once-through steam generator (OTSG), and/or other boilers or heat sources. In a particular embodiment, the non-solar steam generator 310 can include a first portion 313 (e.g., a preheater or economizer) and a second portion 314 (e.g., an evaporator, radiant heater and/or superheater). Water is supplied to the system components via a water source 351 and flow network 350. A first valve 354*a* and second valve 354*b* can be selectively adjusted to direct water through one or both of the steam generators, 310, 320. Accordingly, depending on the desired mode of operation, the valves 354*a*, 354*b* can be set to:

(a) direct all the water from the water source 351 through the non-solar steam generator 310 (and no water through the solar steam generator 320), or (b) direct a first portion of the water through the non-solar steam generator 310 (in particular, the first portion 313 of the heater 310) and another portion of the water through the solar steam generator 320 and the second portion 314 of the non-solar steam generator 310, or (c) direct all the water from the water source 351 through the solar steam generator 320 and the second portion 314 of the non-solar steam generator 310, or (d) direct all the water from the water source 351 through only the solar steam generator 320 (e.g., by opening the second valve 354*b*).

Individual injection wells 331 in the oilfield 335 can include motor-operated valves 333 with associated flowrate sensors 332 and/or other flow control devices that operate under the direction of a controller 340. Accordingly, the valves 333 are placed along steam delivery lines 336 and are coupled between the underground steam injection point of the well, and the source(s) of steam. In a representative embodiment, each well 331 has a dedicated valve 333, and (in particular embodiments) a dedicated sensor 332. In other embodiments, at least some wells 331 can be grouped and connected to a common valve, e.g., in cases for which doing so does not overly compromise the ability to improve injection uniformity and/or the fraction of steam that is solar-generated.

The controller 340 can be programmed to direct the operation of the valves 333 to increase injection uniformity and/or the solar fraction. Accordingly, the controller 340 can be or can include a computer-based system with one or more computer-readable media having instructions that, when executed, receive inputs I (e.g., sensor data) and direct outputs O (e.g., directives) to control the oil recovery operation. The sensor data can be obtained from sensors 332 located at the well heads and/or other locations in the distribution network to sense temperature, pressure, flow rate and/or other suitable input values, and/or sensors measuring the current or expected (e.g., near-future) availability of solar steam. The future availability of solar-generated steam can be determined by processing information from cameras capturing images of the sky, from sensors measuring current solar steam production, sensors measuring current sunshine, and/or combinations of these and/or other sensors. For example, the system can include a whole-sky camera and a solar field direct normal irradiance (DNI) sensor. The whole-sky camera (and/or local weather forecasts) can be used to identify upcoming events (e.g., cloud cover or sand storms) that can affect the output of the solar field. The DNI sensor provides real-time data on the amount of radiation impinging on the mirrors at the solar steam generator 320.

A solar field output sensor or sensors measure the parameters of the steam exiting the solar steam generator 320 (e.g., steam quality, flow rate, temperature, and pressure). Other sensors can measure the same quantities for the output produced by the non-solar powered steam generator 310. If the system also includes a co-generator, an additional sensor can measure the co-generator output. Such a co-generator can be coupled to a separate gas-driven turbine that is used to produce electricity for running the EOR operation and/or for export to a power grid. The co-generator can heat water to steam using waste heat from the gas turbine. Typically, the gas turbine and co-generator operate around the clock and so the output from the co-generator is approximately constant. However, the additional sensor can be used to confirm the output of the co-generator particularly if, as may be the case in some embodiments, the gas turbine and co-generator are not operated at the same level on a continuous basis.

The system 300 can include multiple elements that can be actuated and that operate under the direction of the controller 340. The actuated devices can include valves between the solar steam generator 320 and the injector wells 331 and between the non-solar powered steam generator 310 and the injector wells 331, as well as valves controlling the flow of water into the steam generators 310, 320. Further actuators are used to control the amount of steam produced by the non-solar steam generator 310 e.g., by turning the generator on and off and regulating the rate at which the non-solar steam generator 310 provides heat and receives water. Still further actuators can control the output of the solar field, e.g., by directing the mirrors to be "on sun" for heating and "off sun" to reduce heating.

Figure 4:
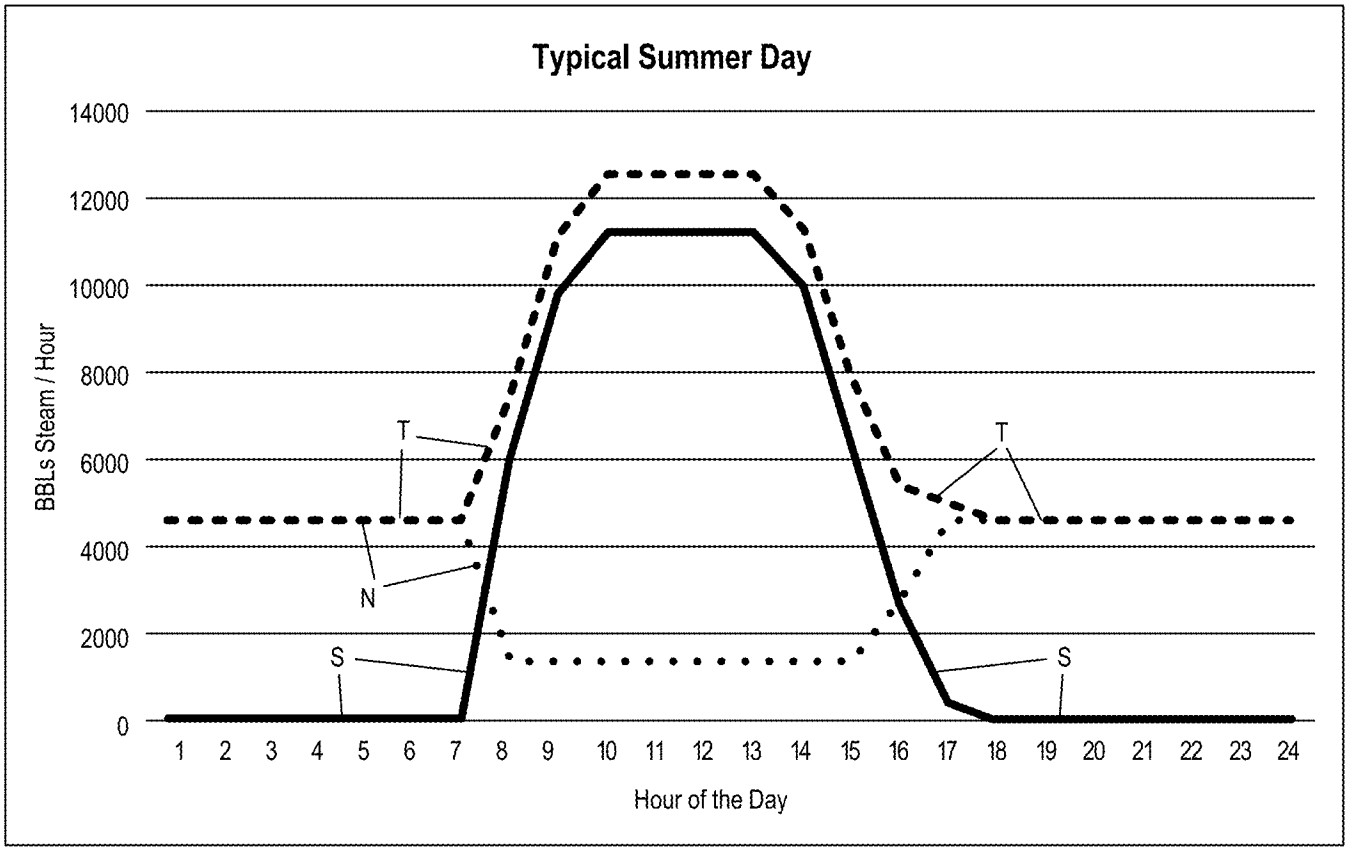
FIG. 4 is a graph illustrating the output from a solar-powered steam generator and a non-solar powered steam generator over the course of a day, in accordance with an embodiment of the present technology.

FIG. 4 schematically illustrates a representative daily variation in energy available from a solar steam generator (line S), a non-solar steam generator (line N), and the total sum of the two energies (line T). As shown in FIG. 4, the total rate of steam can vary by a factor of about three in the illustrated embodiment. In other embodiments, the variation can be even greater. For example, in some embodiments, the rate of steam delivery at night can be only 10% (or less) of that delivered during the day. In further embodiments, the rate of steam delivery at night can be zero.

The disclosed processes and systems can include wells and/or equipment within the wells, and/or equipment upstream of the wells, including the controller(s), configured to handle very high rates of steam delivery during the day (when solar power is readily available), and significantly lower or zero levels of steam during the night (when solar power is not available). Based on the received inputs, the controller can adjust valves on a well-by-well basis to admit steam at a pre-defined steam flow rate that varies throughout the day. The controller can, for example, partially open a valve, receive sensor data corresponding to the resulting steam flow rate, and make adjustments to the valve setting based on the measured flow rate, and its variance from the currently desired flow rate. In one embodiment of the present technology, the controller receives or determines the currently available total amount of steam, and adjusts the flow control valves on each well so as to uniformly divide that steam flow, proportionally across all wells. This method—flow measurement and valve actuation—is capable of proportionally dividing flow while the total flow rate is varying. This is an advance over the conventional fixed "choke" methodology, for which flow proportioning across wells is established by critical flow in each well's flow-limiting choke bore, with small changes in flow for large changes in inlet pressure. By automatically changing valve settings, embodiments of technology can produce the large changes in steam flow, (uniformly in some embodiments and non-uniformly in others) across multiple injection wells, with no changes or only modest changes in pressure. In some situations, a uniform distribution of steam at varying flow rates may be suitable. For example, individual wells can receive an amount of steam that varies with time, with the variation being proportional across multiple (e.g., all) wells. Each well can receive roughly the same daily mass of steam (despite well-to-well differences in location on the steam network, subsurface pressures, and/or parameters), in particular embodiments. However, in other situations, variations in the characteristics of the injection wells pose limitations to the effectiveness of variable rate injection, which can be overcome by an adaptive per-well flow control approach, described further below. The following section discusses such limitations and challenges.

3. INJECTION WELL LAYOUTS AND ASSOCIATED CHALLENGES

Figure 5A:
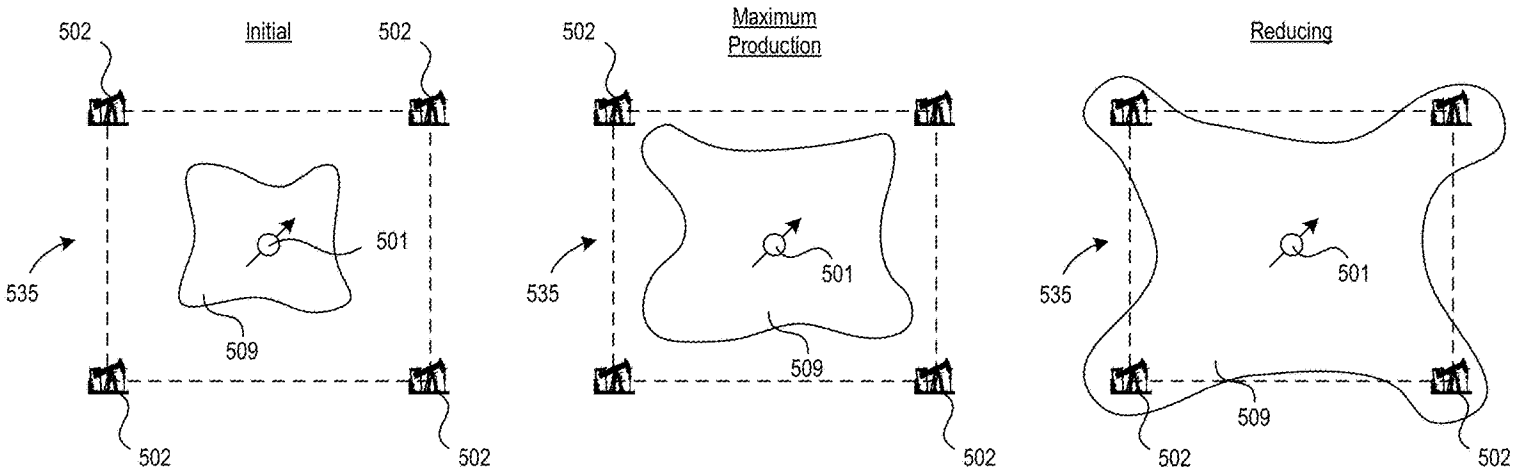
FIG. 5A is a partially schematic illustration of a heating process associated with a steam injection well and multiple production wells.

FIG. 5A is a schematic, plan view illustration of a portion of an oil field 535 having an injection well 501 surrounded by multiple production wells 502. The pattern shown in FIG. 5A can be repeated horizontally and vertically such that, overall, the number of production wells 502 and injection wells 501 is equal. In other embodiments, the pattern and ratio of production wells to injection wells can be different.

Figure 5B:
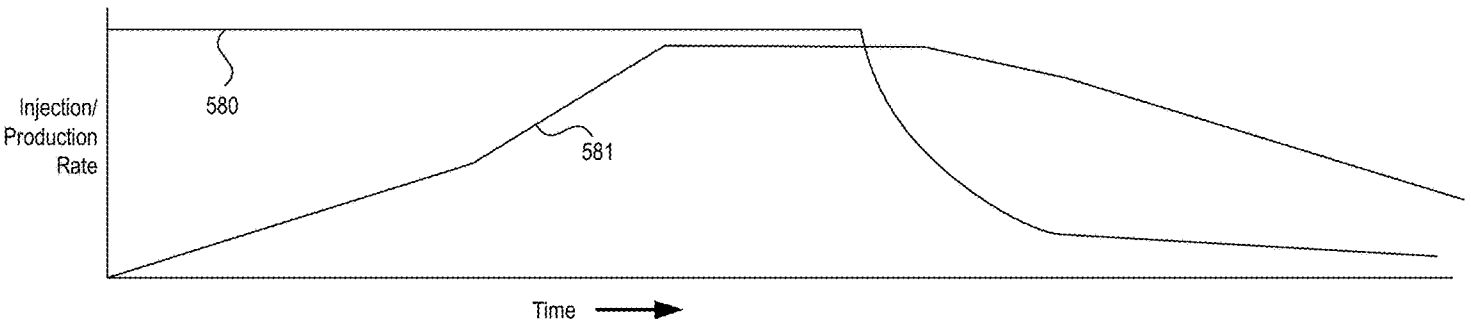
FIG. 5B is an associated graph, in accordance with an embodiment of the present technology.

The portion of the oil field 535 is shown during three periods: an initial period, a maximum production period, and a reduction period. FIG. 5B is a graph showing the steam injection rate (line 580) and the oil production rate (line 581) over the course of time indicated by the foregoing three periods. During the initial period, steam is injected at a relatively higher rate and, as the formation heats up, the oil production rate increases. During the maximum production period, the steam injection rate continues, and the oil production rate plateaus. Once "breakthrough" occurs (e.g., when the steam from the injection well begins to enter the production wells), the steam injection rate decreases. During this reduction period, the oil production rate also begins to decrease as the remaining oil in the formation is withdrawn.

As described in further detail below, several challenges associated with injecting steam in the manner shown in FIG. 5A relate to breakthrough occurring earlier than desired. Once breakthrough occurs, the injected steam follows the path of least resistance created by the breakthrough and proceeds directly to the production well at which breakthrough has occurred, without properly heating the oil-bearing formation. Specific instances of breakthrough are described further below, along with solutions provided by the present technology.

a. Fingering

Figure 6:
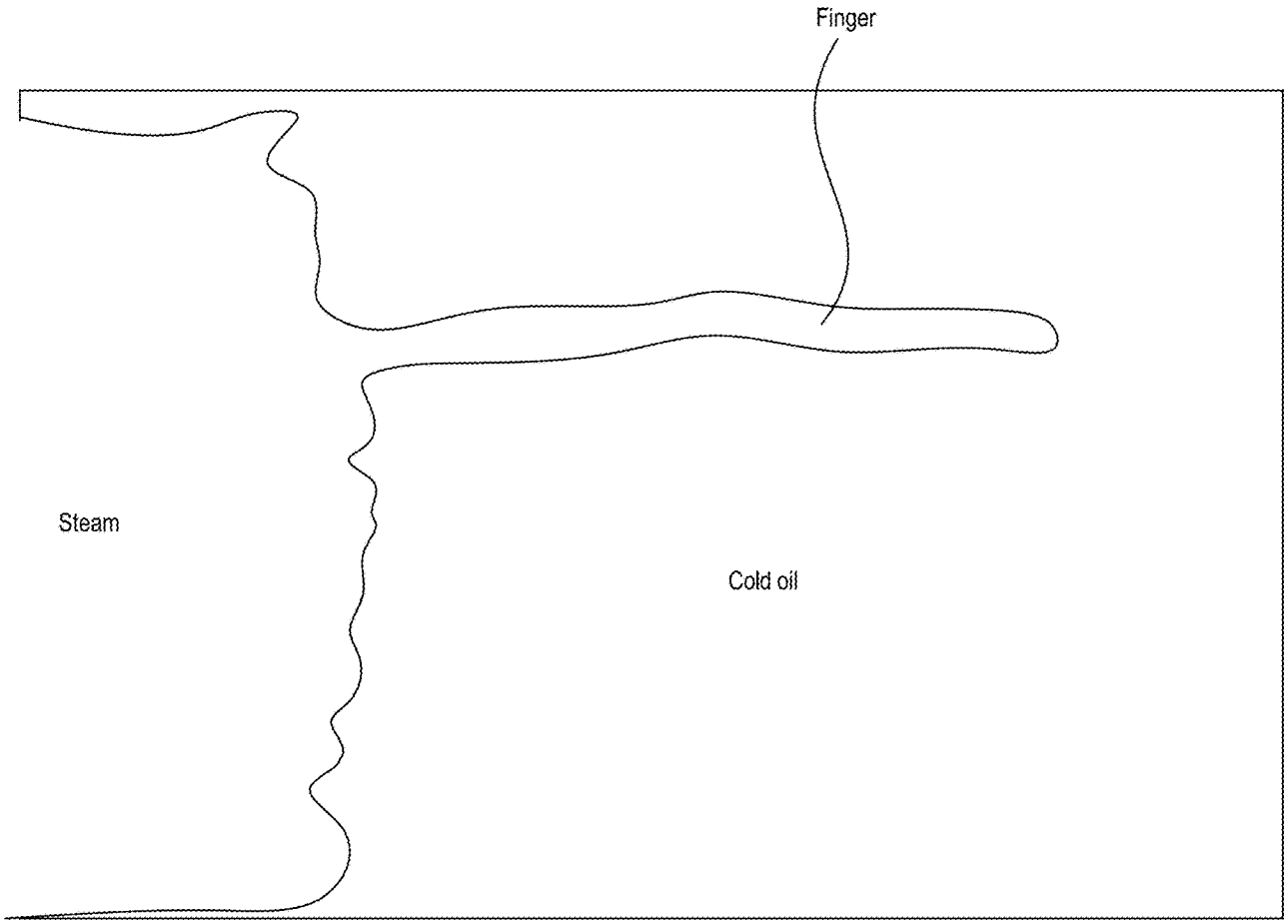
FIG. 6 is a schematic illustration of steam "fingering" during an EOR operation.

"Fingering" is the tendency of a fluid phase with higher mobility $\mu$ (higher relative permeability), and thus lower resistance to flow, to selectively "break through" and bypass a fluid with relatively lower $\mu$. FIG. 6 illustrates an example of steam being injected from the left and oil being collected and produced at the right. It is generally desirable to have a well-ordered transition zone (e.g., the roughly vertical boundary between steam and oil in FIG. 6) where steam condenses and gives up its heat at a boundary with minimum surface area. However, because the mobility of steam ($\mu_{steam}$) is significantly greater than that of oil ($\mu_{oil}$), substantial "fingering" may occur, especially when steam is continuously injected.

Fingering may result in "early breakthrough" in a steam-flood operation, in which steam flows along a thermal bypass path (or finger) that grows to extend between a steam injection well and an oil production or recovery well. This direct bypass path causes the steam to reach the production well, without giving up its heat to the formation, resulting in an undesirable loss of energy efficiency. A corresponding problem in SAGD operations occurs when steam leaks via fingers to the top of the oil-bearing zone, bypassing the cold oil without having given up its heat. Reductions in this fingering behavior are accordingly beneficial. Embodiments of the present technology can reduce such fingering by varying the injection rate and pressure of the steam into the formation.

Embodiments of the present technology deliver the scheduled (e.g., required) daily mass of steam into the oil-bearing formation (via one or more injector wells) by using variable rate injection. The variable rate can include a daily period of zero-flow or very low flow, e.g., at night when no solar energy is available. By reducing steam injection rates on a nightly basis, steam flow into the fingers drops, allowing the locally cooler area of the formation to cool the steam finger. As a result, condensed liquid water partially or completely fills the finger zone, reducing the relative mobility in the finger zone (because $\mu_{water}<\mu_{steam}$), and thus reducing the likelihood of continuing finger growth when the higher rate steam injection is resumed (e.g., the following day). Accordingly, a particular aspect of the present technology includes deliberately varying the steam injection rate to achieve a subsurface effect that may depend (in part) on the output of the solar field, but is not simply dictated by that output. Further particular embodiments include detecting early breakthrough, or detecting incipient breakthrough and taking appropriate steps. Such steps can include reallocating more steam to portions of the formation that have not experienced (or are not about to experience) breakthrough.

b. Early Breakthrough Scenarios

Figure 7:
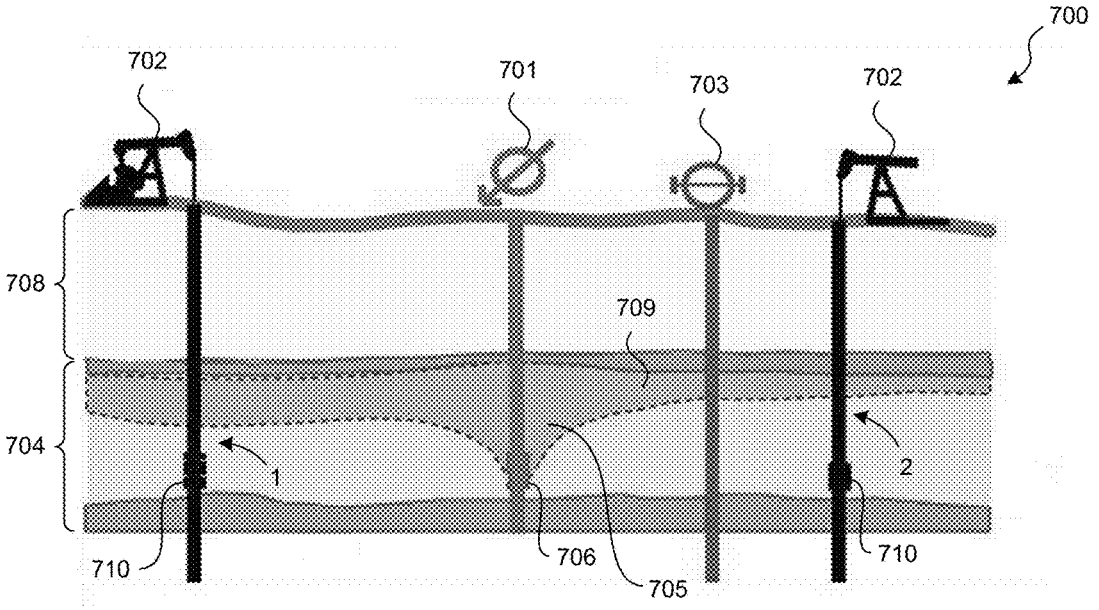
FIGS. 7-9 illustrate representative injection wells and production wells suitable for use with variable rate steam injection, in accordance with embodiments of the present technology.

FIG. 7 illustrates a cross-section of a portion of a typical steamflood operation 700, with alternating injection wells 701 and production wells 702. Optional thermal Observation Wells (TOWs) 703 may measure the temperature at one or more points in the formation. FIG. 7 illustrates a problem common in conventional steam injection projects. Some regions of the oil-bearing zone have higher permeability (and therefore allow higher steam mobility) than other regions. This inhomogeneity or anisotropy of reservoir conditions results in uneven steam distribution within the formation.

Anisotropy in the formation is a challenge for the effective use of steam injection. The desired behavior is that a steam zone 705 moves outwards in a symmetrical pattern away from injection perforations 706 of the injection well 701, uniformly heating all parts of the surrounding formation (e.g., as shown in FIG. 5A). Variations in oil density, variations in formation rock, baffle/shale intercalations, formation fractures or rubble zones all can cause highly anisotropic steam flow behavior. Highly permeable flow zones can carry off a great deal of steam volume, while lower permeability zones experience little steam inflow. The effect of anisotropy is self-reinforcing; regions that experience steam inflow are heated by the steam, which in turn drives out liquid fractions and reduces the viscosity of existing liquids, opening those heated zones to still higher rates of steam inflow. Constant rate steam injection experiences these effects most significantly.

Embodiments of the present technology can mitigate these effects and allow for a higher energy efficiency, a higher total oil recovery, and/or a lower cost of oil production. Instead of a relatively constant steam injection rate on a 24-hour basis, steam is injected at a varying rate. The rate can have a 24-hour periodicity in some embodiments, and other periodicities in other embodiments, depending, for example, on formation conditions and/or energy availability. In a particular embodiment, the injection rate is chosen to provide relatively higher pressure and steam flow at some times of the day, and a relatively lower pressure and steam flow at other times of the day.

High rates of steam injection for comparatively brief periods benefit the steam distribution in one or more of at least the following ways. First, higher delivery pressure (which is typically associated with higher injection rates) during the day drives steam into regions that have higher viscosity fluids, higher reservoir pressures, and/or lower permeabilities, at a rate higher than would be accomplished by constant-rate steam inflow at a lower continuous pressure. Second, by injecting steam at a relatively higher rate, the effects of hydraulic pressure drops (e.g., flow-related pressure drops) can operate to balance steam propagation. In particular, formations with different flow resistances will have more equal flows through them at higher upstream steam pressures than at lower upstream steam pressures. Third, by allowing a period of relatively lower steam inflow rate and relatively lower pressure, some thermal equilibration and re-condensation of the steam occurs, which mitigates some of the effect of inhomogeneous distribution, generally in the manner discussed above with reference to fingering.

As shown in FIG. 7, steam injected at an injection site via an injection well 701 spreads into the oil-bearing zone, increasing production at the production wells 702 by several mechanisms, including displacement, viscosity reduction, rock wettability changes, thermal expansion, and gravity drainage. As is also shown in FIG. 7, steam is released at the perforations 706 of the injector well 701, which are positioned relatively low within the oil-bearing zone. Because steam has a relatively low density, it rises and flows outwards within an oil-bearing zone 704, up to a caprock layer 708, forming a "steam chest" 709 which delivers heat to the formation. Perforations 710 in the production wells 702 are also relatively low within the oil-bearing zone 704, allowing liquids to drain while delaying the point in time at which steam reaches the production well perforations 710. Once the steam reaches the production well perforations 710 (breakthrough), the energy efficiency of the production operation changes (e.g., decreases), as a portion of the injected steam now flows up the production well 702, rather than delivering its heat into the formation.

Figure 8:
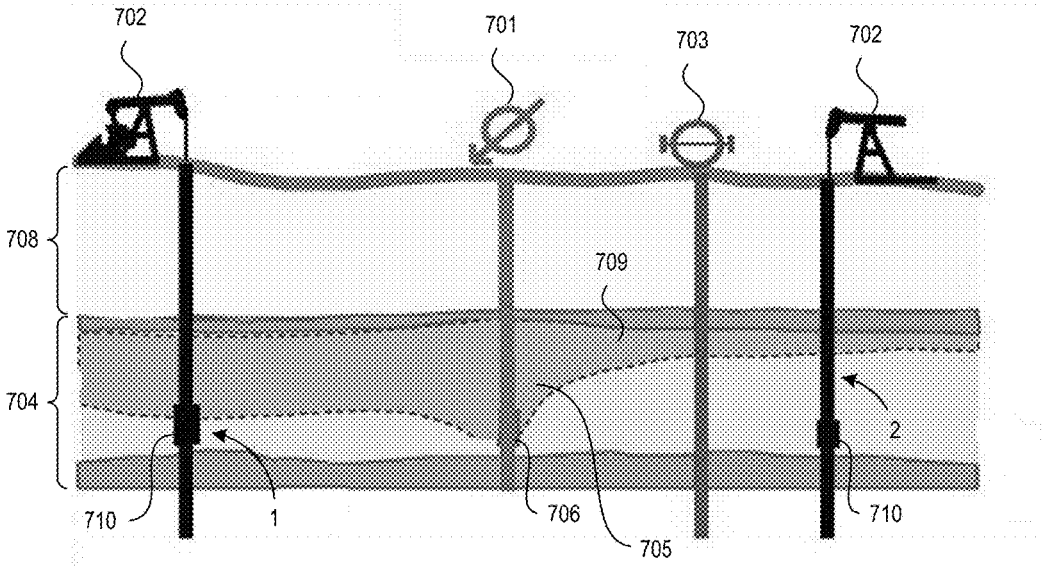

FIG. 7 also illustrates an effect of modest anisotropy in the flow of steam within the formation. In particular, the steam chest 709 is thicker (more steam has flowed and heated a larger zone) at Point 1 than at Point 2. FIG. 8 illustrates a more significant anisotropy, where breakthrough has occurred at Point 1 while a relatively modest steam chest has formed at Point 2.

Figure 9:
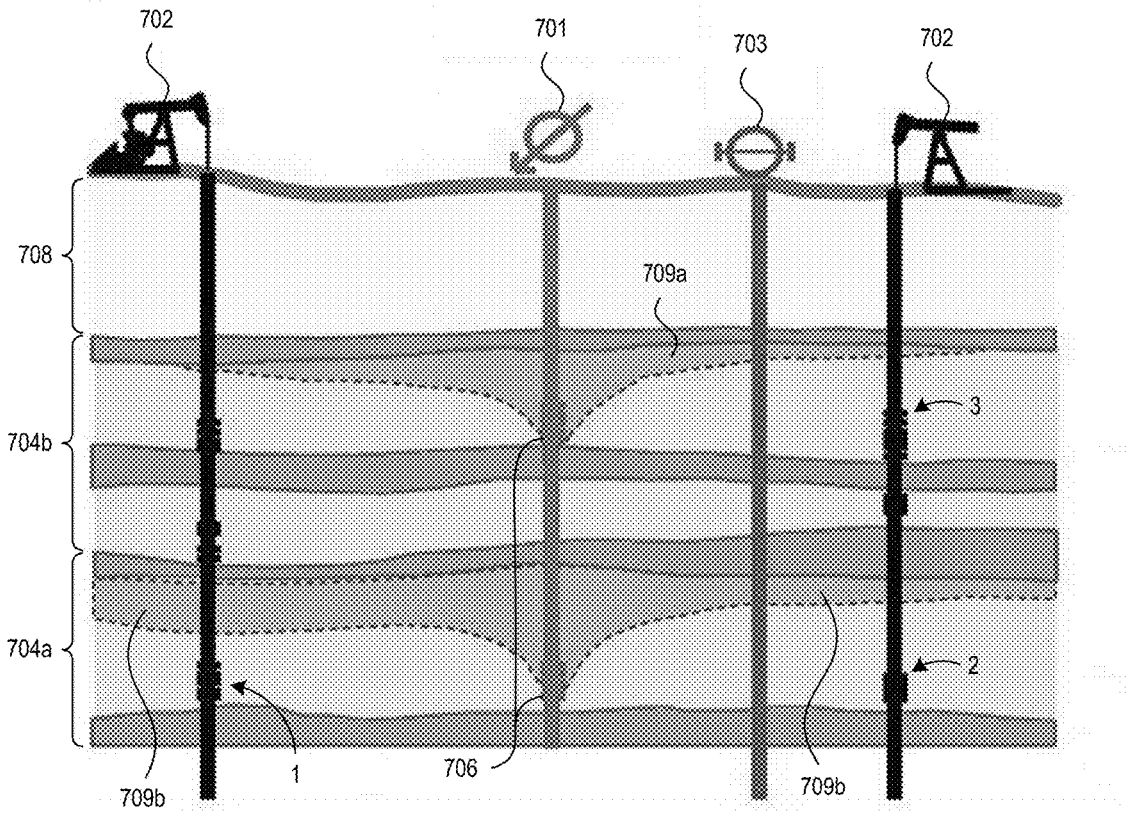

FIG. 9 illustrates another steamflood configuration, in this case, a multi-zone operation, in which an individual injection well 701 delivers steam into multiple discrete and vertically offset first and second zones 704*a*, 704*b* in the formation, as indicated by multiple sets of injector well perforations 706 at corresponding multiple depths or levels in the formation. FIG. 9 illustrates a challenge common with such multi-zone injection operations: how to deliver a balanced amount of steam into each of the zones 704*a*, 704*b*. Over-injection in one zone may cause early breakthrough, while under-injection in another zone causes reduced production due to inadequate heating. FIG. 9, for example, shows that at Point 3, an upper steam chest 709*a* is not yet fully developed and has not completely spread around the production wells 702, whereas at Point 1, a lower steam chest 709*b* is about to initiate a steam breakthrough. In this example, the first zone 704*a* will increase in temperature faster than the second zone 704*b* and thus the fluid viscosity of the oil will be reduced faster, causing positive feedback to the increasing injection rate into the first zone 704*a*. Once steam breakthrough occurs at Point 1, steam will preferentially flow to the breakthrough point, more oil will be produced from the well at Point 1, and the pressure in the first zone 704*a* will be reduced over time causing proportionally more of the steam to enter into the first zone 704*a*, further increasing the differences between the first zone 704*a* and the second zone 704*b*. By injecting flow into the injection well 701 at high pressures and flow rates, the vertical distribution of steam will be less affected by the increasing imbalance in reservoir pressure between the first zone 704*a* and the second zone 704*b*. That is, steam may be delivered to the upper and lower steam chests 709*a*, 709*b* at different rates, but those rates can remain approximately constant over the course of time. The amount of steam delivered to the well overall can be decreased over the course of time by injecting the steam at high flow rates and pressures, but for less time.

FIGS. 7-9 illustrate a problem widespread in steam injection operations. Steam has a high relative permeability compared to the formation liquids, and so can flow over and past the liquids and beyond the zones where heat is desired. Of potentially greater significance is the change in formation permeability with heat. As steam enters a zone and heats that zone, the viscosity of the local liquids is reduced, reducing the backpressure and making it easier for more steam to enter that zone. A relatively small variation in formation permeability or original fluid viscosity may result in a relatively larger variation in delivered steam over time due to this "positive reinforcement" effect.

4. VARIABLE RATE INJECTION TO ADDRESS FLOW/HEATING NON-UNIFORMITIES

The following sections describe further methods for addressing flow/heating non-uniformities in an oil-bearing formation. It will be understood from the present disclosure that these techniques may have additional benefits, including increasing the solar fraction.

a. Variable Rate Injection to Address Non-Uniformities Resulting from Formation-Based Pressure and Flow Rate Relationships During the high-rate steam injection periods, the heating uniformity is significantly increased. During the low rate periods, the amount of injected steam is expected to be low enough so as not to significantly decrease uniformity. Injecting steam at a higher rate changes the pressure drop associated with the frictional effects on the flow of steam. The Forchheimer equation below shows that the pressure drop in a porous medium has a term proportional to the square of flow velocity above a critical velocity:

$$\frac{dP}{dL} = \frac{\mu v}{k} + \beta \rho v^2 \tag{3.1}$$

Where:

P=pressure (atm)

L=length (cm)

μ=viscosity (cp)

ν=velocity (cm/s)

k=Permeability (darcy)

β—No Darcy flow coefficient (atm-sec2/gm)

β=Density (g/cc)

As a result of the physical phenomenon characterized by the above equation, above a certain critical flow rate, doubling the flow rate results in a four-fold increase in pressure drop. As the peak steam flow rate is increased, the steam pressure within the formation at the foot of the injection well increases, and the outward steam flow rate also increases. As the outward flow rate increases, the pressure drop between the steam injection site in the formation and a distant point (e.g., Point 1 in FIG. 7), increases by the square of the flow rate, according to the above quadratic relationship. Portions of the formation which have a greater starting resistance to flow, and thus a lower flow rate, (e.g., Point 2 in FIG. 7), will experience a correspondingly lower flow pressure drop. As a result, a high injection flow rate (e.g., for a brief time), distributes the steam more uniformly in the formation, despite the original anisotropy in permeability, than if the same mass of steam is delivered at a lower flow rate for a longer period of time. As the injection uniformity increases, the uniformity with which the formation heats also increases, which in turn increases the uniformity of the permeability of the formation, as compared to the constant-flow rate case.

The foregoing variable rate flow approach can also be applied to a well with high-pressure zones. For example, in some instances the pressure at a zone within a larger formation will be at or above the normal injection pressure at which steam is injected into the formation. This zone may be at a higher pressure because it is not depleted, and/or because it was previously over-pressured. In a normal steam flood operation, if the design injection pressure never surpasses the reservoir pressure at that zone, then no steam injection will occur and the thermal EOR process will never be initiated.

By contrast, embodiments of the present technology include injecting steam at higher rates and pressures (for at least a period of time) while maintaining the same average steam injection rate. This procedure can accordingly initiate/resume steam injection into these zones to initiate/resume the thermal EOR process. For example, particular embodiments include measuring and managing steam injection on a well-by-well basis, and apportioning a daily mass of steam (again, on a well-by-well basis) to manage and/or account for subsurface variations across an oil-bearing formation.

In particular, the current common practice in steamflood, SAGD and cyclic steam operations, is to inject steam at a constant rate over a period of multiple days, weeks, months or years. A relatively constant pressure and flow rate deliver a continuous supply of steam during the injection period, and these parameters are typically changed only infrequently.

By contrast, embodiments of the present technology can instead deliver the same daily, weekly, or monthly mass of injected steam, but vary the rate of injection on a much more frequent basis, e.g., on an hourly basis. In a given period—for example, a 24 hour day-night period—the steam injection rate can be varied from a relatively higher rate of steam (more barrels/hour or tons/hour) during some hours (e.g., daylight hours), to a relatively lower rate of steam at other hours (e.g., nighttime hours). During the high-rate periods, the heating uniformity is significantly increased. During the low-rate periods the amount of injected steam is expected to be low enough so as not to significantly decrease heating uniformity b. Variable Rate Injection to Address Non-Uniformities Caused by Well-Based Pressure and Flow Relationships In some cases, conventional injection wells include "limited entry" or "sonic chokes" for steam injection. For example, limited entry perforating and flow chokes are used under constant steam flow rate conditions to limit the flow of steam into highly permeable and/or low pressure zones and thus divert steam into lower permeability formations. This approach can suffer from several limitations, which can be overcome using improved (e.g., optimized) variable rate steam injection, as is discussed further below.

Figure 10A:
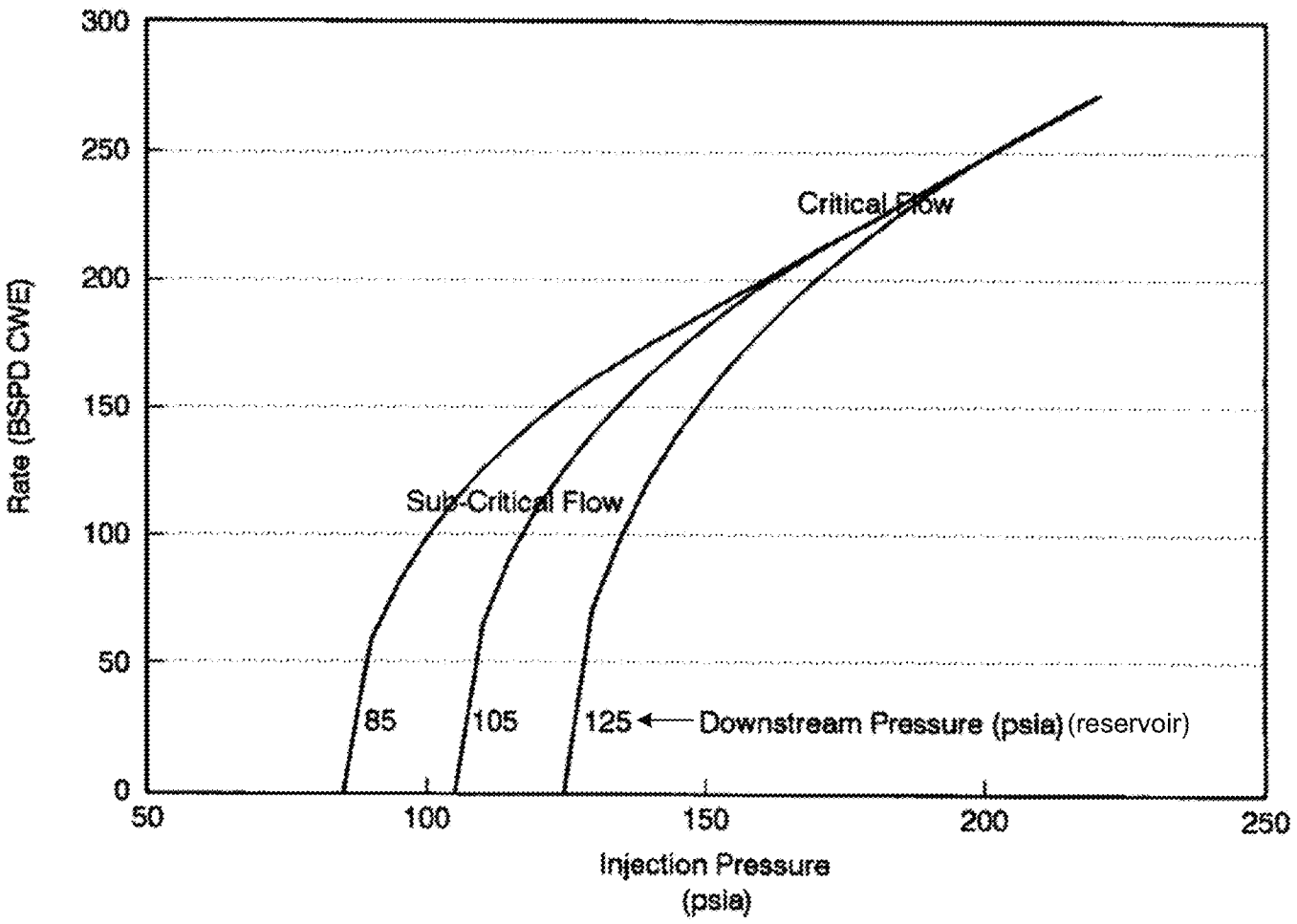
FIG. 10A is a graph illustrating sub-critical and critical flow regimes as a function of injection pressure at various downstream pressures, for EOR operations.

FIG. 10A is a graph illustrating steam injection rate (in units of barrels of steam per day, cold water equivalent) as a function of steam injection pressure (psia). Each of the three curves shown in FIG. 10A represents a downstream pressure, e.g., the pressure in the reservoir or formation into which the steam is injected. As seen in FIG. 10A, no flow is injected into the formation until the injection pressure exceeds the downstream pressure. Once the injection pressure exceeds the downstream pressure, the flow rate increases rapidly with increasing injection pressure in the sub-critical flow regime. The rate of increase then slows until the injection pressure is approximately double the downstream pressure. At this point, the flow becomes choked (sonic) and further increases in injection pressure produce significantly smaller increases in flow rate because the flow rate is limited by the sonic condition at the injector. As described further below, this limiting effect can be used to more evenly distribute the flow of steam across an oilfield. The convergence of the three lines in FIG. 10A demonstrates that once a choked flow condition is achieved, the variations in conditions within the wells (downhole pressure) no longer affect the rate of steam injection—so uniform injection can be achieved despite non-uniform well injectivity.

As used herein the terms "chokes" and "choking" are used to describe a variety of suitable devices or methods that produce a "choked" (sonic) flow between the wellbore and the reservoir layer by use of: limited entry perforating, orifice devices, flow control valves, steam savers, venturi valves, and/or other suitable devices that establish a condition where flow rate is not dependent (or is significantly less dependent) on downstream pressure. Choking can improve the uniformity of a steam flood flow pattern and thus the recovery factor in at least the following three cases.

(i) High Reservoir Pressure

If the downstream or reservoir pressure is too high for critical flow to be established in the valves, significantly increasing the upstream pressure (and flow rate) can produce choking at individual injection sites and can therefore direct roughly the same amount of steam at each choked injection site. Put another way, if some injection sites are choked and others are not, the un-choked sites will receive less flow, assuming the same reservoir pressure. Increasing the injection flow rate and pressure for a period of time will choke more injection sites. Therefore, for the same volume of steam injected, the distribution of steam within the formation will be more uniform as the time of injection is shortened and the peak flow rate is raised.

(ii) Total Average Injection Rate is Reduced Over Time

In many steam injection projects, the total desired mass of steam per unit time to be injected into a well or pattern of wells decreases after an early period (which may be months or years in duration), but it is still desirable to obtain critical or choked flow. See, for example, FIGS. 5A, 5B. As steam injection proceeds, the formation heats and in some cases steam breakthrough occurs at the production well, and the required optimal daily average steam amount drops (e.g., as shown in FIG. 5B). In such cases, the steam injection apparatus which achieves choked flow at a first (high) average total flow may no longer achieve choked flow at a later (low) average mass flow delivered at a lower continuous flow rate; that is, the choking devices will no longer function as designed to uniformly distribute steam delivery. If, instead, the initial high flow rate is maintained for a first period of time (e.g., during the day or a portion of the day), and then significantly reduced during another period of time (e.g., during the night), choked flow conditions can be achieved during the period when the higher flow rate is provided, allowing the desired distribution of steam to be maintained even while the average total mass flow of injected steam drops. Note that during the period of lower pressure and flow rate, choked flow may not be achieved, causing an uneven delivery of steam during such periods. However, the amount of steam delivered during these periods can be a relatively small fraction of the overall amount of injected steam, due to the lower injection pressure. Referring to FIG. 9, chokes may be installed in series with each steam injector 701 (at the wellhead, at a manifold, or elsewhere), and/or may be installed downhole within the well, such as at the well perforations 706. Chokes at this point balance the flow of steam into separate zones or layers of the formation. Accordingly, an advantage of this variable-rate arrangement is that the heating effect of the steam can be balanced between different layers, without the expensive process of removing and reinstalling new subsurface chokes as the EOR process proceeds. In other embodiments, a similar arrangement can be used to balance steam flow horizontally, in addition to, or in lieu of, balancing the flow vertically.

Figure 10B:
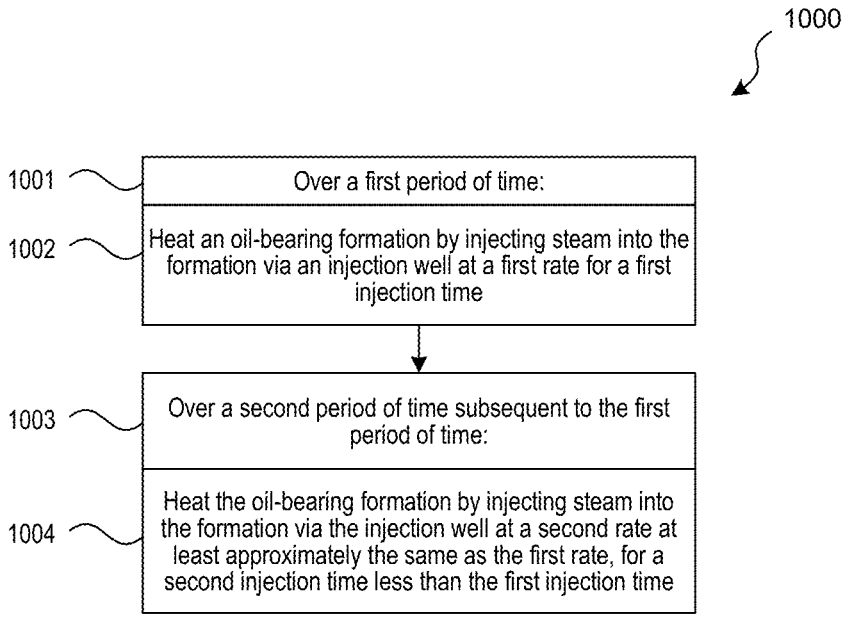
FIG. 10B is a flow diagram illustrating a process for injecting steam over multiple time periods, in accordance with representative embodiments of the present technology.

FIG. 10B illustrates a process 1000 for directing steam into an oil-bearing formation in accordance with the methodology described above. Process portion 1001 includes, over a first period of time, heating an oil-bearing formation by injecting steam into the formation via an injection well (block 1002). For example, this process can include heating the formation from a first temperature to a second temperature, changing a pressure in the formation (e.g., increasing pressure by the addition of steam, or decreasing pressure by causing oil to exit the formation via a production well), and/or changing another characteristic of the formation. The injected steam can include solar-generated steam, non-solar-generated steam, or a combination. The steam is injected at a first rate for a first injection time (e.g., a first number of hours per day). Over a second period of time subsequent to the first period of time (block 1003), the process includes directing heat into the oil-bearing formation by injecting steam into the formation via the injection well at a second rate at least approximately the same as the first rate (block 1004). For example, a downhole choke valve can deliver the flow into the formation at approximately the same flow rate during both the first and second periods of time. Over the second period of time, the steam is injected for a second injection time less than the first injection time (e.g., for fewer hours per day). For example, this process can include closing a valve to shorten the period of time over which the steam is injected. Accordingly, different periodic doses of steam can be delivered by the injection well at the same rate or approximately the same rate both when steam demand is high (e.g. during the first period of time) and when it is lower (e.g., during the second period of time) by changing the amount of time that steam is directed to the injection well. The foregoing process can be performed with updated parameters over a course of weeks/months/years as the oil field is heated and oil extraction progresses.

In one aspect of an example described above, temperature was used to indicate a transition from the first period of time to the second period of time. In other embodiments, this general approach can be used in the context of other variables, which may be correlated with temperature changes. A representative example includes the rate at which oil is removed from the formation, a parameter that increases as the formation heats up.

In still further embodiments, conditions other than flow rate can be held constant or approximately constant, while the "duty cycle" (e.g., average number of hours per day) is different during the first period of time than during the second period of time. For example, the flow state of the downhole choke valve can remain the same. That is, the downhole choke valve can remain choked during both the first period of time and the second period of time, while the duty cycle changes (e.g., decreases). The choked state of the valve can apply to multiple valves in a single injection well, and/or to valves across multiple injection wells.

(iii) Choke Perforation is Oversized or Otherwise has had its Effectiveness Wash Out Over Time In some cases, perforations, nozzles, and/or other orifices employed to achieve choked flow conditions are either improperly formed, due to variations in the way they are formed, or change due to effects associated with their operation. For example, downhole explosives are typically used to form perforations, and the resulting perforations may not be uniform, and in particular, may be too large. In addition, the perforations may erode over time. In such cases, choked flow may not be achieved in a constant-rate injection configuration. Aspects of the present technology—operating at a higher pressure and flow rate to achieve choked flow during one repeating time period (e.g., a daily cycle)—can be employed to improve the distribution of flow, and deliver the steam at closer to the original design point while tolerating the variations or changes in the orifice characteristics. For example, if existing chokes are not functioning at the design flow rate, the flow rate can be increased for some period of time to improve the distribution of flow consistent with the original design of the chokes, and reduced during a second period of time, so as to achieve the desired average flow rate.

This aspect of the present technology may be combined with aspects of the technology described further below with reference to FIG. 20. For example, the low-flow devices and high-flow devices described below with reference to FIG. 20 can be installed in the injection well initially, or a supplemental length of tubing (with low- and high-flow devices) can be inserted into an existing well to improve performance. In other embodiments, such devices can be integrated with the outer casing of the well.

To determine the effectiveness of the downhole choking, a step rate test (or other suitable test) may be performed. The step rate test is a test in which flow rate is changed multiple times to allow a plot of flow rate (Q) and well head pressure (P) to be made (e.g., similar to the graph shown in FIG. 10A). The characteristic of a choke is a non-linear relationship between pressure and flow rate. From this plot, the changes in slope of the P/Q curve will indicate when effective downhole choking is achieved. This method may be combined with a PLT (Production Logging Tool), spinner survey and/or other suitable arrangement to measure downhole flow rates.

The process can include the following, which considers a 24-hour cycling of steam injection rates, though other cyclic periods are suitable for other embodiments:

(a) For a given reservoir, a high—low cycle of steam injection is selected such that during the period $T_p$ an increased peak flow $Q_p$ is injected such that the downhole choking devices experience choked flow. During other times $(24-T_p)$ a minimum flow rate $Q_m$ is injected. These are determined such that the total target flow rate for a day $Q_t$ is met: e.g., $Q_t=T_p\times Q_p+(24-T_p)\times Q_t$ (b) Thus $Q_m=(Q_t-Q_p\times T_p)/(24-T_p)$ (c) If $Q_m$ is below a minimum flow rate required, then $T_p$ may be reduced In particular embodiments, the foregoing process is performed on a daily basis to better take advantage of solar steam supply or other time variation of steam supply such as the daily variation of cogenerated steam from a power plant.

5. VARIABLE RATE STEAM INJECTION TO INCREASE THE FRACTION OF HEATING PRODUCED BY SOLAR-GENERATED STEAM

In any of the foregoing embodiments, a variable steam input flow rate and pressure can improve the distribution of steam into the oil-bearing formation, and therefore the distribution of heat in the formation. The benefits of the variable rate steam injection approach can be realized via the method described above with reference to FIG. 2. Variable rate steam injection can also make greater use of available steam and therefore increase the solar fraction, as described further in this section.

A representative approach for designing a variable injection rate system to improve solar fraction can include constructing a model to estimate the distribution of steam flows to different zones of the formation at different pressures and/or flow rates. Practical limits on pressure and flow rate can also be determined including maximum, minimum, and average pressures and rates. The desired flow rates into each zone or region of the well are set, then a time-based "duty cycle" of different flow rates is designed to deliver at least a close approximation to the desired flow rates into each zone. The flow rate to achieve this flow is achieved via automatically actuated flow control devices. Due to the dynamics of the reservoir, this optimization process may be repeated over the course of the lives of the production and injection wells to account for changing conditions. This approach, in addition to achieving improved heating uniformity at the oil-bearing formation, can increase the fraction of the total amount of heating that is produced by solar-generated steam.

a. Representative Types of Injection Wells

As described previously, when solar steam is beneficial (e.g., when it costs less than alternative steam sources), it is economical to inject steam in a way that increases (e.g., maximizes) the fraction of steam that is heated with solar energy. The ability to increase or maximize the amount of heat provided to an oil formation that is generated by solar energy is limited by the fact that solar energy is only available during a portion of the day, and by the fact that some injection wells can deliver more steam than others. Aspects of the present technology are directed to increasing the solar fraction by identifying and directing higher peak steam flow rates to those wells that have an excess capacity for receiving steam, while maintaining a desired total daily mass of steam.

In general terms, and for purposes of discussion herein, steam injection wells are divided into three categories:

(1) A "Type A" well which, despite receiving the maximum amount of solar-generated steam that can be delivered to it during the day, requires additional steam to achieve its targeted daily mass of steam.

(2) A "Type B" well that has a higher capacity for receiving steam during the day, allowing a larger portion of its daily mass of steam to be delivered by solar-generated steam.

(3) A "Type C" well that is able to meet, but not exceed, its daily steam injection mass target via only solar-generated steam.

For each of the above wells, (even a Type C well), some steam is typically delivered to the well at night to prevent the well from cooling down excessively. Accordingly, Type B and Type C wells typically receive this minimum level of steam, even at night, when such steam may be produced by non-solar generators. A Type A well, on the other hand, requires additional steam at night in excess of the minimal level, simply in order to meet its target daily injected mass of steam.

Figure 11:
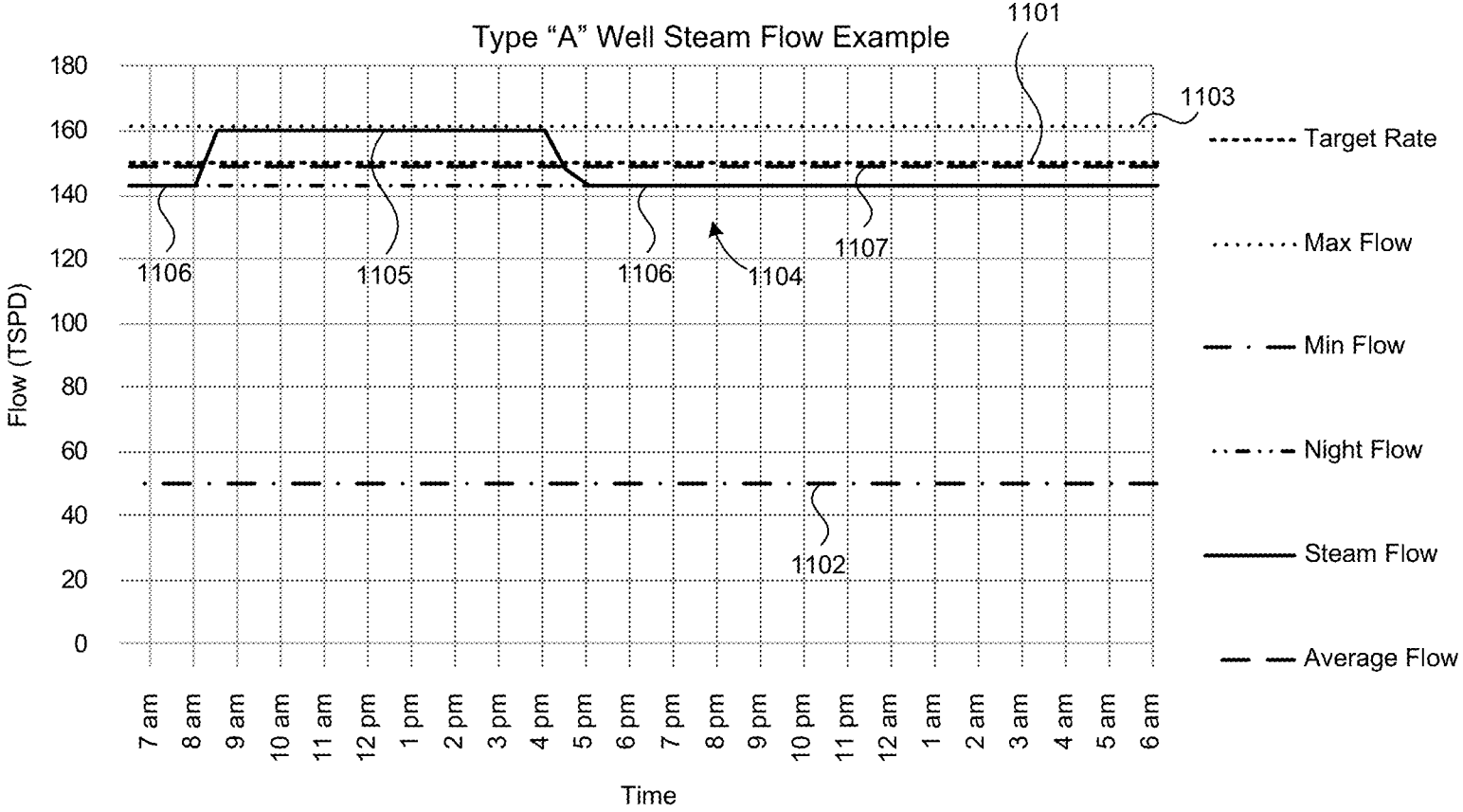
FIG. 11 is a graph illustrating variable rate steam injection to a first type of injection well over the course of a day, in accordance with a representative embodiment of the present technology.
Figure 12:
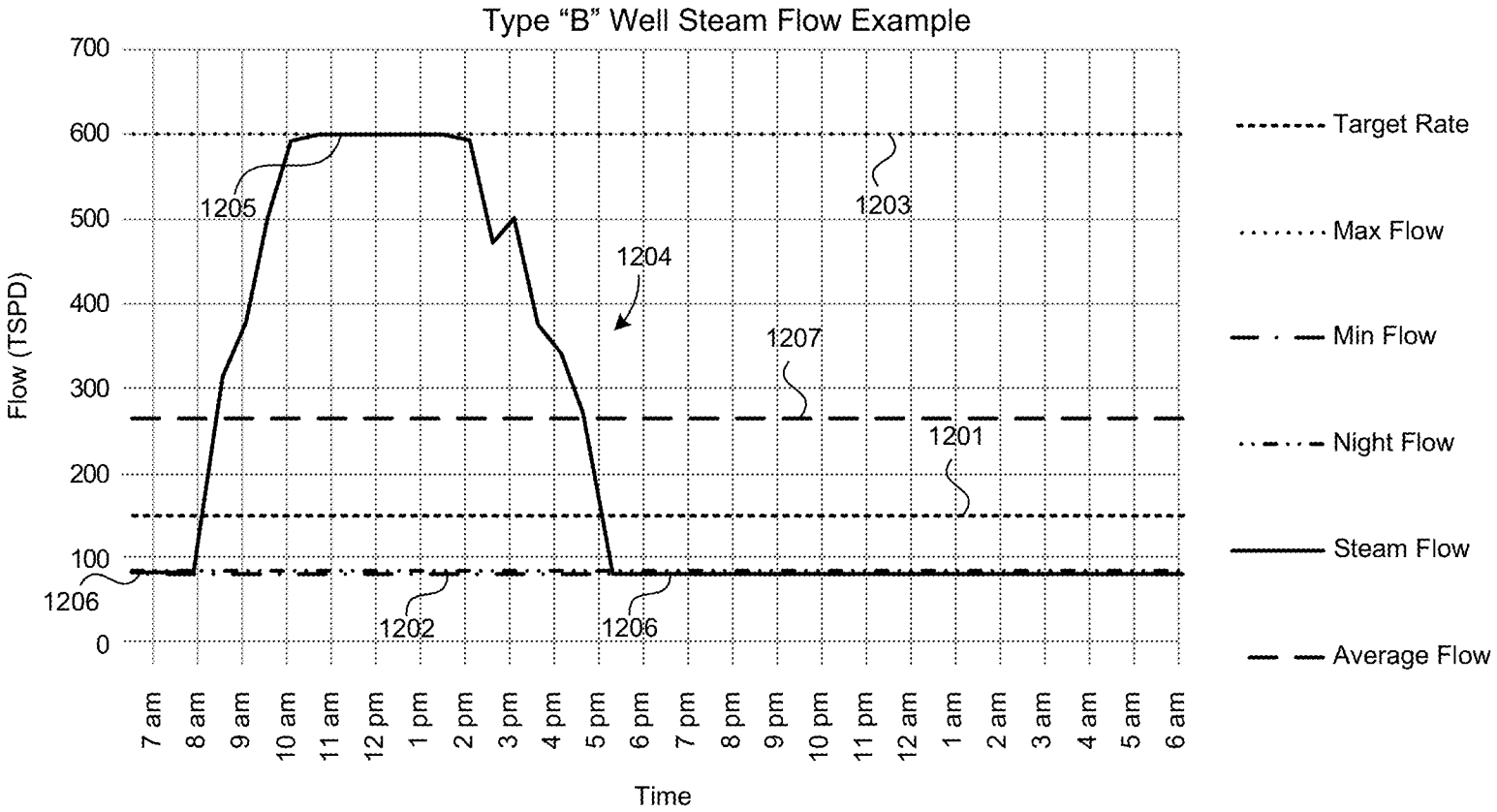
FIG. 12 is a graph illustrating variable rate steam injection to a second type of injection well over the course of a day, in accordance with a representative embodiment of the present technology.

FIG. 11 illustrates a representative daily performance profile for a Type A well, and FIG. 12 illustrates a representative daily performance profile for a Type B well. Beginning with FIG. 11, the Type A well has a daily target steam delivery mass (line 1101) of 150 tons of steam per day (TSPD). The well has a minimum steam flow rate of 50

TSPD (line 1102) and a maximum steam flow rate of 160 TSPD (line 1103). The minimum flow rate can also be expressed as 2.1 tons of steam per hour, and the maximum flow rate as 6.66 tons of steam per hour. As discussed above, the minimum steam flow rate may be set at a level to reduce or eliminate temperature drops in the well at night. The maximum steam flow rate represents the maximum rate at which the well can accept steam, with all the relevant up-stream valves opened. This value is typically set to avoid fracturing the overburden rock, to avoid damaging the well, and/or for other (e.g., safety-related) reasons.

During the course of a 24-hour period, the Type A well operates in a manner to produce an average flow (line 1107) equal to the target flow (line 1101). The total steam flow (line 1104) provided to the well to achieve this level includes a daytime flow (line 1105) provided by solar-generated steam, and a nighttime flow (line 1106) provided by non-solar generated steam.

As shown in FIG. 11, the Type A well receives solar-generated steam at the maximum available rate (line 1103), in addition to non-solar generated steam at above the minimum rate (line 1102) in order to deliver an average flow (line 1107) equal to its target flow (line 1101).

FIG. 12 illustrates a Type B well which has additional capacity for solar steam and can accordingly deliver steam in excess of its target rate. For example, the Type B well can have a target flow rate of 150 TSPD (line 1201), a minimum flow rate of 80 TSPD (line 1202) and a maximum flow rate of 600 TSPD (line 1203). During daytime hours (line 1205), the well delivers steam at the maximum rate (line 1203), and at night (line 1206) the well receives the minimum flow (line 1202). The combination of these flows produces an average flow (line 1207) greater than the target flow (line 1201), indicating that the well delivers more steam than it is required to.

FIGS. 13A-13B are tables illustrating characteristics of five representative wells, some Type A and some of Type B. Wells #1 and #3 (Type A wells) correspond to the performance profile shown in FIG. 11, and Well #2 corresponds to the performance profile described above with reference to FIG. 12. FIGS. 13A-13B includes representative characteristics for each of the wells and, in addition to the flow settings described above with reference to FIGS. 11 and 12, includes a ranking. As will be described in further detail below, the ranking can be based upon the expected value of oil produced as a result of the steam injected by the well, divided by the cost of the steam required to produce that oil.

Aspects of the present technology include methods of allocating variable rate steam among multiple wells, and a control system that carries out that allocation. The method may be carried out by field engineers or operators, or implemented via an automatic control system (e.g., one or more stored computer programs), in a centralized or distributed control system.

The foregoing methods can include dynamically allocating steam to wells so as to obtain a high solar fraction, making better use of time-varying solar steam, and/or with lower flows than are typical for conventional systems. Each well can be allocated steam to optimize a set of requirements including a target total steam per period of time (e.g., per day). The variable amount of steam can include a "duty cycle" of high and low flow rates.

The control system can be used to (a) improve (e.g., optimize) the requirement for steam injection into each well to satisfy daily or weekly steam demand for each well while reducing (e.g., minimizing) the use of fuel; and/or (b) implement the above allocation by directing valves, fuel flows, solar reflector positions and/or other devices. The allocation process can include running a fast loop (injection volumes as a function of fuel usage) and a slow loop (reservoir models for production on annual/seasonal basis) to determine the operational (e.g., optimum) settings.

b. Inputs and Outputs for Optimizer/Controller

Figure 14A:
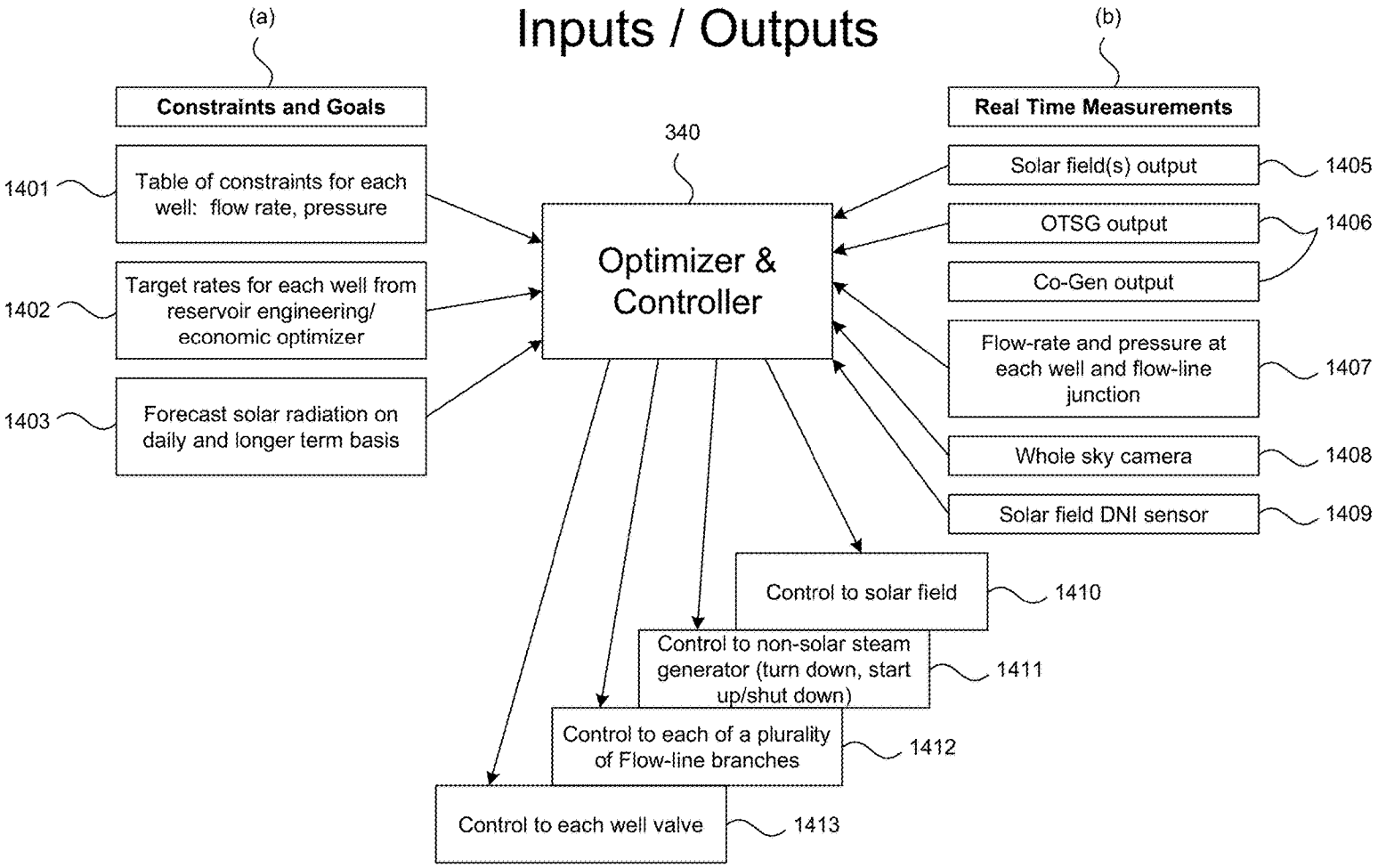
FIG. 14A is a flow diagram illustrating representative inputs and outputs for a control system in accordance with embodiments of the present technology.

FIG. 14A is a partially schematic illustration of a process for establishing (e.g., optimizing) and implementing control parameters for a system such as the system described above with reference to FIG. 3. In some embodiments, the same computer/controller 340 can be used to both optimize the control parameters and execute the instructions that carry out the process steps (e.g., by providing directives to the actuators described above). In other embodiments, the process of optimizing the control parameters and executing the control parameters can be carried out by different controllers/computers and/or combinations of controllers/computers.

The inputs to the system can include (a) constraints and goals, which can be fixed or can vary on a relatively large time scale (e.g., weeks, months or years), and (b) measurements (e.g., real-time measurements) that change on a more rapid time scale (e.g., seconds-based, minutes-based or hours-based). The constraints and goals can include maximum flow rates and pressures for each injection well (block 1401), target injection rates for each well, based, for example, on an engineering and/or economic optimizer data (block 1402), and/or forecast solar radiation on a daily and longer-term basis, e.g., based on historical measurements (block 1403). The short-time-scale measurements can include the output from the solar field (block 1405), the output from the non-solar steam generators, e.g., a fuel-fired generator and, if present, a co-generator (block 1406), the flow rates and pressures at individual wells and individual junctions or other locations along the steam flow path (block 1407), input from a whole-sky camera (block 1408), and/or input from a solar field DNI sensor (block 1409).

One goal of the optimizer can be to minimize a cost function related to the difference between the target and actual daily injection rate for each well while meeting the constraints of steam supply, and line capacity throughout the network. Another goal can be to ensure that steam is delivered first to high-value wells where the steam is expected to have the greatest economic benefit. Still another goal can be to take advantage of wells that have the capacity to deliver more solar-generated steam than is required to meet their total daily steam mass target.

Based on the long-term constraints and goals and the short-term measurements, the allocation (e.g., optimizer) portion of the program determines control parameters, and the controller portion of the system executes the control directives. The control directives can include directives to the solar field, e.g., directing the movement of solar concentrators and fluid flow into and out of the field (block 1410). Control directives can also be issued to the non-solar steam generator(s) e.g., to start up, shut down, increase or decrease steam output (block 1411). The control directives also include controls to individual branches or junctions of the steam supply and distribution network (block 1412), and to individual wells (block 1413). The controls to the wells can include changing valve positions, changing choke positions, and issuing directives to motor-operated valves (MOVs).

Figure 14B:
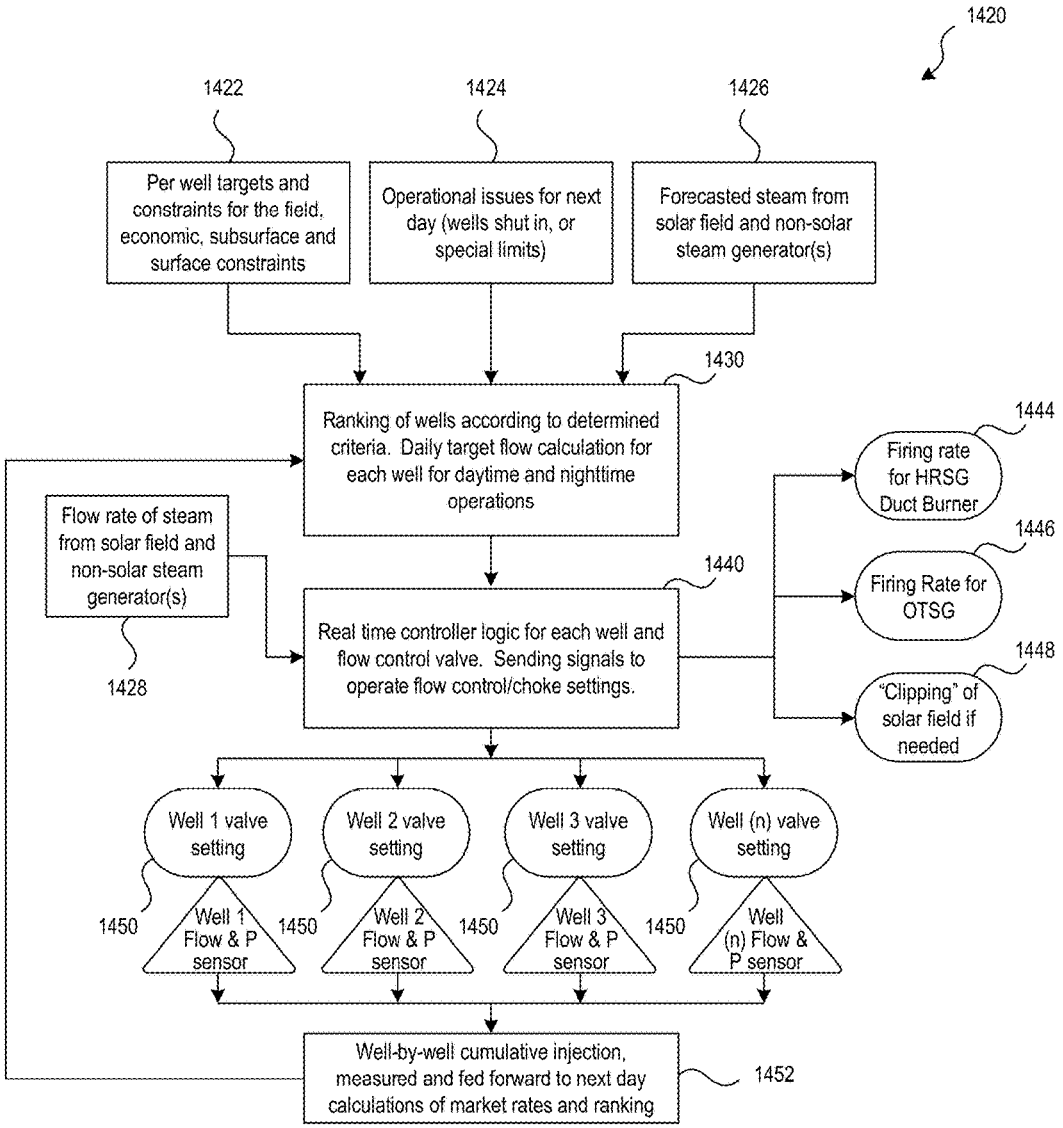
FIG. 14B is a flow diagram illustrating representative inputs and outputs for a control system in accordance with further embodiments of the present technology.

FIG. 14B is a flow diagram illustrating a process 1420 in accordance with another aspect of the present technology. This process follows the general outline described above with reference to FIG. 14A, and includes additional details.

Block 1430 includes ranking the injection wells according to determined criteria and then calculating target flows for each well for both daytime and nighttime operations. The inputs used to make the determinations identified in block 1430 include per-well targets and constraints, and/or economic, subsurface and/or surface constraints (block 1422), operational issues, e.g. wells are the to be "shut in" or have other special limits or features (block 1424), and/or forecasts e.g., for steam from the solar field and/or non-solar steam from corresponding generators (block 1426).

Once the wells are ranked, block 1440 includes determining the settings for individual wells. This process can be performed on a daily basis and/or a more frequent or less frequent basis, depending upon the particular operation. The inputs for block 1440 include the flow rate of steam from the solar field and the non-solar steam generator (block 1428), in addition to the ranking identified in block 1430. The outputs include firing rates for non-solar steam generators (e.g., a heat-recovery steam generator duct burner, as shown in block 1444 and/or a once-through steam generator, as shown in block 1446). If the output from the solar field exceeds the capacity of the injection wells, even after all injection wells have received the maximum amount that they can deliver, the output from the solar fields can be "clipped", e.g. reduced, for example, by pointing one or more solar concentrators off sun (block 1448).

After the valve settings are determined in block 1440, the individual valves for individual wells are adjusted (blocks 1450). Sensors at each well can be used to identify the actual amount injected to each well, as indicated by block 1452. If the actual values results in a deficit or surplus, that information can be fed back into block 1430 to adjust the steam injection schedule for a subsequent period of time (e.g., the next day).

c. Representative Optimizer

The following is an example of a simple, spreadsheet-based version of an optimizer for establishing control directives based on inputs in accordance with an embodiment of the present technology.

(iv) Global Parameters/Inputs

SD=Total expected duration of solar steam per day in hours

OTSGMIN=fuel-fired once through steam generator (OTSG), turn down flow in tonnes of steam per day (TSPD)—this is the level to which the OTSG is turned down once the solar field reaches a minimum threshold flow rate OTSGF=OTSG normal flow rate in TSPD OTSGEff %=Efficiency of OTSG in %—this is a constant value based on the Higher Heating Value (HHV) of the fuel used to power the OTSG DuctMinF=Flow rate contribution from Duct Burner turn-down flow rate in TSPD—this is the level to which the Duct Burner is turned down once the solar field reaches a minimum threshold flow rate—in a particular example the Duct Burner is set at a constant value at its turn-down flow rate HRSGF=Flow rate contribution from Heat Recovery Steam Generator (HRSG) in TSPD, this is a constant contribution of a fixed value SolarPeak=Peak flow rate from solar facility in TSPD OilPrice=Price of oil in $/Tonne FuelPrice=Price of fuel used to make steam in $/MMBTU (million BTUs)—this is used to obtain steam price SteamPrice=Price of steam in $/Tonne accounting for the fuel price and OTSG efficiency (v) Further Parameters and Variables N=Total number of wells—in this optimization example an N=5 (i.e. 5 injection wells)

n=Well rank number, n=1, 2, 3, . . . , N i=Time segment of day. In this example, the day is split into 48 segments of 30 min intervals starting from 7:00 am with i=1, 2, 3, 4, . . . , 48

SD(i)=Expected duration of solar steam day at time segment (i)

OTSG(i)=Flow rate contribution from OTSG at time segment (i) in TSPD, this flow is between OTSGMIN and OTSGF SolarPercentage(i)=Percentage of total peak solar flow rate (SolarPeak) at time segment (i) in TSPD. In this example this is an input from the solar field in real time TotalSteamOutput(i)=Total steam flow output from the systems (OTSG, HRSG, Duct Burner and Solar facility) in TSPD at time segment (i)

—SOR (n)=Steam Oil Ratio—ratio of Steam flow to Oil flow in well (n)

TF (n)=Target flow rate for well (n) in TSPD (total mass of steam per day)

MF (n)=Minimum flow rate for well (n) in TSPD

PF (n)=Peak allowable/achievable flow rate for well (n) in TSPD may require opening a valve, e.g., a choke valve DS (n)=Delivered steam flow rate for well (n) in TSPD—this is the flow to well (n) based on PF and MF prior to adjustments, and helps indicate the type of well, e.g., whether it is "A" or "B"

NF (n)=Nighttime flow rate for well (n) in TSPD—this is a flow calculated to satisfy TF during nighttime period that is above the MF of that particular well (n) assuming an amount of available solar-generated flow delivered at peak rate during the solar day APF (n)=Adjusted peak flow rate for well (n) in TSPD—this is the adjusted peak flow rate applicable for well (n) to stay within TF requirements when MF is applicable at nighttime and PF for this (n) would result in exceeding TF WellType (n)=Well (n) could be allocated as one of three types:

Type "A"—where PF is maintained during SD while NF applies at nighttime when MF at night and PF during the day alone are not sufficient to meet TF (see FIG. 11)

Type "B"—where MF is maintained at nighttime while PF is reduced to APF during SD in order not to exceed TF (see FIG. 12)

Type "C"—where MF and PF meet exactly the flow required of the well and no adjustments are required Rank (n)=Ranking order of which well is in priority to be switched on. In the example given they are ranked by the "SteamValue" parameter ExtraCapacity (n)=Extra capacity for steam injection available for well (n) in TSPD/%—this is the difference between the peak flow (PF) and adjusted peak flow (APF), indicating the amount of extra flow that could be supplied to a well that has a lower APF value than what is physically possible to inject to it (PF)

CN (n)=Cumulative night flow rate for well (n) in TSPD—this is the minimum total flow needed to be available for well (n) to meet the night flow (NF) requirements for that well and subsequent wells down the rank SteamValue (n)=Value allocated to well (n) based on economic value of the potential oil extracted, estimated from the Steam Oil Ratio (SOR) and value of barrel of oil, as well as cost of steam used for injection SB (n, i)=Steam balance available for well (n) at time segment (i) in TSPD—this is the allocated steam that could be distributed to the well at that time segment SteamFlow (n, i)=Steam flow into well (n) at time segment (i) in TSPD—this is the steam flow injected for well (n) at that particular time segment which satisfies the NF, APF and SB requirements of this well and all other subsequent wells in rank AdjSteamFlow (n, i)=Adjusted value of SteamFlow (n,i) in TSPD after distribution of excess steam Excess (i)=Excess steam available at time segment (i) in TSPD SteamSupply(n)=Total steam supplied to well(n) in TSPD SteamBalance(n)=Excess (positive) or insufficient (negative) flow of steam delivered to well (n) relative to its target flow rate (TF)

Representative Equations

Steam value equation:

$$SteamValue_{(n)} = \left\{\frac{OilPrice}{SOR}\right\} - SteamPrice \tag{4.1}$$

Equations to adjust minimum flow (MF) at nighttime and for peak flow (PF):

$$NF_{(n)} = \left\{TF_{(n)} - \left(PF_{(n)}\frac{SD}{24}\right)\right\}\frac{24}{24-SD} \tag{4.2}$$

$$APF_{(n)} = \left\{TF_{(n)} - \left(MF_{(n)}\frac{24-SD}{24}\right)\right\}\frac{24}{SD} \tag{4.3}$$

$$DS_{(n)} = \left\{PF_{(n)}\frac{SD}{24} - MF_{(n)}\frac{24-SD}{24}\right\} \tag{4.4}$$

Equations to estimate cumulative night flow (CN):

$$CN_{(n)}=FN_{(n)}+CN_{(n+1)} \tag{4.5}$$

Boundary condition for last ranked well:

$$CN_{(N)}=MF_{(N)} \tag{4.6}$$

Steam Balance for all segments and wells:

$$SB_{(n,i)}=SB_{(n-1,i)}-SteamFlow_{(n,i)} \tag{4.7}$$

Boundary condition for highest rank well (n=1) is the total steam flow output from the system:

$$SB_{(1,i)}=TotalSteamOutput_{(i)} \tag{4.8}$$

$$TotalSteamOutput_{(i)}=OTSG_{(i)}+HRSGF+DuctMinF+SolarFlow_{(i)} \tag{4.9}$$

$$SolarFlow_{(i)}=SolarPeak*SolarFraction_{(i)} \tag{4.10}$$

$$OTSG_{(i)}=OTSGMIN$$

$$\text{if } HRSFG+DuctMin\mathit{F}+SolarFlow_{(i)} \geq \Sigma_{n=1}^{N}NF_{(n)} = HRSFG+DuctMin\mathit{F}+SolarFlow_{(i)}$$

$$\text{if } HRSFG+DuctMin\mathit{F}+SolarFlow_{(i)} < \Sigma_{n=1}^{N}NF_{(n)} \tag{4.11}$$

Steam Flow equations:

Type "A" wells:

$$\begin{aligned} SteamFlow_{(n,i)} = {} & \\ & SB_{(n,i)} - CN_{(n)} \text{ if } NF_{(n)} < SB_{(n,i)} - CN_{(n)} < APF_{(n)} = \\ & NF_{(n)} \text{ if } SB_{(n,i)} - CN_{(n)} < NF_{(n)} = \\ & APF_{(n)} \text{ if } SB_{(n,i)} - CN_{(n)} < APF_{(n)} \end{aligned} \tag{4.12}$$

Type "B" wells:

$$\begin{aligned} SteamFlow_{(n,i)} &= SB_{(n,i)} - CN_{(n+1)} && \text{if } NF_{(n)} < SB_{(n,i)} - CN_{(n+1)} < APF_{(n)} \\ &= NF_{(n)} && \text{if } SB_{(n,i)} - CN_{(n+1)} < NF_{(n)} \\ &= APF_{(n)} && \text{if } SB_{(n,i)} - CN_{(n+1)} < APF_{(n)} \end{aligned} \tag{4.13}$$

Boundary condition for last ranked well (n=N) of either type:

$$\begin{aligned} SteamFlow_{(N,i)} &= SB_{(N,i)} && \text{if } NF_{(N)} < SB_{(N,i)} < APF_{(N)} \\ &= NF_{(N)} && \text{if } SB_{(N,i)} < NF_{(N)} \\ &= APF_{(N)} && \text{if } SB_{(N,i)} < APF_{(N)} \end{aligned} \tag{4.14}$$

Excess Steam equations:

Excess steam available at any time segment after distribution to all wells:

$$Excess_{(i)}=SB_{(N,i)} \tag{4.15}$$

Extra capacity of steam, applicable for Type "B" wells only:

$$ExtraCapacity_{(n)} = PF_{(n)} - APF_{(n)} \tag{4.16}$$

$$ExtraCapacity\%_{(n)} = \frac{PF_{(n)} - APF_{(n)}}{\sum_{i=1}^{N} PF_{(i)} - APF_{(i)}} \tag{4.17}$$

Adjusted steam flow after allocating excess capacity:

$$\begin{aligned} AdjSteamFlow_{(n,i)} = {} & \\ & SteamFlow_{(n,i)} + \{Excess_{(i)} * ExtraCapacity\%_{(n)}\} \\ & \text{if } \{Excess_{(i)} * ExtraCapacity\ \%_{(n)}\} < PF_{(n)} = \\ & PF_{(n)} \text{ if } \{Excess_{(i)} * ExtraCapacity\ \%_{(n)}\} > PF_{(n)} \end{aligned} \tag{4.18}$$

Calculating percentage of target steam flow delivered for each well:

$$SteamSupply_{(n)} = \frac{\sum_{i=1}^{48} AdjStreamFlow_{(n,i)}}{48} \quad (4.19)$$

$$SteamBalance_{(n)} = SteamSupply_{(n)} - TF_{(n)} \quad (4.20)$$

Calculating target flow for well (n) based on previous day's target:

$$TF_{(n)\ current\ day} = TF_{(n)\ previous\ day} - SteamBalance_{(n)\ previous\ day} \quad (4.21)$$

(vi) Control Parameters and Algorithm Description

Figure 14C:
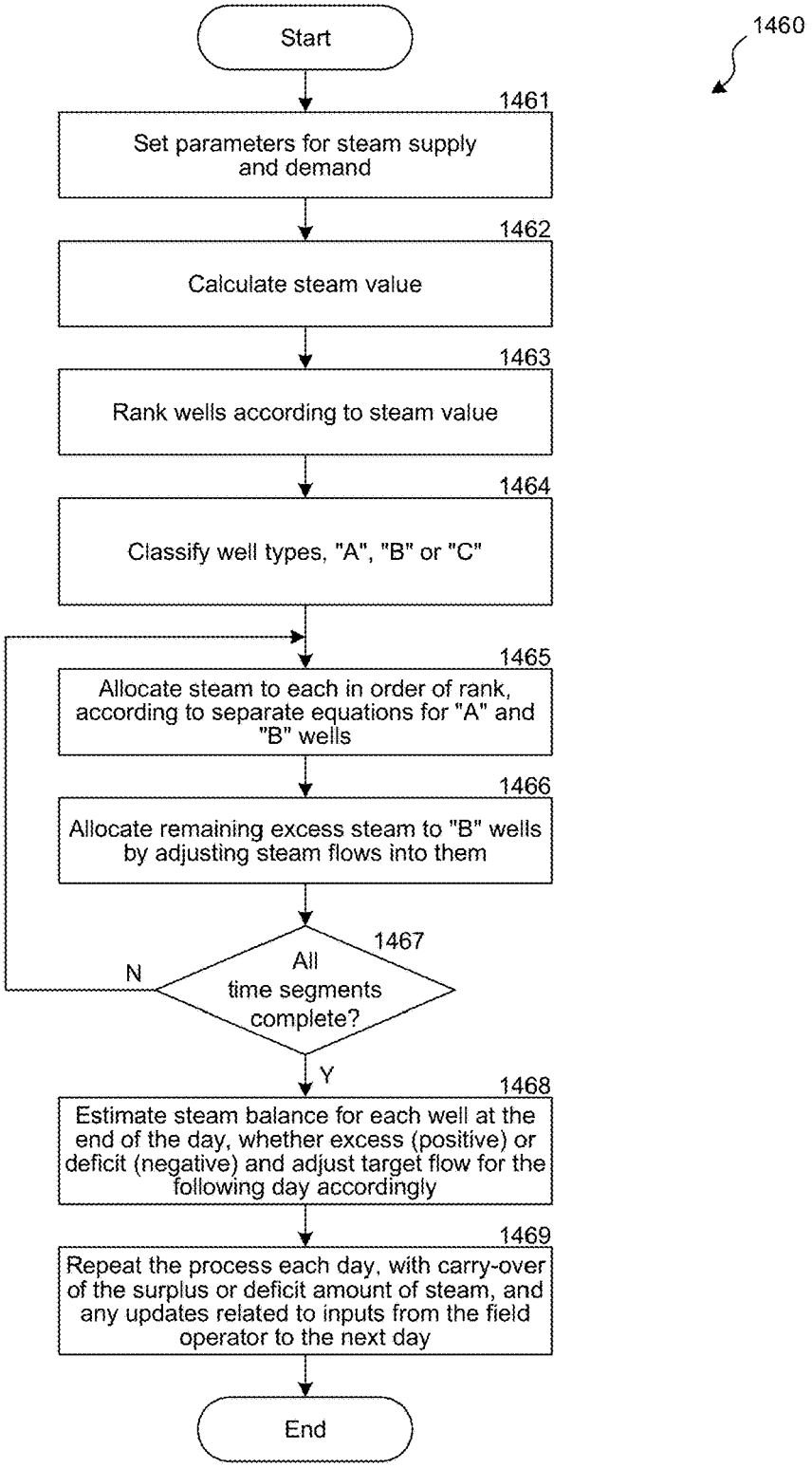
FIG. 14C is a flow diagram illustrating a process for allocating steam to multiple variable rate injection wells, in accordance with representative embodiments of the present technology.

FIG. 14C is a flow diagram illustrating a representative process for determining well-by-well injection rates in accordance with an embodiment of the present technology. The process 1460 includes setting parameters for steam supply and demand (described above) (block 1461), calculating steam value (process portion 1462) and ranking the wells according to the steam value (block 1463). The steam value refers generally to the expected cost of the steam divided by the expected value of oil resulting from injecting the steam.

At block 1464, the wells are classified as Type A, Type B, or Type C, consistent with the discussion above with reference to FIGS. 11 and 12. In block 1465, steam is allocated to each of the wells in order of rank, using different equations for Type A wells than for Type B wells. This process is performed for an initial time segment. If, after the initial allocation, additional steam remains, it is allocated to the B wells, which can handle an increased amount of steam (block 1466). At block 1467, it is determined whether all the time segments have been completed. Blocks 1465 and 1466 are repeated until all time segments have been completed.

At block 1468, the steam balance is estimated for each well at the end of a day. The balance can be positive or negative and in either case, is used to adjust the target flow for the following day. At block 1469, the process can be repeated each day, with surpluses or deficits carried forward into the following day.

The following sections outline representative calculations and results using the foregoing inputs and equations. Results are also shown in FIGS. 15A-18B. The calculations were performed using a spreadsheet, and in other embodiments, can be performed using other techniques. In general, the process can be iterative. In an illustrated embodiment, a two-step iterative process is shown. In other embodiments the process can include more iterative, depending on the desired level of precision.

The total amount of steam available for injection at each time segment was calculated from the OTSG, HRSG, Duct Burner and Solar flows for that segment. In a particular embodiment, HRSG flow is maintained at its normal flow throughout the day, while the Duct Burner flow is kept at its turn down flow at all times. OTSG flow can be increased up to its maximum flow to maintain the required nighttime flow (NF) for each well during nighttime when solar is not available; when solar steam comes online it is turned down to its minimum flow (OTSGMIN). FIG. 15A illustrates the results.

Solar flow (SolarFlow) at each time segment is calculated based on the peak solar flow possible (SolarPeak) and the daily variation in solar energy (SolarDaily) which is a percentage. Both of these variables are inputs to the algorithm.

Delivered steam (DS) to each well determines the type of well it is:

Type "A" if DS<0
Type "B" if DS>0
Type "C" if DS=0

Night flow (MF) and adjusted peak flow (APF) values are then adjusted differently based on the type of well determined:

Type "A" wells—
NF is adjusted as per equation (4.2)
APF=PF
Type "B" wells—
NF=MF
APF is adjusted as per equation (4.3)
Type "C" wells (no adjustments to MF or APF)—
NF=MF
APF=PF DS, MF and APF estimations are shown in FIG. 15B.

Wells are ranked according to their "SteamValue" parameter. This determines the ranking in which steam is distributed to each well. The SteamValue estimations are shown in FIG. 15C.

Steam is delivered to the wells according to their ranking, and depending on the amount of steam available for that well at the specific time segment (i.e. the SB parameter). Steam is distributed to the first ranked well based on equation 4.14 and then distributed onwards to the subsequent well in ranking as per equations 4.12 or 4.13, depending on the determined well type, and so on until the last ranked well is reached (n=N). An example is shown on the first row of FIG. 15D. For purposes of illustration, only the first thirteen of the daily 30 minute time segments are shown in FIGS. 15D-15F.

The algorithm in equations 4.12 to 4.14 delivers the maximum possible steam to the first ranked well as long as the steam balance is sufficient to meet the nighttime flow for subsequent wells down the rank. This flow is the adjusted peak flow for that particular well; however, if there is insufficient steam balance for the adjusted peak flow, the algorithm ensures the highest possible amount of steam is delivered which is the balance steam minus the cumulative nighttime flow needed for subsequent wells (CF). The calculation of steam balance after every allocation is as per equation 4.7 and is shown as an example in FIG. 15E.

After delivering the maximum possible steam to the highest ranked well (n=1), the process is repeated for the next-ranked well (well n=2), but with an available steam balance that is reduced by the amount delivered to the previous well (well n=1), and so on until all the last ranked well (well n=N), as shown in FIG. 15D.

Figure 16A:
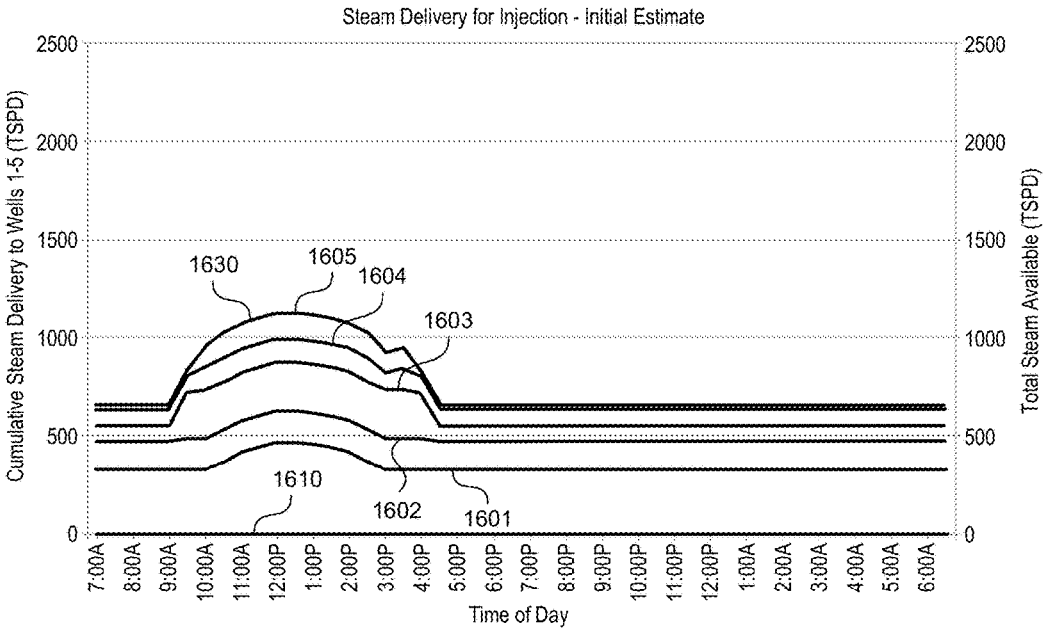
FIGS. 16A and 16B graphically illustrate initial and final results, respectively, from an iterative program allocating steam to multiple wells, with no excess steam available, in accordance with representative embodiments of the present technology.
Figure 17A:
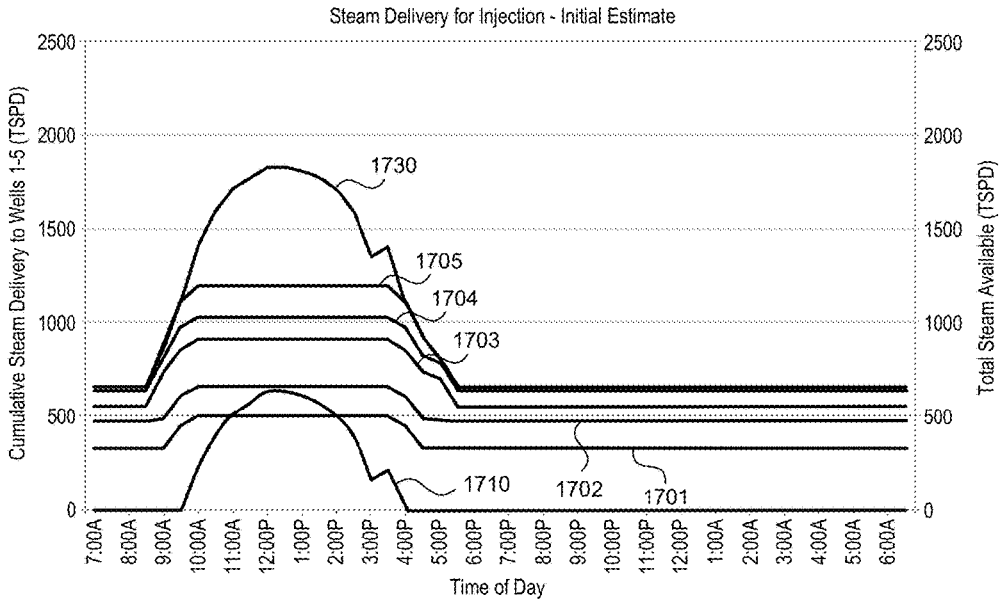
FIGS. 17A and 17B graphically illustrate initial and final results, respectively, from an iterative program allocating steam to multiple wells, wherein excess steam is available, in accordance with representative embodiments of the present technology, wherein excess steam is available.
Figure 18A:
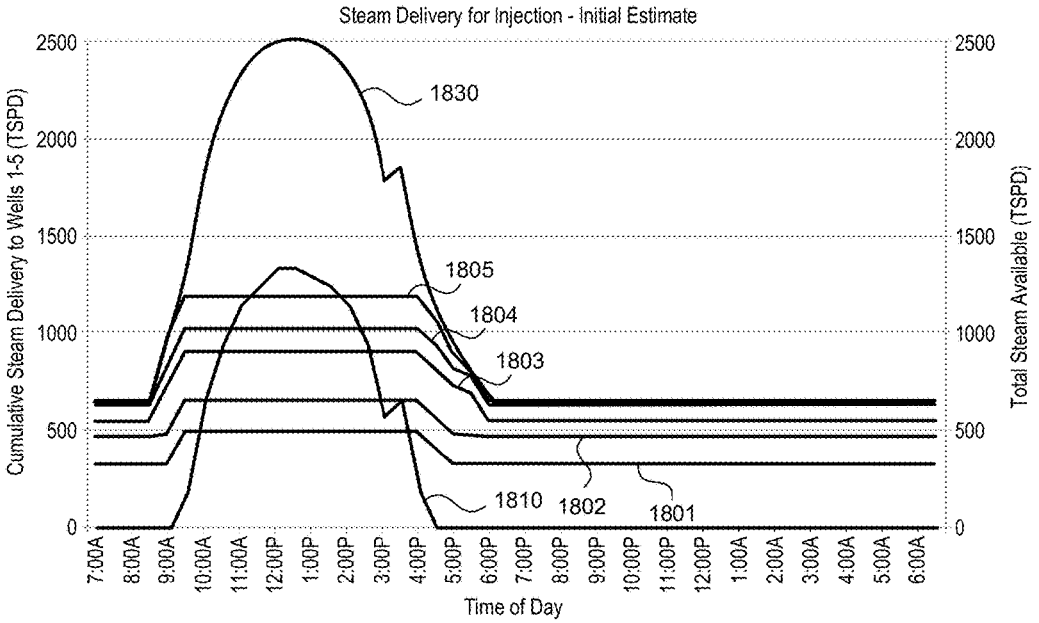
FIGS. 18A and 18B graphically illustrate initial and final results, respectively, from an iterative program allocating steam to multiple wells, wherein sufficient excess steam is available that some steam is clipped, in accordance of representative embodiments with the present technology.

After initially allocating the required steam for all the wells, the daily steam profile is as shown in FIGS. 16A, 17A and 18A. FIG. 16A shows the case when the cumulative steam flow demand to all wells is met, and there is no excess steam balance (line 1610). Line 1601 indicates the steam mass delivered to well n=1, line 1602 indicates the cumulative steam mass delivered to wells n=1 and n=2, and lines 1603, 1604 and 1605 indicate the cumulative steam flow masses delivered to wells 1-3, 1-4 and 1-5, respectively. The total amount of delivered steam (line 1630) is equal to the cumulative amounts delivered to wells 1-5 (line 1605). FIGS. 17A and 18A shows cases when there is excess steam supplied that is not (in the initial iteration of the program) being distributed to the wells (lines 1710 and 1810).

The cases depicted in FIGS. 17A and 18A indicate that extra steam is available and can be allocated to wells that still haven't exceeded their maximum steam rates. In particular, line 1710 indicates a non-zero amount of excess steam. Lines 1701-1705 identify the cumulative amounts of steam delivered to the wells (as discussed above with reference to FIG. 16A), with the total steam mass (line 1730) exceeding the cumulative amount delivered to the five wells (line 1705) by the excess available steam (line 1710). A similar result is shown in FIG. 18A (see lines 1801-1805, 1810 and 1830). The extra steam for each time segment is estimated from equation 4.15, which is equation 4.7 at n=N, i.e. the remaining balance of steam after steam is distributed to all the wells (last row of FIG. 15E). This excess steam balance is then used along with the extra capacity for steam from equation 4.16 to adjust the actual steam flow for each well at each time segment as per equation 4.18. The adjusted steam flows for this example is shown in FIGS. 15F and 15G.

Figure 16B:
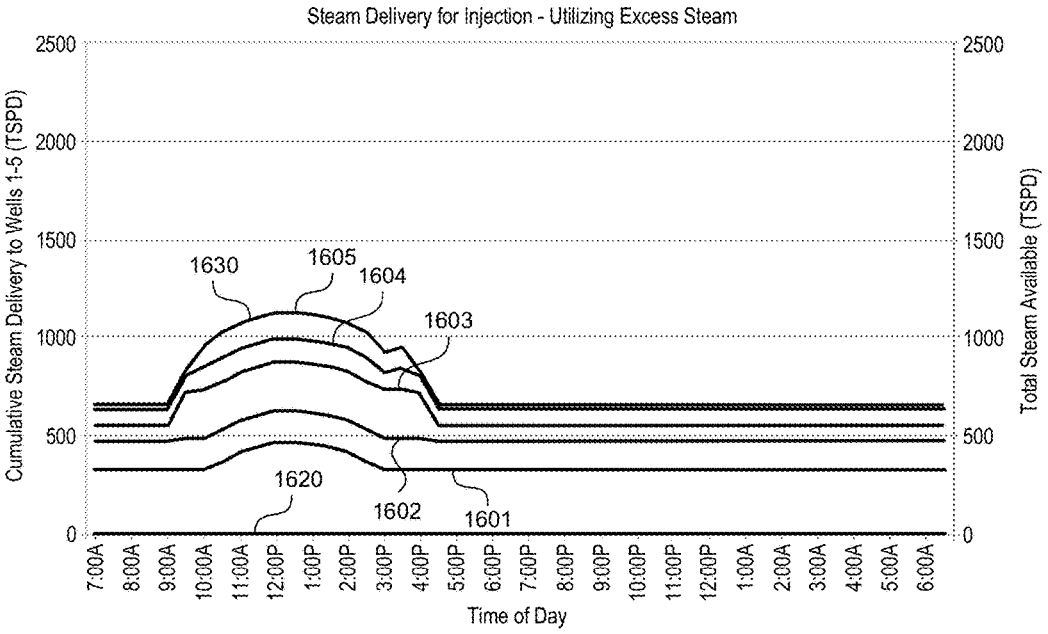
Figure 17B:
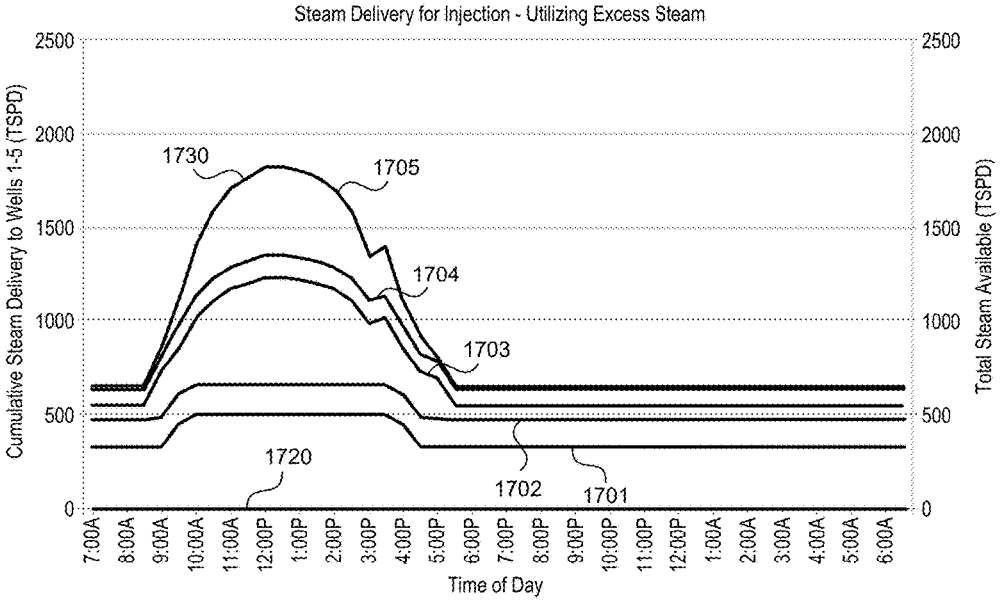
Figure 18B:
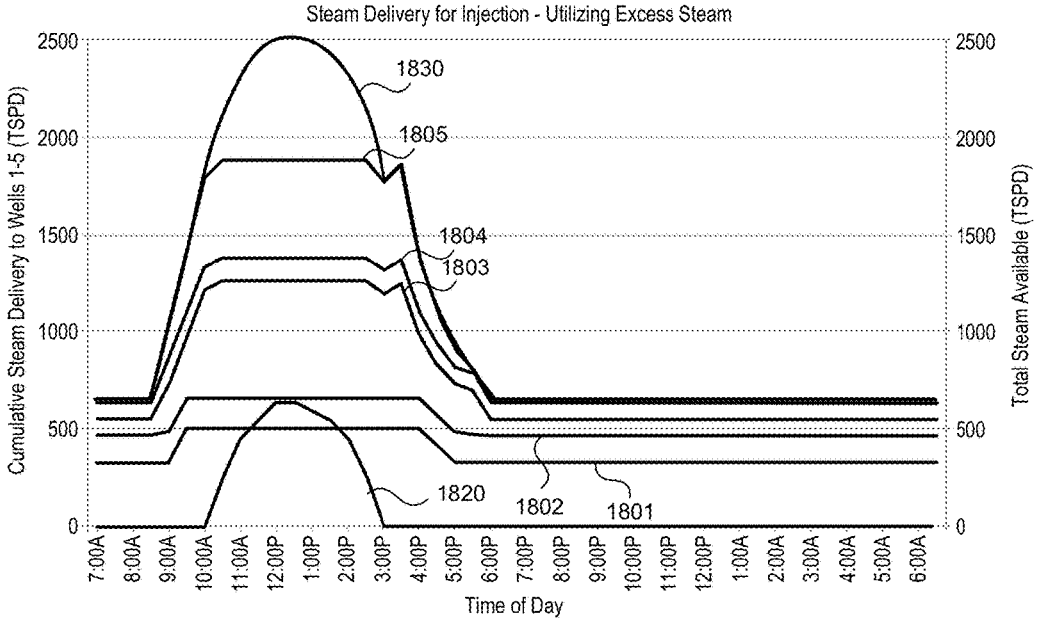

FIGS. 16B, 17B and 18B show the daily steam profile for the adjusted steam flow rates which utilize the excess available steam, and correspond to FIGS. 16A, 17A and 18A, respectively. Accordingly, these Figures represent a second iteration of the process. FIG. 16B is identical to FIG. 16A because there is no excess steam to distribute. Because there is no excess steam, no steam is clipped from the solar field output (line 1620 is at zero). FIG. 17B shows that when there is excess steam (line 1710 in FIG. 17A) the excess steam can be distributed to the wells that have extra capacity. These are wells 3, 4 and 5 which have an increased delivery level in FIG. 17B compared to FIG. 17A. Because the excess supply is taken up by the excess capacity of these wells, the amount of clipped steam (line 1720) is again zero. If the total steam flow exceeds the cumulative capacity of the wells, some excess steam must be clipped/dumped, as shown in FIG. 18B (line 1820).

The adjusted steam flow rates may exceed or be below target flow rate (TF) of steam for a particular well; therefore, equations 4.13 and 4.14 are used to estimate the steam supply and balance (parameters: SteamSupply and SteamBalance) into each well. This is shown in FIG. 15G. The SteamBalance parameter can then be fed forward into the following day's target flow for each well, e.g., added or subtracted to it depending on whether it supplied excess or insufficient flow of steam. This adjusts the target flow of the wells as per equation 4.21 for the following day, and results in wells that did not receive enough steam (i.e. most negative Steam Balance value) receiving a higher target flow until they receive their share of steam, and vice versa for wells that received more steam than their target rate.

This method may not result in a perfect match. In one embodiment a "cost function" is calculated based on a mismatch between actual steam and target steam flow. This cost function is minimized by an interactive calculation on the data that changes the night flow to "catch up" or "slow down" injection to minimize the cost function.

A cost function is redefined by the operator of the field to calculate the cost of not meeting the target injection rate. In one embodiment, the cost function assumes that if steam is injected above the target rate, it is a waste of gas, and if not enough steam is injected, it prevents a volume of oil being produced based on the well patterns steam oil ration (SOR).

6. REPRESENTATIVE IMPLEMENTATIONS a. Types of Automation

In one embodiment, the steam directed into each injection well is controlled by one or more motorized valves at each well under the direction of a controller. In another embodiment, the field can operate with pressure actuated switches instead of an electronic or PLC controller. In this case, an elevated pressure in the steam distribution network provides the trigger to open valves, and a reduced pressure allows the valves to close. When the flow rate from the solar field increases, the steam distribution pressure also increases. At a pre-determined distribution pressure setting, the wells with the highest "rank" switch from "night flow" to "peak flow" by a pressure-actuated switch. As the pressure continues to increase, the next set of wells with the next highest rank switch from "night flow" to "peak flow" in the same manner. This continues until all wells are at peak flow, e.g., during peak solar output. The pressure-actuated switch can be at the same location in the distribution network as are the chokes for a conventional steam distribution network, e.g., either at the wellhead or at a steam line "manifold". Instead of a computer-based controller, the pressure settings on the valves control the steam access into the wells. Accordingly, the design of the valve opening pressure can be based on a steam network model, using nodal analysis flow software, or trial and error by a skilled operator.

An advantage of using pressure-operated switches to control steam into each well is that it is relatively simple to implement. Conversely, an advantage of a computer-controlled valve arrangement is that it is more flexible. For example, the opening pressures for each well valve can be easily adjusted by changing a program setting (as opposed to a mechanical setting), which can reduce the effort and expense required to accommodate changes in the oilfield and/or the well over time.

In either of the above cases, the valves operate in an automated manner, whether responding directly to upstream pressure, indirectly to the output of a pressure sensor, or indirectly in response to a command from a controller. In any of these cases an operator need not manually adjust the valve.

In particular embodiments, the system can include transient threshold levels that are not to be exceeded. For example, rapid increases in steam flow after a shutdown may cause slugs of water to be launched down the pipelines. Transients in pressure may lead to thermal stresses. In particular embodiments, the system is configured to operate in a stable manner, e.g., by avoiding instabilities such as pressure oscillations and positive feedback from opening and closing valves. One approach is to introduce hysteresis into the valve opening and closing processes so the valves remain stable and do not "chatter" at the on-off threshold.

These wells can also be fitted with flow chokes that may operate at a "critical" or "sub critical" flow rate, to properly distribute the steam. Switching from "min flow" to "peak flow" may be implemented switching from choke size 1 to choke size 2 (e.g., by changing a setting of a 2-setting choke device).

b. Cyclic Steam Injection

Cyclic steam injection (also known variously as Cyclic Steam Stimulation (CSS) or "Huff 'n Puff") is a thermal EOR process in which the following multi-step procedure is repeatedly carried out:

- a chosen mass of steam is injected into the formation
- steam injection is completed and the well is shut-in (closed) for a "soak" period
- the well is put on production for a period of time The mass of steam injected, the "soak" period, and the production period all may vary significantly based on the characteristics of the formation, the characteristics of the oil, and/or the economics of producing steam. Generally, oil production rates are significantly increased for a period of time immediately following the steam injection, and decay to a lower production rate over the course of time. At some point, it is economically beneficial to cease oil production, put the well back on steam injection, and repeat the cycle.

It is conventional practice to deliver a relatively constant amount of steam on a continuous basis during the injection phase. Multiple wells are served by a common steam generation facility, and typically only a subset of the total number of wells will receive steam at any given time. Existing practice thus involves the temporal dispersion, or temporal non-alignment, of steam injection across the plurality of wells at a given oilfield. Such operational methods thus reduce the required peak steam production capability of the steam generation facilities, and thus the cost of construction, because fewer than all the wells receive steam at any point in time.

Solar energy varies both diurnally—with maximum radiation generally available at noon and no energy available between sunset and dawn—and seasonally, with maximum average radiation available at some times of year (e.g. summer) and lower amounts of energy available at other times of year (e.g. winter).

Early in the life of an EOR project, when formation temperatures are low and injectivity is relatively low, the time required to deliver the required mass of steam may be longer for cyclic injection than for continuous-injection. Later in a project's life, however, when injectivity has risen, the time required to deliver the required mass of steam may be the same as, or shorter than, the standard continuous-flow injection case. Each well can be equipped with a control valve and a flow meter which controls and measures injected steam. A control system in accordance with the present technology can manage the schedule of steam injection, keeping a well on daily injection until the required steam volume has been delivered.

With regard to diurnal steam production variation, the peak rate of steam injected in any given well during the day may be limited by such considerations as erosional velocity limitations in the in-well tubing, and/or velocity limits in the steam distribution network. A varying number of wells may be actively injected at different times of the day—with some wells shut-in at night or during lower radiation periods and more wells in operation during relatively higher radiation periods—to spread out and absorb peak energy flows.

With regard to seasonal steam production variation, scheduling the injection cycles (e.g., deciding to terminate oil production and begin steam injection) can be carried out based on forecast availability of solar radiation and solar steam. This method of optimizing an oilfield's operation can be carried out either by human operators and engineers or by a control system that implements an optimization strategy.

One aspect of the present technology includes reducing or eliminating the existing practice of temporal decorrelation or dispersion of injection cycles. Instead, some number of cycles may be brought together so as to make use of the expanded availability of solar steam at certain times of year—effectively scheduling an increased daily steam demand which is at least partially aligned with an increased daily availability of solar steam. Put another way, a conventional cyclic steam stimulation process for 40 wells may include injecting wells 1-20 during the first half of the year, and wells 21-40 during the second half of the year. By contrast, aspects of the present technology can include scheduling wells 1-30 during the summer months, and wells 31-40 during the winter months. Such alignment of well injection schedules may be in multiple groups, as the periods of peak availability of solar steam may be longer than a single injection cycle, and there may be multiple local "peak" periods in solar steam availability in a typical year. One implementation of this method is to calculate an economic optimum production strategy, which balances the seasonal availability of solar energy, the present-value impact of variable rate oil production, the relative cost of solar steam and fuel-fired steam, and generates a field operating plan which optimizes the cost and production value benefits (e.g., using the optimization technique described previously).

The same or similar techniques (scheduling steam injection to be temporally aligned with the availability of solar steam) can also apply to steam injection in steamflood, and other continuous steam injection processes. In such continuous steam injection processes, it is desirable to periodically inject some steam into each producer well. The producer well is taken off production and connected to the steam distribution network and a given mass of steam is injected. Steam injection in producer wells in this case is typically targeted to "clean-up" the formation in the region of the well, heating, displacing, and otherwise mitigating the effects of accumulated material which reduce permeability and production. Existing practice in steamflood operations is, as for the CSS case above, to temporally decorrelate producer well steam injection. The present teaching of systems and methods for optimizing steam injection operations in the presence of diurnal and seasonal variations in steam availability also applies to "clean-up" injection of producers in steamflood, CSS, and other continuous injection operations.

Figure 19A:
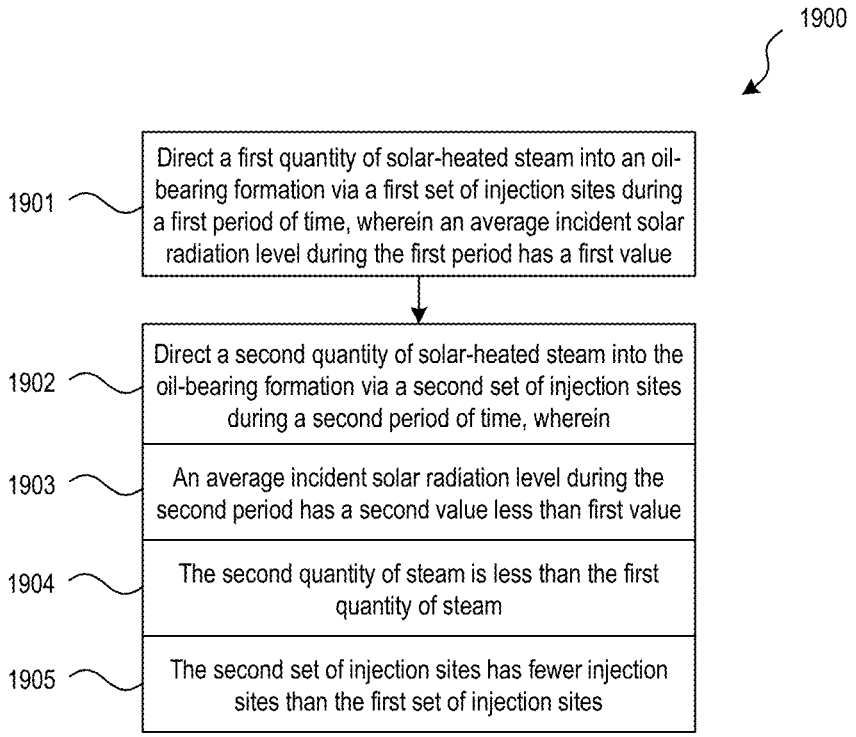
FIG. 19A is a flow diagram illustrating a process for injecting steam to different sets of wells at different periods of time, in accordance with representative embodiments of the present technology.

FIG. 19A is a flow diagram illustrating a process 1900 for injecting steam to different sets of wells at different times, in accordance with embodiments of the present technology described above. Process portion 1901 includes directing a first quantity of solar heated steam into an oil-bearing formation via a first set of injection sites during a first period of time. During this time, an average incident solar radiation level has a first value. For example, if the first period of time is generally during the summer months, the first value is relatively high.

Process portion 1902 includes directing a second quantity of solar-heated steam into the oil-bearing formation via a second set of injection sites during a second period of time. The average incident solar radiation level during the second period has second value less than the first value (block 1903). For example, if the second period is primarily during the winter months, the incident solar radiation level is lower than during the first period. The second quantity of steam is less than the first quantity of steam (block 1904) and the second set of injection sites has fewer injection sites and the first set of injections sites (block 1905). For example, in the embodiment described above, the second set of injection sites includes ten sites, while the first set of injection sites includes thirty sites. In one aspect of this embodiment, there is no overlap between injections wells of the first set and injection wells of the second set. In other embodiments, at least some wells can be part of both sets.

c. Greater Steam Flow Variation for Injection Wells Waving Wider Ranges of Steam Flow Capacities.

Figure 19B:
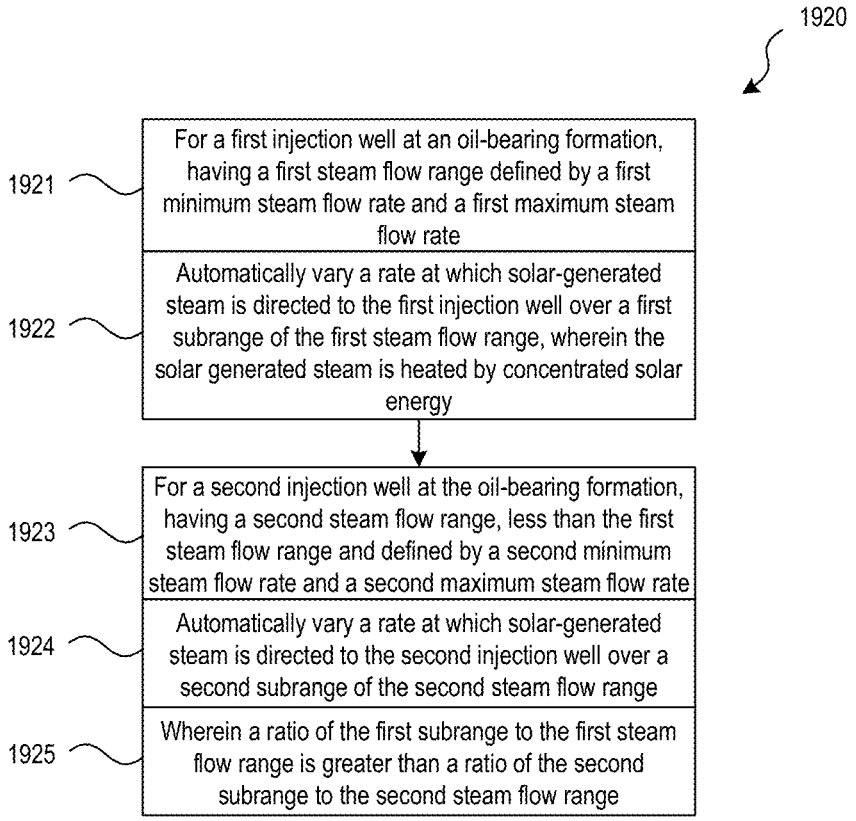
FIG. 19B is a flow diagram illustrating a process for injecting steam to different wells over different ranges of the wells' injection capabilities, in accordance with embodiments of the present technology.

One outcome associated with the methodology described above for increasing the solar fraction is that steam injection wells having a large capacity for steam deliver steam with more variability than wells that have a smaller capacity for steam. FIG. 19B illustrates a process 1920 in accordance with this embodiment. A first injection well at an oil-bearing formation has a first steam flow range defined by a first minimum steam flow rate and a first maximum steam flow rate (block 1921). The process includes automatically varying a rate at which solar generated steam is directed to the first injection well over a first subrange of the first steam flow range (block 1922). The first minimum steam flow rate can be zero, or can correspond to the minimum rate at which steam is delivered to the well at night, e.g., to prevent the well from significantly cooling during the night. The maximum steam flow rate, as discussed above, can correspond to the maximum rate at which the well can accept steam, with all upstream valves open, subject to limitations including formation restriction and safety restrictions.

A second injection well at the oil-bearing formation has a second steam flow range less than the first steam flow range and defined by second minimum steam flow rate and a second maximum steam flow rate (block 1923). The process includes automatically varying a rate at which the solar-generated steam is directed to the second injection well over a second subrange of the second steam flow range (block 1924). The first subrange can be greater than the second subrange, and in particular embodiments, the ratio of the first subrange to the first steam flow range is greater than the ratio of the second subrange of to the second steam flow range (block 1925). Put another way, the variability of the steam flow for a well having a broad range of steam flow capacities is greater than the variability of the steam flow for a well having a narrower range of steam flow capacities. FIGS. 11 and 12 illustrate a representative embodiment. The Type B well shown in FIG. 12 has a steam flow range of 520 (600-80) and an identical subrange. The Type A well shown in FIG. 11 has steam flow range of 110 (160-50) and a subrange of 20 (160-140). The ratio of subrange to steam flow range for the high capacity Type B well is 1.0, and for the low capacity A well is $^{20}/_{110}$ or 0.18.

d. Greater Variability Among Wells at Night than During the Day

Another potential result from the optimization process described above is that the well-to-well variability among wells at an oil-bearing formation can be greater at night than during the day. This is because, unlike conventional arrangements, a well can be operated at its maximum flow rates during the day, regardless of the target demand for that well while at night. Accordingly, a well that does not receive enough steam during the day will receive significantly more than the minimum nightly flow.

Figure 19C:
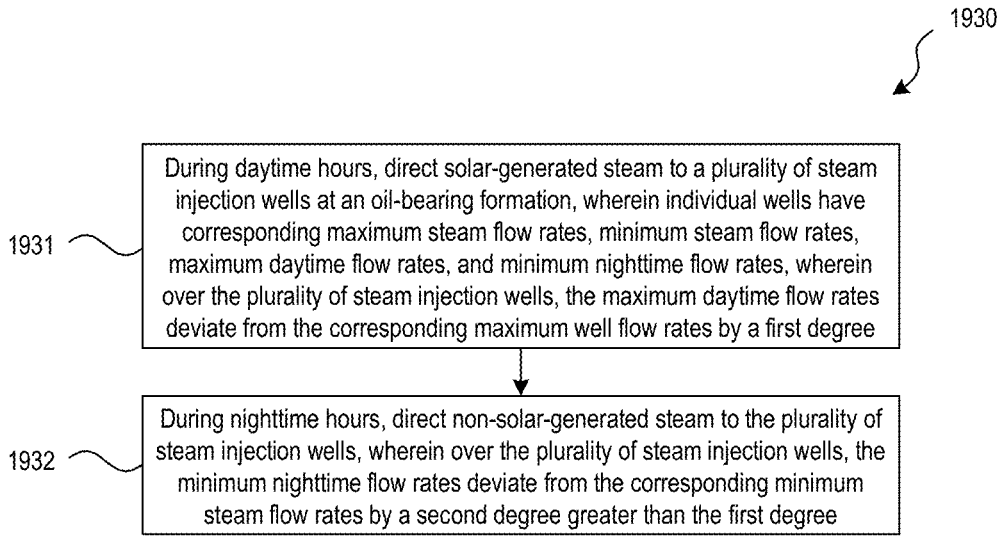
FIG. 19C is a flow diagram illustrating a process for distributing steam with a greater variability among wells at night compared to during the day, in accordance with representative embodiments of the present technology.

FIG. 19C illustrates a process 1930 in accordance with such an embodiment. At block 1931, during daytime hours, solar-generated steam is directed to a plurality of steam injection wells at an oil-bearing formation. Individual wells have corresponding maximum steam flow rates, minimum steam flow rates (as described above), maximum daytime flow rates, and minimum nighttime flow rates. The maximum daytime flow rate corresponds to the rate at which steam is actually delivered to the well during a particular day, and the maximum nighttime flow rate corresponds to the rate at which steam is actually delivered to the well during the night. Over the plurality of steam injection wells, the maximum daytime flow rates deviate from the corresponding maximum well flow rates by a first degree. Because, in accordance with a particular embodiment, the wells will typically operate at their maximum capacities, the deviation (e.g. the first degree of deviation) can be zero or a relatively small number.

At block 1932, during nighttime hours, non-solar generated steam is directed to the plurality of steam injection wells. Over the plurality of steam injection wells, the minimum nighttime flow rates deviate from the corresponding minimum steam flow rates by a second degree greater than the first degree. For example, while a number of wells may receive only the minimum steam flow rate (e.g., the amount required to keep the well from cooling significantly) other wells, including the Type A wells as described above, will receive a significantly greater amount of steam at night in order to meet their daily steam quota.

7. WELL DESIGN FOR VARIABLE RATE STEAM INJECTION

The following sections describe wells that include features particularly configured to support variable rate injection.

a. Parallel Downhole Valves

In at least some embodiments, an injection well designed for variable rate injection can have different characteristics than a well designed for continuous steam injection. For example, a steam injection well 2020 as shown in FIG. 20 typically includes a steam flow control device 2001 (e.g., a valve) at the wellhead. This is typically a motor-operated valve or a valve that includes other devices for automatically adjusting and controlling the rate of steam flowing from the steam delivery network into an individual well.

The steam injection well 2020 typically has tubing 2019 carrying the steam, within a well casing 2008 which is cemented to the formation. As steam injection begins, the tubing 2019 and the well 2020 are heated by the steam. Accordingly, the well 2020 can include devices that allow the tubing 2019 to slide within the wellhead, so as to accommodate thermal expansion and contraction of the tubing material associated with the temperature changes of no-steam-flow and steam flow. As the well 2020 heats and cools, stresses and strains in the casing and cementing may occur. As steam injection proceeds, steam flows from the surface steam distribution network into the formation. Accordingly, the surface steam distribution network pressure must be higher than formation pressure by enough of a margin to enable the desired rate of flow.

Variable rate steam injection in accordance with embodiments of the present technology can include "shutting in" a steam injection well 2020 at night. Such a shut-in process can cause the injector tubing 2019 and well casing 2008 to cool, which in turn can cause stresses and strains related to thermal contraction of the materials. Without positive flow in the tubing 2019, pressurized acid gases from the formation may enter and flow upwards in the tubing 2019. As a result, leaks in the valve 2001 or other wellhead facilities may expose operators at the surface to hazardous inhalants. Accordingly, it can be beneficial to continue positive steam injection at all times, but at a significantly reduced flow rate. For example, one representative embodiment includes reducing the flow rate within the well by 90% or more at night versus the daytime flow rate. This value corresponds to the minimum flow rate, discussed above.

During daytime injection, an equilibrium pressure and temperature profile are established within the injection well 2020. The pressure drop through the tubing 2019 for a given flow rate, plus formation pressure, determine the temperature and pressure within the tubing. When the wellhead valve 2001 is partially closed to select a lower flow rate (e.g., at night), the flow-related pressure drop is reduced. At very low flow rates, the tubing pressure is close to the formation pressure. The tubing temperature will approximate the saturation temperature of the steam within the tubing; therefore the pressure change will result in a temperature change. The pressure drop across wellhead valve 2001 may be quite large, potentially shortening the life of the valve and/or increasing its required maintenance.

One approach to addressing this potential issue, in accordance with an embodiment of the present technology, is to add downhole steam flow control devices that act to mitigate the effect of variable rate steam injection on the well casing 2008, the tubing 2019, and the wellhead valve 2001 by reducing the daily pressure and temperature swings within the injector tubing 2019 associated with variable rate steam injection, as described further below.

The overnight steam flow rate, or the lowest steam injection rate desired on a daily basis, is typically chosen when the well is designed. A low-flow control device 2002 (e.g., a valve) is positioned at the downhole steam injection point, and is designed to accommodate this minimum flow rate. The low-flow control device 2002 is generally selected to have a maximum flow rate less than that of the wellhead valve 2001. In at least one embodiment the low-flow device 2002 is passive, requiring no actuation or control from the surface, thus reducing its cost. In at least one embodiment the low-flow device 2002 exhibits a nonlinear resistance to flow at a critical flow velocity. For example, the nonlinear resistance to flow can be accomplished by selecting a geometry such as a "fixed choke" which exhibits a supersonic velocity transition at the critical flow. One element of the desired behavior of the low-flow device 2002 is a relatively large pressure drop (e.g., 50%) across the device to achieve critical flow through the device. In the case for which the well has multiple zones or multiple steam injection points (e.g., vertically displaced from each other), a plurality of such low-flow devices 2002 can be positioned with one or more located within each zone. With multiple, individual low-flow devices 2002 sized to produce choked flow at the target minimum flow rate, valves across the steam injection network can deliver uniform amounts of steam at minimum flow conditions. The low-flow device 2002 can include a slick-line retrievable valve to facilitate routine maintenance. In particular embodiments, the low-flow device 2002 can include a check valve to further reduce the likelihood for toxic gases to flow upwards in the injection tubing during periods of non-steam-injection.

Figure 20:
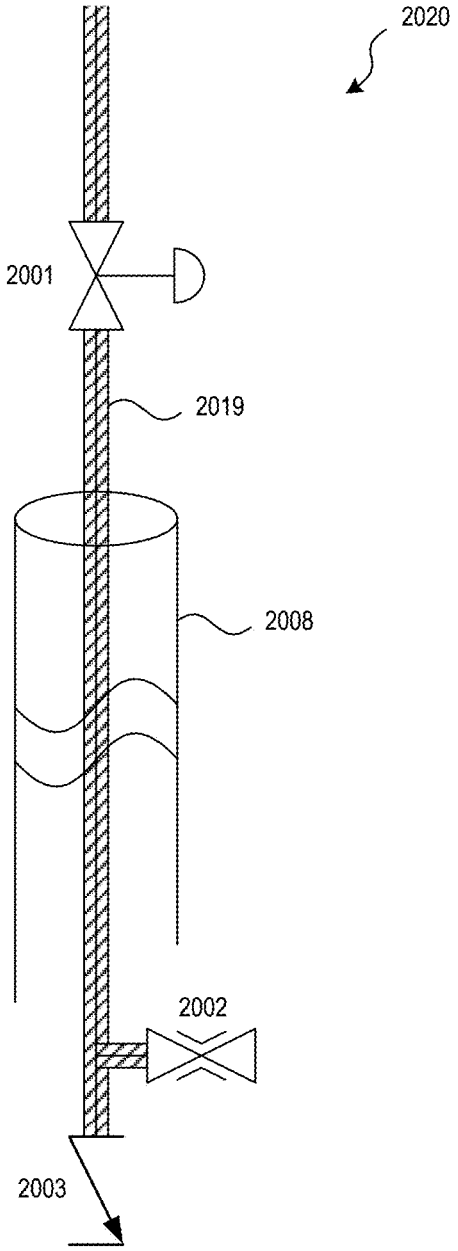
FIG. 20 illustrates a well having multiple downhole valves arranged in parallel in accordance with an embodiment of the present technology.

The arrangement in FIG. 20 can also include a high-flow control device 2003 (e.g., a valve), designed to provide low resistance to high flow rates. The high-flow device 2003 generally has a maximum flow capacity less than that of the wellhead valve 2001, and greater than that of the low-flow device 2002. The high-flow device 2003, in one embodiment, is passive, requiring no actuation or control from the surface, thus reducing its cost. In one embodiment, the high-flow device opens when the pressure within the tubing exceeds the formation pressure by a chosen amount. In a particular embodiment, the high-flow device 2003 opening pressure is selected to be above the pressure at which the low-flow device 2002 achieves critical flow. The high-flow device 2003 can prevent reverse flow, e.g., by closing completely when the pressure within the tubing 2019 is not sufficiently elevated above the pressure within the formation. For example, the high-flow device 2003 can be or include a check valve. The check valve can have a passive element, such as a spring, that both prevents reverse flow and delays opening the high-flow valve 2003 when the steam input pressure is below the low-flow valve critical pressure. Accordingly, the low-flow device 2002 and the high-flow valve 2003 operate in parallel, with the high-flow device 2003 opening only when the supply pressure is high enough.

The effect of this combination of flow control devices positioned at the steam injection point(s) is to raise the pressure within the injector tubing 2019 at times of low flow, and to establish a defined "low flow rate" for overnight steam injection. Higher pressure within the tubing 2019 at night, arising from the pressure drop across the low-flow device 2002, results in reduced pressure and temperature swings between full-rate injection and minimum-rate injection. The high-flow device 2003 provides minimal restriction at times of higher steam flow, allowing wellhead control valve 2001 to manage the steam flow injection rate. Furthermore, the high-flow device 2003 can open at pressures well above the choking pressure of the low-flow device 2002. Accordingly, all the low-flow valves 2002 in the distribution system can remain choked throughout the night to produce a consistent flow into the formation.

The low-flow device 2002 allows the steam distribution network to be operated in different manners on a 24-hour basis. During overnight low-flow periods, all the wellhead valves 2001 may be significantly or completely open, with the steam distribution headers operating at lower pressures, so that per-well flow management is entirely determined by the characteristics of the low-flow devices 2002, without large pressure drops across the wellhead valves 2001 and the resulting maintenance requirements. In another embodiment, the pressure in the steam distribution network can be maintained at a more relatively constant value, and the wellhead valves 2001 can be actuated so as to operate in combination with the low-flow valve 2002 to control overnight steam injection at lower rates. For example, by partially closing the wellhead valve 2001, the downhole pressure in the well decreases, causing the high-flow device 2003 to close so that the steam flow into the formation is controlled by only the low-flow device 2002.

b. Wells with Heat Transfer Characteristics Configured for Nighttime Reliability As discussed above, one result of delivering steam at high flow rates during the day and low flow rates at night is that the well may cool during the night, which increases thermal stresses on the well, among other effects. As was also discussed above, one approach to addressing this issue is to provide enough steam flow to the well at night that cooling is reduced or eliminated, even if the steam provided to achieve this effect does not significantly heat the oil-bearing formation. In other embodiments, it may be desirable to completely eliminate the flow of steam to the well at night e.g., to shut in the well and allow the entire amount of steam injected into the oil-bearing formation to be solar-generated steam.

Figure 21:
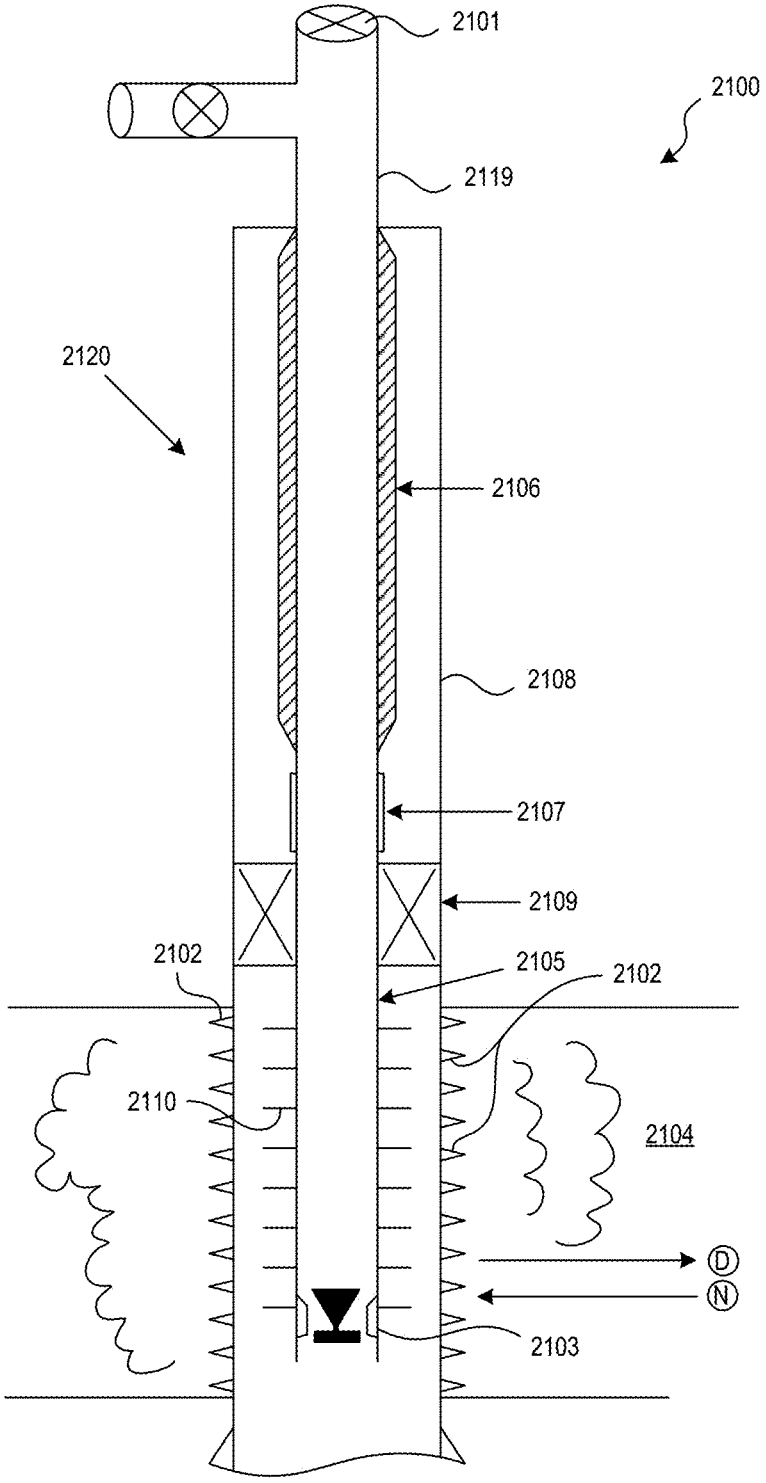
FIG. 21 schematically illustrates an injection well having different heat transfer characteristics over different tubing segments in accordance with an embodiment of the present technology.

FIG. 21 schematically illustrates an arrangement 2100 having an injection well 2120 with a downhole shut-in device (as discussed above) that allows no back flow when the well is shut in. In the case of 100% solar fraction, this can include a simple on-off check valve 2103. The injection well 2120 can also be configured to reduce or eliminate the need for nighttime heating, while still reducing or preventing nighttime condensation of the injected steam. This can keep the temperature inside the wellbore high enough to prevent thermal and pressure cycling of the tubing on a daily basis.

In one aspect of this embodiment, the well 2120 includes downhole tubing 2119. Different sections of the tubing 2119 have different heat transfer characteristics, e.g., different heat transfer coefficients. The tubing can extend downward into the well, past a packer 2109, and through part or all of a heated reservoir section 2104 where steam is injected. A lower section of the tubing 2105 is designed to have a high heat transfer coefficient, and can optionally include fins, vanes and/or other heat transfer enhancing features 2110 to improve heat transfer. An upper section of the tubing 2106 above the packer 2109 is designed to be insulated (and/or otherwise have a low heat transfer coefficient) and to accommodate thermal expansion, e.g. via an expansion joint 2107. A casing 2108 of the well includes perforations 2102 that allow steam and heat to transfer outwardly to heat the formation during the day (arrow D) and inwardly to heat condensate at night (arrow N). The perforations 2102 can be sized to choke the steam flow and can accordingly operate as a low-flow valve in the manner described above with reference to FIG. 20.

A well having the above design features can be operated as follows. Initially, some period of continuous injection can be employed to heat up the reservoir section 2104. During such early operations, a relatively lower solar fraction is typically achieved. For example, during this (relatively short) period, the system may operate at less than 100% solar fraction (e.g., the system may use heat from both solar sources and non-solar sources to produce steam), until the reservoir section 2104 near the injector well is heated to a certain minimum temperature. Once the well 2120 is operating in "100% solar mode", and some volume of steam has been injected to heat up the reservoir 2104, steam injection passes normally into the well 2120, down through the tubing sections 2106, 2105 and into the reservoir section 2104 during the day.

At night, the well is shut in as follows. A surface wellhead valve 2101 is closed. The one-way check valve 2103 at the steam injection location closes when the downward steam flow stops. This valve can include a slickline-retrievable valve that can be operated, serviced and replaced via a slickline, e.g., without removing the tubing. The steam in the tubing 2119 starts to cool and the pressure drops. At least some steam condenses into condensate water (despite the lower thermal conductivity of the upper section 2106), and falls down the tubing 2119 and into the lower section 2105 between the packer and check valve 2103. Because the reservoir 2104 remains at about the same temperature both during daytime injection and at night, heat from the reservoir 2104 transfers to the (cooling) outer wall of the tubing 2105 at night. Due to the presence of steam in the annulus between the tubing 2105 and casing 2108, the condensate in the section of tubing between the packer and check valve boils. The resulting steam keeps the temperature and pressure of the tubing 2119 at close to the reservoir temperature. Accordingly, the system mitigates thermal cycling of all components from the wellhead valve down. The stable temperature and elimination of backflow allows daily on-off steam flow, which enables use of 100% solar steam.

Figure 22:
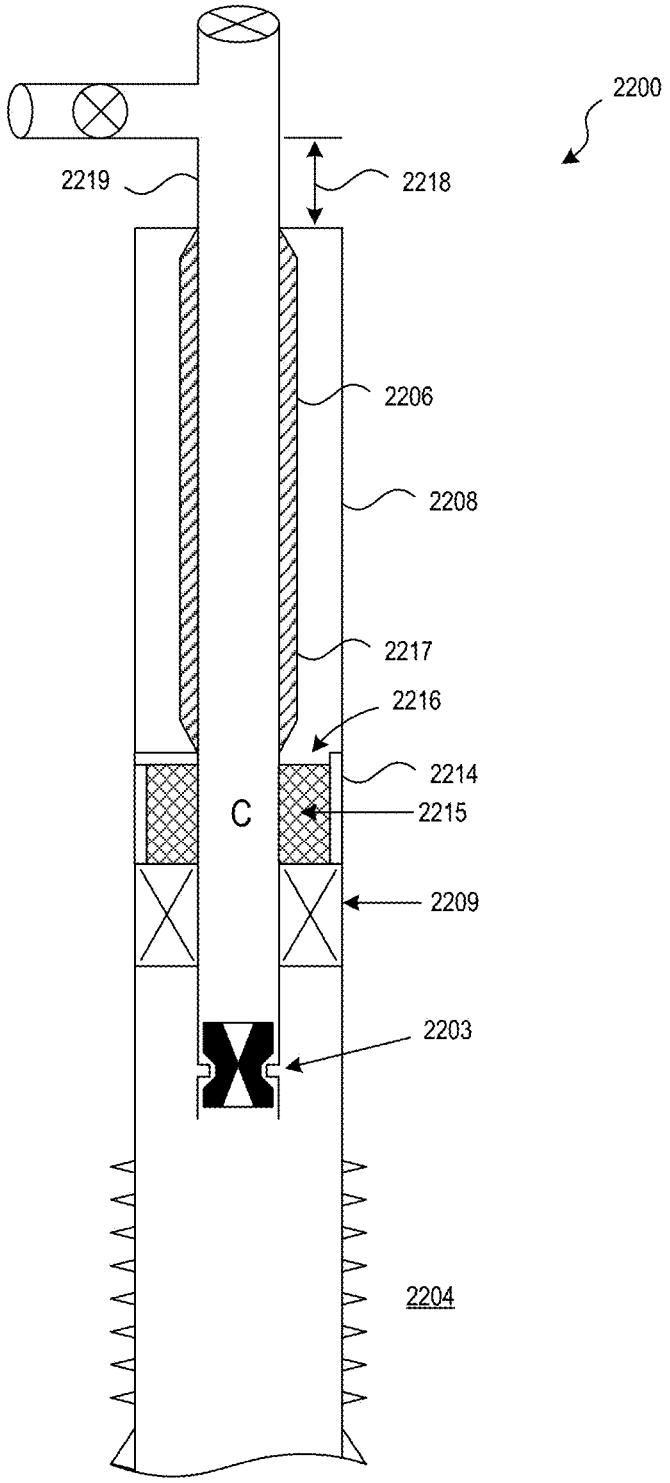
FIG. 22 schematically illustrates an injection well having a phase-change material to deliver and receive heat in a variable manner, in accordance with an embodiment of the present technology.

A system in accordance with another embodiment of the present technology, shown in FIG. 22, includes a phase change material 2215 located in the annulus between the well tubing and outer casing in addition to a combination of tubing sections having different heat transfer coefficients. As shown in FIG. 22, a well 2220 in accordance with an embodiment of the present technology includes a casing 2208 positioned against the underground formation, and well tubing 2219 extending within the casing 2208. The well tubing 2219 can include an above-ground shrinkage allowance 2218 to accommodate thermally-induced changes in the length of the well tubing 2219. An upper section 2206 of the well tubing 2219 can also include a vacuum-based, or other insulation 2217, to reduce heat transfer losses from an upper section 2206 of the well tubing 2219. A one-way check valve 2203 above the steam injection zone or reservoir 2204 allows steam to be injected from the well tubing 2219 into the steam injection zone 2204 during an injection period, and closes to prevent gases and steam from rising up from through the well tubing 2219 after an injection period has been completed.

In a particular aspect of this embodiment, the phase change material 2215 is positioned in an annulus 2216 between the well tubing 2219 and the casing 2208 located above a packer 2209. The phase change material 2215 can be positioned within an annular-shaped section of insulation 2214 to reduce or prevent heat transfer to the surrounding formation. During steam injection, the heat of the steam melts the phase change material 2215. When steam injection is stopped, the steam within the well tubing 2219 condenses to form a condensate C. The amount of condensate C is reduced as a result of the insulation 2217, but some condensate is expected nonetheless. When the pressure drops, (e.g., as a result of condensation) the temperature drops. The heat from the phase-change material 2215 re-boils the condensate C and maintains steam vapor pressure in the well at the melting point of the phase-change. In this way, a small amount of phase change material 2215 can prevent the well 2220 from cooling (or from cooling significantly) and can maintain (or approximately maintain) the well pressure.

The phase change material 2215 can include a eutectic mixture selected to have a solid/liquid phase boundary between the saturated steam temperature at the injection pressure (for example 310 C at 100 Bar) and the shut-in temperature and pressure (280 C at 68 Bar). The volume of the phase change material 2215 (a function of the diameter of the annulus and the height of the phase change material 2215 in the annulus) can be selected to provide enough heat transfer to last through expected "shut-in" periods. The phase change material 2215 is in close thermal communication with the well tubing 2219 but is generally insulated from the casing 2208, e.g., with a section of insulation 2214. The insulation 2214 around the phase change material 2215 can be in the form of a thin outer tubing with a "bellows" configuration to accommodate the volume change of the phase change material 2215 between solid and liquid phase.

A benefit of using a phase change material as the heat transfer medium (as compared to heat transfer media that do not undergo a phase change at the design temperature) is that such materials can transfer a significant amount of heat (both received and transmitted) at approximately the same temperature. This in turn reduces or eliminates the need to actively control the temperature at which heat is transferred from the phase change material to the well tubing and vice versa.

Yet another embodiment of the present technology includes purging the system with nitrogen as part of the shut-in process, e.g., to prevent condensation of water, and back flow of gasses from the wells into the surface network.

In still another embodiment, using 100% solar steam, the steam distribution pressure is bled off each day to prevent condensation of water. The entire system above the well "one way check valve" can undergo daily thermal cycling from steam temperature/pressure to ambient.

In a representative approach, the following steps are taken:

The wellhead steam valve is closed.

Steam from the distribution network is flowed back to the hot water storage in the solar field, to recover the energy in the steam lines. The steam below ground is trapped when the well head valve is closed, and is kept hot by the surrounding (heated) formation.

A suitable method is used to verify that the one way check valve is sealing correctly. This method can include monitoring pressure/temperature in the well at the wellhead as a function of time. Each day, the decline curve should be similar if the valve is sealing. If the valve leaks, the pressure will reach reservoir pressure then stop declining. At this time the check valve is serviced/replaced.

The system can be configured to prevent the following conditions when it is started up:

Dry steam starts flowing but contacts the cool pipe, and forms condensate.

This condensate forms pools in low spots in the pipe network

The pools of water could be "launched" by high velocity steam to form water hammer effects.

Accordingly, flow rates are managed to heat the steam system and raise flow rates at a pre-determined rate (e.g., the steam flow rate is gradually increased) so as to avoid such water hammer damage.

The system may allow for the use of low pressure superheated steam during start up to evaporate water and prevent the slugging of water.

c. Wells for Both Injection and Production

Figure 23:
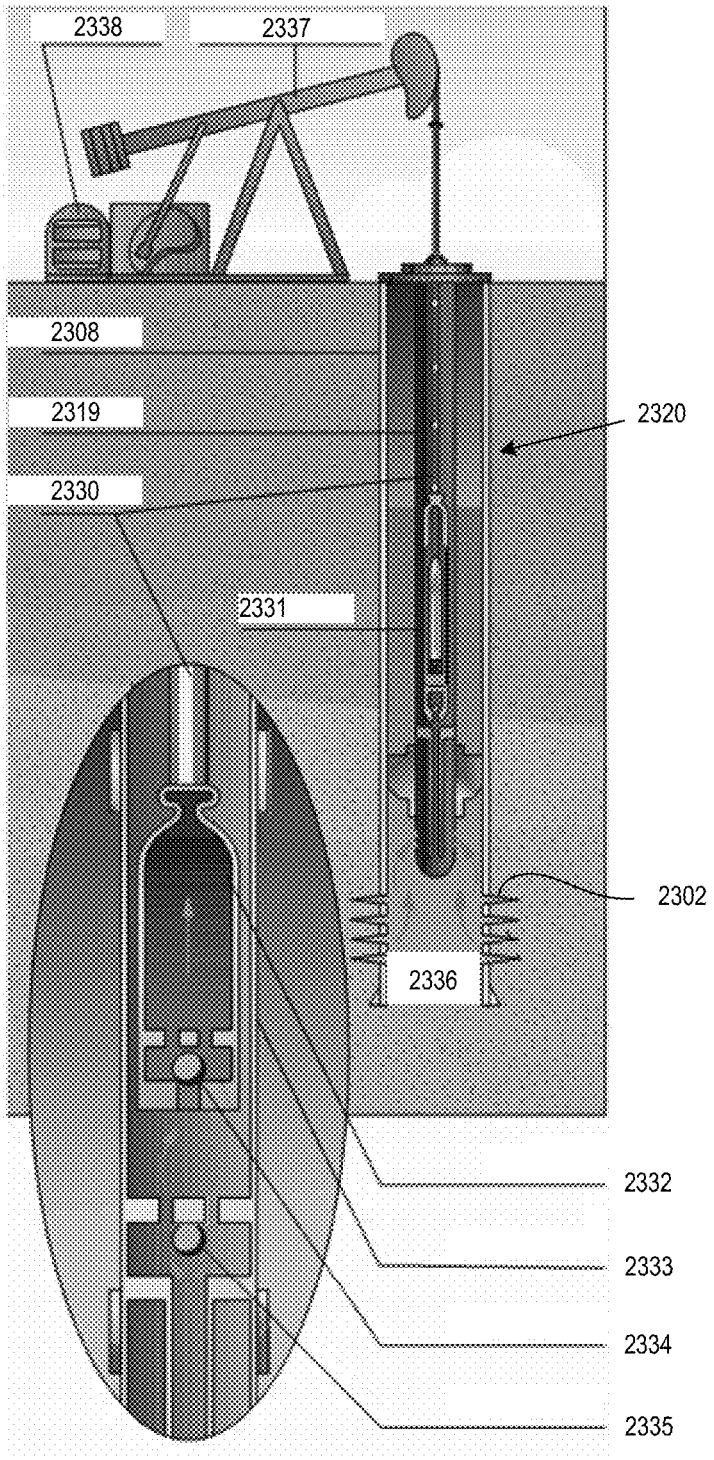
FIG. 23 illustrates a production well with a downhole pump.
Figure 24:
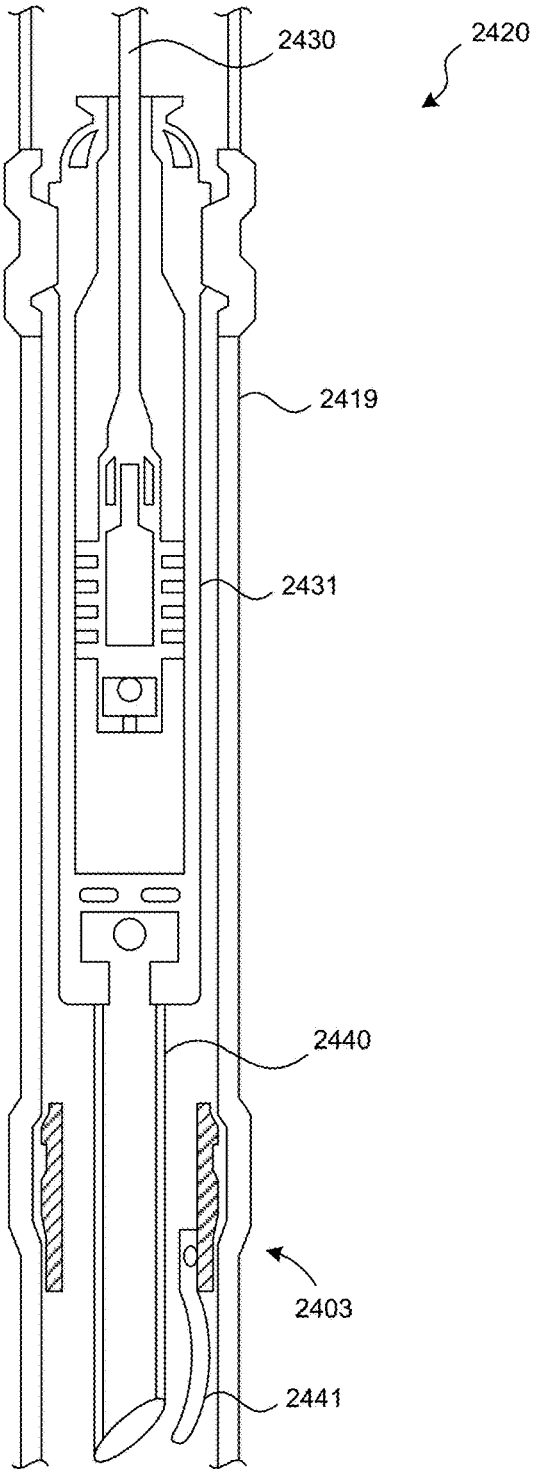
FIG. 24 illustrates a well with a downhole pump and configured to operate as both an injection well and a production well, in accordance with embodiments of the present technology.

In particular embodiments, cyclic steam injection can be performed using a single well for both steam injection and oil extraction. FIG. 23 illustrates a representative production well (which includes a pump), and FIG. 24 illustrates an arrangement in which a pump from a production well can be incorporated into a steam injection well. Beginning with FIG. 23, a representative well 2320 includes a well casing 2308, a well tubing 2319 disposed within the casing 2308, and one or more sucker rods 2330 that support a pump 2331 within the tubing 2319. The pump 2331 can include a plunger 2332, a barrel 2333, a traveling valve 2334, and a standing valve 2335 that operate in accordance with conventional techniques to withdraw oil 2336 through perforations 2302 in the casing 2308, and upwardly to the surface. The pump 2331 can be driven by a beam pumping unit 2337, which is in turn powered by a power source 2338.

FIG. 24 illustrates a well 2420 configured to both inject steam and withdraw oil. The well includes well tubing 2419 in which a pump 2431 (e.g., configured generally similar to the pump 2331 described above with reference to FIG. 23) is positioned above a check valve 2403. The check valve 2403 can operate generally in the manner described above to allow steam to flow outwardly into the adjacent oil-bearing formation, and to block the flow of gases upwardly into the well tubing 2419 when the well is not actively injecting steam. The pump 2431 can include an extension 2440 having an entry opening and that extends downwardly so as to pass through a flapper or other valve element 2441 of the check valve 2403. Accordingly, when the well 2420 is used for oil production, the pump 2431 is lowered using the corresponding sucker rod 2430 so that the projection 2440 opens the valve element 2441, allowing the pump 2431 to access the oil below. When the well 2420 is used for steam injection, the pump 2431 is raised so that the valve mechanism 2441 is not impeded and the check valve 2403 can operate to allow steam to pass downwardly, while preventing potentially toxic gases from passing upwardly.

8. FURTHER EMBODIMENTS

From the foregoing, it will be appreciated that specific embodiments of the present technology have been described herein for purposes of illustration, but that various modifications may be made without deviating from the technology. For example, while several embodiments are described in the context of solar energy (which is by its nature variable), similar techniques can be applied to other forms of energy as well. In a particular example, some types of energy may be cheaper and/or more efficient at night than during the day, in which case the foregoing techniques can be used to provide significantly higher levels of steam during the night rather than during the day. Representative examples include coal burning energy, which may be readily available or cheaper at night, and/or gas-fired co-generator energy, which in desert environments, is more efficiently produced at night (when turbine inlet temperatures are lower), than during the day.

The techniques described above can be applied to oil fields that have arrangements of injector wells and producer wells different than those described above, e.g., in the context if FIGS. 5A and 5B. In particular embodiments, the solar field includes concentrators and receivers that are housed in a protective (e.g., glass) enclosure, and in other embodiments, techniques and systems generally similar to those described above can be used with solar fields that do not include such enclosures.

Embodiments of the present technology that include a phase change material were discussed above in the context of the downhole portion of a steam injection well. A similar system of pipeline storage "re-boilers" can be used above-ground, e.g., in low-spots of and between steam headers. For example, the low section of pipe can include a section of the line with a phase change material "jacket" inside the insulation. Or in another embodiment, a vessel is positioned at the low spot(s) in the pipeline into which liquid (condensed steam) drains. The phase-change material re-boils the condensate, which is then re-introduced into the steam line.

Particular embodiments of the techniques described above include optimization processes, e.g., to allocate steam to different injection wells in accordance with different schedules. The optimization process can be determined on the basis of certain quantities that may be calculated automatically and/or determined on the basis of any of a variety of suitable measurements, estimates, assumptions, or combinations thereof. For example, the Steam Value parameter and associated Steam Oil Ratio (SOR) described above rely on values of steam flow and oil flow, which may be difficult to determine precisely for each injection well. Accordingly, these parameters may be estimated, manually entered, calculated from periodic (not necessarily real-time) measurements, in addition to or in lieu of being calculated automatically.

Certain aspects of the technology described in the context of particular embodiments may be combined or eliminated in other embodiments. For example, embodiments and features directed to increasing solar fraction may also be used to increase the uniformity of formation heating. Further, while advantages associated with certain embodiments of the disclosed technology have been described in the context of those embodiments, other embodiments may also exhibit such advantages, and not all embodiments need necessarily exhibit such advantages to fall within the scope of the present technology. Accordingly, the present disclosure and associated technology can encompass other embodiments not expressly shown or described herein.

To the extent any materials incorporated herein by reference conflict with the present disclosure, the present disclosure controls.

The invention claimed is:

1. A method for enhanced oil recovery, comprising:

directing solar-generated steam to an injection well at an oil-bearing formation, wherein the solar-generated steam is heated by concentrated solar energy;

receiving an indication of at least one of an actual change or an expected change in a flow rate of additional solar-generated steam available for delivery to the injection well; and based at least in part on the indication, automatically changing a setting of a flow control valve in a steam delivery line that directs the additional solar-generated steam to the injection well, wherein the injection well is one of a plurality of injection wells at the oil-bearing formation, each having a corresponding flow control valve, and wherein the method further comprises changing settings of individual flow control valves by different amounts.

2. The method of claim 1, further comprising scheduling setting changes for the flow control valves to at least approximately minimize, for individual wells, a ratio of an expected cost of steam injected into the individual well to an expected value of oil attributed to steam injection into the individual well.

3. The method of claim 1 wherein changing the setting includes at least partially closing the flow control valve.

4. The method of claim 3 wherein the indication corresponds to a reduction in the flow rate of the additional solar-generated steam.

5. The method of claim 3 wherein the indication corresponds to nighttime.

6. The method of claim 1 wherein changing the setting includes at least partially opening the flow control valve.

7. The method of claim 6 wherein the indication corresponds to an increase in the available flow rate of the solar-generated steam.

8. The method of claim 6 wherein the indication corresponds to daytime.

9. The method of claim 1 wherein the injection well has a maximum steam flow rate, and wherein changing the setting includes changing the setting to direct steam to the injection well at the maximum steam flow rate.

10. The method of claim 1 wherein the change is an actual change and includes a change in at least one of pressure and steam flow rate.

11. The method of claim 1 wherein the change is an expected change and includes an expected change in steam flow rate due to time of day.

12. The method of claim 1 wherein the change is an expected change and includes an expected change in incident solar radiation.

13. The method of claim 1 wherein receiving the indication and changing the setting are repeated on a daily basis.

14. The method of claim 1 wherein the indication is a first indication and corresponds to the expected change in the flow rate of additional solar-generated steam, and wherein the method further comprises:

receiving a second indication, after receiving the first indication, the second indication corresponding to an actual change in the flow rate of additional solar-generated steam; and based at least in part on the second indication, further automatically changing the setting of the flow control valve.

15. The method of claim 1, further comprising:

delivering to the injection well an amount of steam based on an expected amount of solar generated steam for a first time period;

after the first time period has elapsed, receiving an indication that the amount of steam is less than a target amount of steam for the injection well; and automatically allocating an increased amount of steam to the injection well for delivery to the injection well during a subsequent time period.

16. The method of claim 15 wherein the first time period corresponds to a first day, and the second time period corresponds to a second, subsequent day.

17. An enhanced oil recovery system, comprising:

a controller programmed with instructions that, when executed:

direct a steam-flow network to deliver solar-generated steam to an injection well at an oil-bearing formation, wherein the solar-generated steam is heated by concentrated solar energy;

receive an indication of at least one of an actual change or an expected change in a flow rate of additional solar-generated steam available for delivery to the injection well; and based at least in part on the indication, automatically change a setting of a flow control valve in a steam delivery line that directs the additional solar-generated steam to the injection well.

18. The system of claim 17, further comprising the flow control valve, and wherein the flow control valve includes an actuator operatively coupled to the controller.

19. The system of claim 18, further comprising:

a solar field having at least one receiver and at least one solar concentrator positioned to heat a working fluid in the receiver;

the injection well; and the steam-flow network, wherein the steam-flow network includes the steam delivery line, and wherein the steam delivery line is coupled between the solar field and the injection well.

20. The system of claim 17 wherein the injection well is one of a plurality of injection wells, and the flow control valve is one of a plurality of corresponding flow control valves, and wherein the instructions, when executed:

schedule setting changes for the flow control valves to at least approximately minimize, for individual wells, a ratio of an expected cost of steam injected into the individual well to an expected value of oil attributed to steam injection into the individual well.

21. The system of claim 17 wherein the change is an actual change and includes a change in at least one of pressure and steam flow rate.

22. The system of claim 17 wherein the change is an expected change and includes an expected change in steam flow rate due to time of day.

23. The system of claim 17 wherein the change is an expected change and includes an expected weather change.

24. The system of claim 17 wherein receiving the indication and changing the setting are repeated on a daily basis.

25. The system of claim 17 wherein the indication is a first indication and corresponds to the expected change in the flow rate of additional solar-generated steam, and wherein the instructions, when executed:

receive a second indication, after receiving the first indication, the second indication corresponding to an actual change in the low rate of additional solar-generated steam; and based at least in part on the second indication, further automatically change the setting of the flow control valve.

26. A method for enhanced oil recovery, comprising:

directing steam to a plurality of injection wells at an oil-bearing formation, wherein the plurality of injection wells are connected to a steam distribution network, and wherein the steam is heated by a combination of concentrated solar energy and non-solar energy;

receiving an indication of at least one of an actual change or an expected change in a flow rate of additional steam available for delivery to the plurality of injection wells; and based at least in part on the indication, automatically changing a setting of at least one flow control valve in the steam distribution network to change an apportionment of the additional steam over the plurality of injection wells.

27. The method of claim 26 wherein each of the plurality of injection wells has a corresponding flow control valve, and wherein the method further comprises changing settings of individual flow control valves by different amounts.

28. The method of claim 26 wherein changing the setting includes at least partially closing the at least one flow control valve.

29. The method of claim 26 wherein changing the setting includes at least partially opening the at least one flow control valve.

30. The method of claim 26 wherein the indication corresponds to nighttime.

31. The method of claim 26 wherein the indication corresponds to an increase in the available flow rate of the solar-generated steam.

32. The method of claim 26 wherein the injection well has a maximum steam flow rate, and wherein changing the setting includes changing the setting to direct steam to the injection well at the maximum steam flow rate.

33. An enhanced oil recovery system, comprising:

a solar field, including:

at least one receiver; and at least one solar concentrator positioned to heat a working fluid in the receiver;

an injection well at an oil-bearing formation;

a steam flow network, including a steam delivery line coupled between the solar field and the injection well; and a controller programmed with instructions that, when executed:

direct the steam-flow network to deliver solar-generated steam from the solar field to the injection well;

receive an indication of at least one of an actual change or an expected change in a flow rate of additional solar-generated steam available for delivery to the injection well; and based at least in part on the indication, automatically change a setting of a flow control valve in a steam delivery line that directs the additional solar-generated steam to the injection well.

34. The system of claim 33, further comprising the flow control valve, and wherein the flow control valve includes an actuator operatively coupled to the controller.

35. The system of claim 33 wherein the injection well is one of a plurality of injection wells, and the flow control valve is one of a plurality of corresponding flow control valves, and wherein the instructions, when executed:

schedule setting changes for the flow control valves to at least approximately minimize, for individual wells, a ratio of an expected cost of steam injected into the individual well to an expected value of oil attributed to steam injection into the individual well.

36. The system of claim 33 wherein the change is an actual change and includes a change in at least one of pressure and steam flow rate.

37. The system of claim 33 wherein the change is an expected change and includes an expected change in steam flow rate due to time of day.

38. The system of claim 33 wherein receiving the indication and changing the setting are repeated on a daily basis.

39. The system of claim 33 wherein the indication is a first indication and corresponds to the expected change in the flow rate of additional solar-generated steam, and wherein the instructions, when executed:

receive a second indication, after receiving the first indication, the second indication corresponding to an actual change in the low rate of additional solar-generated steam; and based at least in part on the second indication, further automatically change the setting of the flow control valve.

40. A method for enhanced oil recovery, comprising:

directing solar-generated steam to an injection well at an oil-bearing formation, wherein the solar-generated steam is heated by concentrated solar energy;

receiving an indication of at least one of an actual change or an expected change in a flow rate of additional solar-generated steam available for delivery to the injection well; and based at least in part on the indication, automatically changing a setting of a flow control valve in a steam delivery line that directs the additional solar-generated steam to the injection well, wherein the injection well is one of a plurality of injection wells at the oil-bearing formation, and wherein the steam delivery line supplies steam to only the one of the plurality of injection wells.

41. A method for enhanced oil recovery, comprising:

directing solar-generated steam to an injection well at an oil-bearing formation, wherein the solar-generated steam is heated by concentrated solar energy;

receiving an indication of at least one of an actual change or an expected change in a flow rate of additional solar-generated steam available for delivery to the injection well; and based at least in part on the indication, automatically changing a setting of a flow control valve in a steam delivery line that directs the additional solar-generated steam to the injection well, wherein:

the injection well is the first of two injection wells;

the flow control valve is the first of two flow control valves;

the first injection well has a first maximum steam flow capacity;

the second injection well has a second maximum steam flow capacity less than the first;

changing the setting includes changing the setting of the first flow control valve by a first amount, and the method further comprises changing a setting of the second flow control valve in a steam delivery line that directs the solar-generated steam to the second injection well by a second amount different than the first amount.

42. A method for enhanced oil recovery, comprising:

directing solar-generated steam to an injection well at an oil-bearing formation, wherein the solar-generated steam is heated by concentrated solar energy;

receiving an indication of at least one of an actual change or an expected change in a flow rate of additional solar-generated steam available for delivery to the injection well; and based at least in part on the indication, automatically changing a setting of a flow control valve in a steam delivery line that directs the additional solar-generated steam to the injection well, wherein the injection well has a maximum steam flow rate, and wherein changing the setting includes changing the setting to direct steam to the injection well at the maximum steam flow rate.

43. A method for enhanced oil recovery, comprising:

directing solar-generated steam to an injection well at an oil-bearing formation, wherein the solar-generated steam is heated by concentrated solar energy;

receiving an indication of at least one of an actual change or an expected change in a flow rate of additional solar-generated steam available for delivery to the injection well; and based at least in part on the indication, automatically changing a setting of a flow control valve in a steam delivery line that directs the additional solar-generated steam to the injection well, wherein the indication is a first indication and corresponds to the expected change in the flow rate of additional solar-generated steam, and the method further comprises:

receiving a second indication, after receiving the first indication, the second indication corresponding to an actual change in the flow rate of additional solar-generated steam; and based at least in part on the second indication, further automatically changing the setting of the flow control valve.

44. A method for enhanced oil recovery, comprising:

directing solar-generated steam to an injection well at an oil-bearing formation, wherein the solar-generated steam is heated by concentrated solar energy;

receiving an indication of at least one of an actual change or an expected change in a flow rate of additional solar-generated steam available for delivery to the injection well;

based at least in part on the indication, automatically changing a setting of a flow control valve in a steam delivery line that directs the additional solar-generated steam to the injection well;

delivering to the injection well an amount of steam based on an expected amount of solar generated steam for a first time period;

after the first time period has elapsed, receiving an indication that the amount of steam is less than a target amount of steam for the injection well; and automatically allocating an increased amount of steam to the injection well for delivery to the injection well during a subsequent time period.

45. The method of claim 44 wherein the first time period corresponds to a first day, and the second time period corresponds to a second, subsequent day.

* * * * *